US007755587B2

(12) United States Patent
Kumagai et al.

(10) Patent No.: US 7,755,587 B2
(45) **Date of Patent: *Jul. 13, 2010**

(54) INTEGRATED CIRCUIT DEVICE AND ELECTRONIC INSTRUMENT

(75) Inventors: Takashi Kumagai, Chino (JP); Hisanobu Ishiyama, Chino (JP); Kazuhiro Maekawa, Chino (JP); Satoru Ito, Suwa (JP); Takashi Fujise, Shiojiri (JP); Junichi Karasawa, Tatsuno-machi (JP); Satoru Kodaira, Chino (JP)

(73) Assignee: Seiko Epson Corporation, Tokyo (JP)

( * ) Notice: Subject to any disclaimer, the term of this patent is extended or adjusted under 35 U.S.C. 154(b) by 758 days.

This patent is subject to a terminal disclaimer.

(21) Appl. No.: 11/477,715

(22) Filed: Jun. 30, 2006

(65) Prior Publication Data

US 2007/0002188 A1 Jan. 4, 2007

(30) Foreign Application Priority Data

| | | |
|---|---|---|
| Jun. 30, 2005 | (JP) | 2005-192479 |
| Sep. 1, 2005 | (JP) | 2005-253383 |
| Sep. 1, 2005 | (JP) | 2005-253384 |
| Sep. 1, 2005 | (JP) | 2005-253385 |

(51) Int. Cl.
*G09G 3/36* (2006.01)

(52) U.S. Cl. ..... 345/98; 345/204; 365/230.03

(58) Field of Classification Search ..... 345/87–104, 345/204–206; 365/63, 230.03, 230.06
See application file for complete search history.

(56) References Cited

U.S. PATENT DOCUMENTS

| | | | |
|---|---|---|---|
| 4,472,638 | A | 9/1984 | Nishizawa et al. |
| 4,566,038 | A | 1/1986 | Dimick |
| 4,587,629 | A | 5/1986 | Dill et al. |
| 4,648,077 | A | 3/1987 | Pinkham et al. |
| 4,975,753 | A | 12/1990 | Ema |

(Continued)

FOREIGN PATENT DOCUMENTS

| | | |
|---|---|---|
| CN | 1534560 | 10/2004 |

(Continued)

OTHER PUBLICATIONS

U.S. Appl. No. 12/000,882, filed Dec. 18, 2007 in the name of Kodaira et al.

(Continued)

*Primary Examiner*—Regina Liang
(74) *Attorney, Agent, or Firm*—Oliff & Berridge, PLC

(57) ABSTRACT

An integrated circuit device includes first to Nth circuit blocks CB1 to CBN disposed along a direction D1 when a direction from a first side which is a short side of the integrated circuit device toward a third side opposite to the first side is a direction D1 and a direction from a second side which is a long side of the integrated circuit device toward a fourth side opposite to the second side is a direction D2. At least one of the circuit blocks on both ends of the circuit blocks CB1 to CBN is a scan driver block for driving a scan line. Or, the scan driver block SB is disposed along the direction D1 on the side of the first to Nth circuit blocks in the direction D2.

14 Claims, 40 Drawing Sheets

U.S. PATENT DOCUMENTS 5,040,152 A 8/1991 Voss et al.
5,058,058 A 10/1991 Yasuda et al.
5,233,420 A 8/1993 Piri et al.
5,325,338 A 6/1994 Runaldue et al.
5,414,443 A 5/1995 Kanatani et al.
5,426,603 A 6/1995 Nakamura et al.
5,490,114 A 2/1996 Butler et al.
5,544,306 A 8/1996 Deering et al.
5,555,209 A 9/1996 Smith et al.
5,598,346 A 1/1997 Agrawal et al.
5,659,514 A 8/1997 Hazani
5,701,269 A 12/1997 Fujii
5,739,803 A 4/1998 Neugebauer
5,767,865 A 6/1998 Inoue et al.
5,815,136 A 9/1998 Ikeda et al.
5,860,084 A 1/1999 Yaguchi
RE36,089 E 2/1999 Ooishi et al.
5,903,420 A 5/1999 Ham
5,909,125 A 6/1999 Kean
5,917,770 A 6/1999 Tanaka
5,920,885 A 7/1999 Rao
5,933,364 A 8/1999 Aoyama et al.
5,962,899 A 10/1999 Yang et al.
6,005,296 A 12/1999 Chan
6,025,822 A 2/2000 Motegi et al.
6,034,541 A 3/2000 Kopec, Jr. et al.
6,111,786 A 8/2000 Nakamura
6,118,425 A 9/2000 Kudo et al.
6,125,021 A 9/2000 Duvvury et al.
6,140,983 A 10/2000 Quanrud
6,225,990 B1 5/2001 Aoki et al.
6,229,336 B1 5/2001 Felton et al.
6,229,753 B1 5/2001 Kono et al.
6,246,386 B1 6/2001 Perner
6,259,459 B1 7/2001 Middleton
6,278,148 B1 8/2001 Watanabe et al.
6,324,088 B1 11/2001 Keeth et al.
6,339,417 B1 1/2002 Quanrud
6,421,286 B1 7/2002 Ohtani et al.
6,552,705 B1 4/2003 Hirota
6,559,508 B1 5/2003 Lin et al.
6,580,631 B1 6/2003 Keeth et al.
6,611,407 B1 8/2003 Chang
6,646,283 B1 11/2003 Akimoto et al.
6,724,378 B2 4/2004 Tamura et al.
6,731,538 B2 5/2004 Noda et al.
6,822,631 B1 11/2004 Yatabe
6,826,116 B2 11/2004 Noda et al.
6,858,901 B2 2/2005 Ker et al.
6,862,247 B2 3/2005 Yamazaki
6,873,310 B2 3/2005 Matsueda
6,873,566 B2 3/2005 Choi
6,999,353 B2 2/2006 Noda et al.
7,034,792 B2 4/2006 Tamura
7,078,948 B2 7/2006 Dosho
7,081,879 B2 7/2006 Sun et al.
7,142,221 B2 11/2006 Sakamaki et al.
7,158,439 B2 1/2007 Shionori et al.
7,164,415 B2 1/2007 Ooishi et al.
7,176,864 B2 2/2007 Moriyama et al.
7,180,495 B1 2/2007 Matsueda
7,280,329 B2 10/2007 Kim et al.
7,330,163 B2 * 2/2008 Nakai et al. ..... 345/98
7,391,668 B2 6/2008 Natori et al.
7,411,804 B2 8/2008 Kumagai et al.
7,411,861 B2 8/2008 Kodaira et al.
7,466,603 B2 12/2008 Ong
7,471,573 B2 12/2008 Kodaira et al.
7,522,441 B2 4/2009 Kumagai et al.
7,629,652 B2 12/2009 Suzuki et al.
2001/0008498 A1 7/2001 Ooishi
2001/0014051 A1 8/2001 Watanabe et al.
2001/0022744 A1 9/2001 Noda et al.
2002/0011998 A1 1/2002 Tamura
2002/0036625 A1 3/2002 Nakamura
2002/0067328 A1 6/2002 Yumoto et al.
2002/0080104 A1 6/2002 Aoki
2002/0113783 A1 8/2002 Tamura et al.
2002/0126108 A1 9/2002 Koyama et al.
2002/0154557 A1 10/2002 Mizugaki et al.
2003/0034948 A1 2/2003 Imamura
2003/0053022 A1 3/2003 Kaneko et al.
2003/0053321 A1 3/2003 Ishiyama
2003/0156103 A1 8/2003 Ota
2003/0169244 A1 9/2003 Kurokawa et al.
2003/0189541 A1 10/2003 Hashimoto
2004/0004877 A1 1/2004 Uetake
2004/0017341 A1 1/2004 Maki
2004/0021947 A1 2/2004 Schofield et al.
2004/0056252 A1 3/2004 Kasai
2004/0124472 A1 7/2004 Lin et al.
2004/0140970 A1 7/2004 Morita
2004/0164943 A1 8/2004 Ogawa et al.
2004/0239606 A1 12/2004 Ota
2004/0246215 A1 12/2004 Yoo
2005/0001797 A1 1/2005 Miller et al.
2005/0001846 A1 1/2005 Shiono
2005/0045955 A1 3/2005 Kim et al.
2005/0047266 A1 3/2005 Shionori et al.
2005/0052340 A1 3/2005 Goto et al.
2005/0057581 A1 3/2005 Horiuchi et al.
2005/0073470 A1 4/2005 Nose et al.
2005/0116960 A1 6/2005 Shioda et al.
2005/0122303 A1 6/2005 Hashimoto
2005/0184979 A1 8/2005 Sakaguchi
2005/0195149 A1 9/2005 Ito
2005/0212788 A1 9/2005 Fukuda et al.
2005/0212826 A1 9/2005 Fukuda et al.
2005/0219189 A1 10/2005 Fukuo
2005/0253976 A1 11/2005 Sekiguchi et al.
2005/0262293 A1 11/2005 Yoon
2005/0285862 A1 12/2005 Noda et al.
2006/0028417 A1 * 2/2006 Harada et al. ..... 345/93
2006/0050042 A1 * 3/2006 Yi ..... 345/98
2006/0062483 A1 3/2006 Kondo et al.
2006/0145972 A1 7/2006 Zhang et al.
2007/0000971 A1 1/2007 Kumagai et al.
2007/0001886 A1 1/2007 Ito et al.
2007/0001982 A1 1/2007 Ito et al.
2007/0001983 A1 1/2007 Ito et al.
2007/0001984 A1 1/2007 Kumagai et al.
2007/0002509 A1 1/2007 Kumagai et al.
2007/0013634 A1 1/2007 Saiki et al.
2007/0013635 A1 1/2007 Ito et al.
2007/0013687 A1 1/2007 Kodaira et al.
2007/0013706 A1 1/2007 Kodaira et al.
2007/0013707 A1 1/2007 Kodaira et al.
2007/0016700 A1 1/2007 Kodaira et al.
2007/0035503 A1 2/2007 Kurokawa et al.
2007/0187762 A1 8/2007 Saiki et al.
2010/0059882 A1 3/2010 Suzuki et al.

FOREIGN PATENT DOCUMENTS

CN 1542964 11/2004
EP 0 499 478 A2 8/1992
JP A 63-225993 9/1988
JP A 1-171190 7/1989
JP A 4-370595 12/1992
JP A 5-181154 7/1993
JP A 7-281634 10/1995
JP A 8-69696 3/1996
JP A 11-261011 9/1999
JP A 11-274424 10/1999

| | | |
|---|---|---|
| JP | A 11-330393 | 11/1999 |
| JP | A-2001-067868 | 3/2001 |
| JP | A-2001-222249 | 8/2001 |
| JP | A 2001-222276 | 8/2001 |
| JP | A-2002-83933 | 3/2002 |
| JP | A 2002-244624 | 8/2002 |
| JP | A-2002-358777 | 12/2002 |
| JP | A 2003-022063 | 1/2003 |
| JP | A 2003-330433 | 11/2003 |
| JP | A 2004-040042 | 2/2004 |
| JP | A 2004-146806 | 5/2004 |
| JP | A 2004-159314 | 6/2004 |
| JP | A 2004-328456 | 11/2004 |
| JP | A 2005-17725 | 1/2005 |
| JP | A 2005-72607 | 3/2005 |
| JP | A-2006-228770 | 8/2006 |
| KR | A 1992-17106 | 9/1992 |
| KR | 1999-88197 | 12/1999 |
| KR | A 2001-100814 | 11/2001 |
| KR | 10-2005-0011743 | 1/2005 |
| TW | 501080 | 9/2002 |
| TW | 522366 | 3/2003 |
| TW | I224300 | 3/2003 |
| TW | 563081 | 11/2003 |

OTHER PUBLICATIONS

U.S. Appl. No. 11/270,569, filed Nov. 10, 2005 in the name of Satoru Kodaira et al.
U.S. Appl. No. 11/270,546, filed Nov. 10, 2005 in the name of Satoru Kodaira et al.
U.S. Appl. No. 11/270,552, filed Nov. 10, 2005 in the name of Satoru Kodaira et al.
U.S. Appl. No. 11/270,694, filed Nov. 10, 2005 in the name of Satoru Kodaira et al.
U.S. Appl. No. 11/270,749, filed Nov. 10, 2005 in the name of Satoru Kodaira et al.
U.S. Appl. No. 11/270,551, filed Nov. 10, 2005 in the name of Takashi Kumagai et al.
U.S. Appl. No. 11/270,779, filed Nov. 10, 2005 in the name of Takashi Kumagai et al.
U.S. Appl. No. 11/270,585, filed Nov. 10, 2005 in the name of Takashi Kumagai et al.
U.S. Appl. No. 11/270,747, filed Nov. 10, 2005 in the name of Takashi Kumagai et al.
U.S. Appl. No. 11/270,632, filed Nov. 10, 2005 in the name of Takashi Kumagai et al.
U.S. Appl. No. 11/270,553, filed Nov. 10, 2005 in the name of Takashi Kumagai et al.
U.S. Appl. No. 11/270,631, filed Nov. 10, 2005 in the name of Takashi Kumagai et al.
U.S. Appl. No. 11/270,665, filed Nov. 10, 2005 in the name of Takashi Kumagai et al.
U.S. Appl. No. 11/270,549, filed Nov. 10, 2005 in the name of Satoru Kodaira et al.
U.S. Appl. No. 11/270,666, filed Nov. 10, 2005 in the name of Satoru Kodaira et al.
U.S. Appl. No. 11/270,630, filed Nov. 10, 2005 in the name of Satoru Kodaira et al.
U.S. Appl. No. 11/270,586, filed Nov. 10, 2005 in the name of Satoru Kodaira et al.
U.S. Appl. No. 11/270,547, filed Nov. 10, 2005 in the name of Satoru Kodaira et al.
U.S. Appl. No. 11/477,646, filed Jun. 30, 2006 in the name of Satoru Ito et al.
U.S. Appl. No. 11/477,742, filed Jun. 30, 2006 in the name of Satoru Ito et al.
U.S. Appl. No. 11/477,718, filed Jun. 30, 2006 in the name of Satoru Ito et al.
U.S. Appl. No. 11/477,714, filed Jun. 30, 2006 in the name of Takayuki Saiki et al.
U.S. Appl. No. 11/477,670, filed Jun. 30, 2006 in the name of Satoru Ito et al.
U.S. Appl. No. 11/477,669, filed Jun. 30, 2006 in the name of Takashi Kumagai et al.
U.S. Appl. No. 11/477,741, filed Jun. 30, 2006 in the name of Takashi Kumagai et al.
U.S. Appl. No. 11/477,720, filed Jun. 30, 2006 in the name of Takashi Kumagai et al.
U.S. Appl. No. 11/477,716, filed Jun. 30, 2006 in the name of Satoru Kodaira et al.
U.S. Appl. No. 11/477,719, filed Jun. 30, 2006 in the name of Satoru Kodaira et al.
U.S. Appl. No. 11/477,782, filed Jun. 30, 2006 in the name of Takashi Kumagai et al.
U.S. Appl. No. 11/477,647, filed Jun. 30, 2006 in the name of Satoru Kodaira et al.
Sedra & Smith, Microelectronic Circuit (Jun. 1990), Saunder College Publishing, 3rd Edition, Chapter 5, p. 300.

* cited by examiner

FIG. 4

| | WITH MEMORY (RAM) | | WITHOUT MEMORY | | CSTN | TFD |
|---|---|---|---|---|---|---|
| | AMORPHOUS TFT | LOW-TEMPERATURE POLYSILICON TFT | AMORPHOUS TFT | LOW-TEMPERATURE POLYSILICON TFT | | |
| MEMORY (RAM) | INCLUDE | INCLUDE | NOT INCLUDE | NOT INCLUDE | INCLUDE | INCLUDE |
| DATA DRIVER | INCLUDE | INCLUDE | INCLUDE | INCLUDE | INCLUDE | INCLUDE |
| SCAN DRIVER | INCLUDE | NOT INCLUDE | INCLUDE | NOT INCLUDE | INCLUDE | INCLUDE |
| LOGIC CIRCUIT (G/A) | INCLUDE | INCLUDE | INCLUDE | INCLUDE | INCLUDE | INCLUDE |
| GRAYSCALE VOLTAGE GENERATION CIRCUIT ($\gamma$) | INCLUDE | INCLUDE | INCLUDE | INCLUDE | NOT INCLUDE | NOT INCLUDE |
| POWER SUPPLY CIRCUIT | INCLUDE | INCLUDE | INCLUDE | INCLUDE | INCLUDE | INCLUDE |

AMPLITUDE ADJUSTMENT

INCLINATION ADJUSTMENT

FINE ADJUSTMENT

HORIZONTAL TYPE CELL

VERTICAL TYPE CELL

FIG. 39A HORIZONTAL CELL
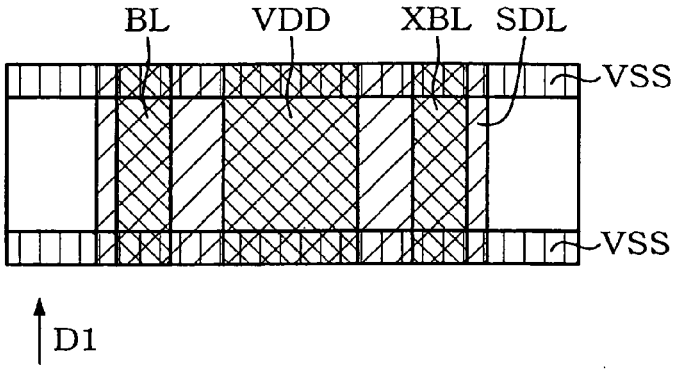
| | |
|---|---|
| ME5 | GL (GRAYSCALE VOLTAGE OUTPUT LINE) |
| ME4 | SDL (VSS) |
| ME3 | WL,VSS |
| ME2 | BL,XBL,VDD |
| ME1 | NODE CONNECTION |
FIG. 39B VERTICAL CELL
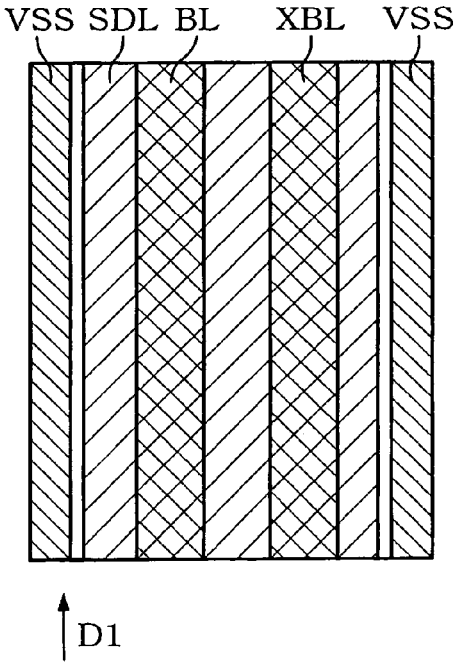
| | |
|---|---|
| ME5 | GL (GRAYSCALE VOLTAGE OUTPUT LINE) |
| ME4 | SDL (VSS) |
| ME3 | BL,XBL,VSS |
| ME2 | WL,VDD |
| ME1 | NODE CONNECTION |

INTEGRATED CIRCUIT DEVICE AND ELECTRONIC INSTRUMENT

Japanese Patent Application No. 2005-192479 filed on Jun. 30, 2005, Japanese Patent Application No. 2005-253383 filed on Sep. 1, 2005, Japanese Patent Application No. 2005-253384 filed on Sep. 1, 2005, and Japanese Patent Application No. 2005-253385 filed on Sep. 1, 2005, are hereby incorporated by reference in their entirety.

BACKGROUND OF THE INVENTION

The present invention relates to an integrated circuit device and an electronic instrument.

A display driver (LCD driver) is an example of an integrated circuit device which drives a display panel such as a liquid crystal panel (JP-A-2001-222249). A reduction in the chip size is required for the display driver in order to reduce cost.

However, the size of the display panel incorporated in a portable telephone or the like is almost constant. Therefore, if the chip size is reduced by merely shrinking the integrated circuit device as the display driver by using a microfabrication technology, it becomes difficult to mount the integrated circuit device.

SUMMARY

A first aspect of the invention relates to an integrated circuit device comprising first to Nth circuit blocks (N is an integer of two or more) disposed along a first direction when a direction from a first side which is a short side of the integrated circuit device toward a third side opposite to the first side is the first direction and a direction from a second side which is a long side of the integrated circuit device toward a fourth side opposite to the second side is a second direction, one of the circuit blocks on both ends of the first to Nth circuit blocks being a scan driver block for driving a scan line, and the circuit block(s) of the first to Nth circuit blocks excluding the scan driver block including at least one data driver block for driving a data line.

A second aspect of the invention relates to an electronic instrument comprising:

the above integrated circuit device; and a display panel driven by the integrated circuit device.

A third aspect of the invention relates to an integrated circuit device comprising first to Nth circuit blocks (N is an integer of three or more) disposed along a first direction when a direction from a first side which is a short side of the integrated circuit device toward a third side opposite to the first side is the first direction and a direction from a second side which is a long side of the integrated circuit device toward a fourth side opposite to the second side is a second direction, the circuit blocks on both ends of the first to Nth circuit blocks being first and second scan driver blocks for driving a scan line, and the circuit block(s) of the first to Nth circuit blocks excluding the circuit blocks on the ends including at least one data driver block for driving a data line.

A fourth aspect of the invention relates to an electronic instrument comprising:

the above integrated circuit device; and a display panel driven by the integrated circuit device.

A fifth aspect of the invention relates to an integrated circuit device comprising:

first to Nth circuit blocks (N is an integer of two or more) disposed along a first direction when a direction from a first side which is a short side of the integrated circuit device toward a third side opposite to the first side is the first direction and a direction from a second side which is a long side of the integrated circuit device toward a fourth side opposite to the second side is a second direction; and a scan driver block for driving a scan line;

the scan driver block being disposed along the first direction on a side of the first to Nth circuit blocks in the second direction.

A sixth aspect of the invention relates to an electronic instrument comprising:

the above integrated circuit device; and a display panel driven by the integrated circuit device.

BRIEF DESCRIPTION OF THE SEVERAL VIEWS OF THE DRAWING

FIG. 4 is an example of various types of display drivers and circuit blocks provided in the display drivers.

FIGS. 39A and 39B are views illustrative of a shield line formation method.

DETAILED DESCRIPTION OF THE EMBODIMENT

Figure 1A:
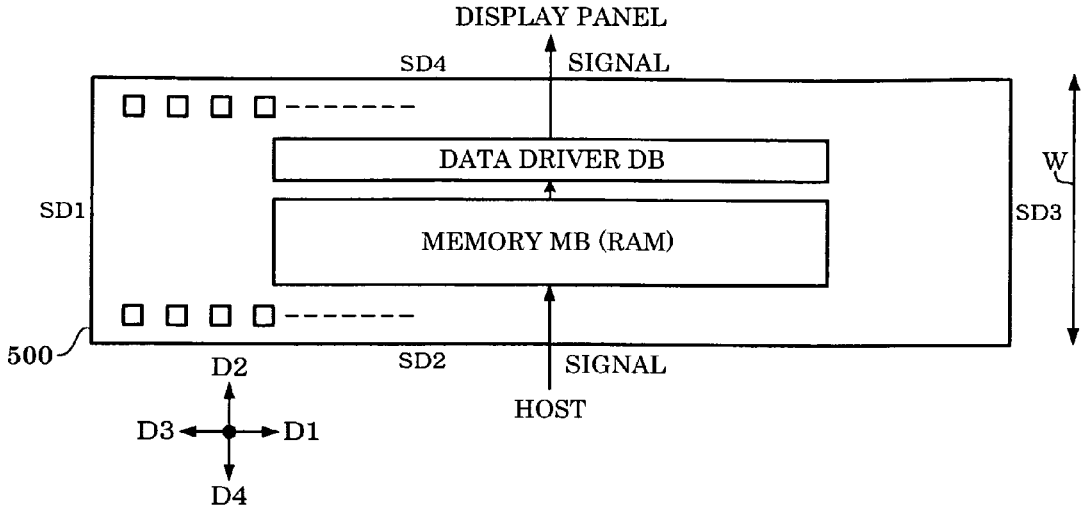
FIGS. 1A, 1B, and 1C are illustrative of a comparative example of one embodiment of the invention.

The invention may provide an integrated circuit device which can reduce the circuit area, and an electronic instrument including the same.

One embodiment of the invention relates to an integrated circuit device comprising first to Nth circuit blocks (N is an integer of two or more) disposed along a first direction when a direction from a first side which is a short side of the integrated circuit device toward a third side opposite to the first side is the first direction and a direction from a second side which is a long side of the integrated circuit device toward a fourth side opposite to the second side is a second direction, one of the circuit blocks on both ends of the first to Nth circuit blocks being a scan driver block for driving a scan line, and the circuit block(s) of the first to Nth circuit blocks excluding the scan driver block including at least one data driver block for driving a data line.

According to this embodiment, the first to Nth circuit blocks are disposed along the first direction. One of the circuit blocks on the ends of the first to Nth circuit blocks is the scan driver block, and the data driver block is disposed as another circuit block. The scan driver block is a circuit block which implements the function of a scan driver for scanning the scan line of a display panel. The data driver block is a circuit block which implements the function of a data driver for driving the data line of the display panel. Therefore, in an integrated circuit device which scans the scan line of the display panel and drives the data line of the display panel, the data driver block can be disposed near the center of the integrated circuit device. This allows output lines of data signals from the data driver block and the like to be efficiently and simply provided. As a result, the width of the integrated circuit device in the second direction can be reduced, whereby a narrow integrated circuit device can be provided. A demand for a reduction in the picture frame size can also be satisfied. Moreover, the length of the wiring between the integrated circuit device and the display panel and the wiring region can be reduced, and the mounting area can also be reduced.

In the integrated circuit device according to this embodiment, the circuit blocks excluding the scan driver block and the data driver block(s) may include:

a logic circuit block which sets grayscale characteristic adjustment data;

a grayscale voltage generation circuit block which generates a grayscale voltage based on the set adjustment data; and a power supply circuit block which generates a power supply voltage; and the data driver block(s) may receive the grayscale voltage from the grayscale voltage generation circuit block and drive the data line.

According to this embodiment, the first to Nth circuit blocks further include the logic circuit block, the grayscale voltage generation circuit block, and the power supply circuit block. In this embodiment, the data driver block is disposed between the logic circuit block and the grayscale voltage generation circuit block and the power supply circuit block. Therefore, wiring or transistor arrangement can be enabled by utilizing the space on the side of the logic circuit block and the power supply circuit block in the second direction or the fourth direction opposite to the second direction, whereby the wiring (routing) and arrangement (placement) efficiency can be increased. As a result, the width of the integrated circuit device in the second direction can be reduced, whereby a narrow integrated circuit device can be provided.

In the integrated circuit device according to this embodiment, the power supply circuit block may be disposed between the scan driver block and the data driver block.

According to this embodiment, wiring can be provided by utilizing the space on the side of the power supply circuit block in the second direction or the fourth direction, whereby wiring efficiency can be increased.

In the integrated circuit device according to this embodiment, the data driver block(s) may be disposed between one block and another block, the one block including the logic circuit block and the grayscale voltage generation circuit block, the another block including the power supply circuit block.

This allows wiring to be formed using the space on the side of the power supply circuit block and the logic circuit block in the second direction or the fourth direction, whereby the wiring efficiency can be increased.

In the integrated circuit device according to this embodiment, the logic circuit block and the grayscale voltage generation circuit block may be adjacently disposed along the first direction.

This reduces the width of the integrated circuit device in the second direction in comparison with a method of disposing the logic circuit block and the grayscale voltage generation circuit block along the second direction, whereby a narrow integrated circuit device can be provided. Moreover, even if the circuit configuration of one of the logic circuit block and the grayscale voltage generation circuit block has been changed, other circuit blocks can be prevented from being affected, whereby the design efficiency can be improved.

In the integrated circuit device according to this embodiment, the grayscale voltage generation circuit block may be disposed between the data driver block and the logic circuit block.

This allows an adjustment data signal line or a grayscale voltage output line to be efficiently provided, whereby wiring efficiency can be increased.

In the integrated circuit device according to this embodiment, the circuit block(s) of the first to Nth circuit blocks excluding the scan driver block and the data driver block(s) may include at least one memory block which stores image data; and the memory block and the data driver block may be adjacently disposed along the first direction.

This reduces the width of the integrated circuit device in the second direction in comparison with a method of disposing the memory block and the data driver block along the second direction, whereby a narrow integrated circuit device can be provided. Moreover, when the configuration of the memory block or the data driver block or the like is changed, the effects on other circuit blocks can be minimized.

In the integrated circuit device according to this embodiment, the circuit block(s) of the first to Nth circuit blocks excluding the scan driver block and the data driver block(s) may include first to Ith memory blocks (I is an integer of two or more) and first to Ith data driver blocks respectively disposed adjacent to the first to Ith memory blocks along the first direction.

This allows arrangement of the first to Ith memory blocks in a number optimum for the number of bits of image data to be stored and the corresponding first to Ith data driver blocks. Moreover, the width of the integrated circuit device in the second direction and the length of the integrated circuit device in the first direction can be adjusted by the number of blocks, whereby the width in the second direction can be reduced.

In the integrated circuit device according to this embodiment, the grayscale voltage generation circuit block may include:

a select voltage generation circuit which outputs a select voltage based on a power supply voltage, and a grayscale voltage select circuit which selects and outputs the grayscale voltage based on the adjustment data set by the logic circuit block and the select voltage.

In the integrated circuit device according to this embodiment, the select voltage generation circuit may be disposed on a side of the grayscale voltage select circuit in the second direction or a fourth direction opposite to the second direction.

This allows an adjustment data signal line and a select voltage signal line to be efficiently provided.

In the integrated circuit device according to this embodiment, the grayscale voltage generation circuit block may be disposed between the data driver block and the logic circuit block.

This allows an adjustment data signal line, a select voltage signal line, and a grayscale voltage signal line to be efficiently provided.

In the integrated circuit device according to this embodiment, a grayscale voltage output line to which the grayscale voltage from the grayscale voltage generation circuit block is output may be provided over the first to Nth circuit blocks along the first direction.

This allows a grayscale voltage signal line to be efficiently provided by utilizing the region of the first to Nth circuit blocks.

In the integrated circuit device according to this embodiment, the circuit block(s) of the first to Nth circuit blocks excluding the scan driver block and the data driver block(s) may include at least one memory block which stores image data; and in the memory block, a shield line may be provided in an upper layer of a bitline, and a grayscale voltage output line to which the grayscale voltage from the grayscale voltage generation circuit block is output may be provided in an upper layer of the shield line.

This effectively prevents a situation in which the voltage level of the bitline is erroneously changed due to a coupling capacitor.

In the integrated circuit device according to this embodiment, in the memory block, the bitline may be provided along the first direction, and the shield line may be provided along the first direction to overlap the bitline.

This achieves effective bitline shielding.

The integrated circuit device according to this embodiment may comprise:

a first interface region provided along the fourth side on a side of the first to Nth circuit blocks in the second direction; and a second interface region provided along the second side on a side of the first to Nth circuit blocks in a fourth direction opposite to the second direction.

Another embodiment of the invention relates to an electronic instrument comprising:

the above integrated circuit device; and a display panel driven by the integrated circuit device.

Another embodiment of the invention relates to an integrated circuit device comprising first to Nth circuit blocks (N is an integer of three or more) disposed along a first direction when a direction from a first side which is a short side of the integrated circuit device toward a third side opposite to the first side is the first direction and a direction from a second side which is a long side of the integrated circuit device toward a fourth side opposite to the second side is a second direction, the circuit blocks on both ends of the first to Nth circuit blocks being first and second scan driver blocks for driving a scan line, and the circuit block(s) of the first to Nth circuit blocks excluding the circuit blocks on the ends including at least one data driver block for driving a data line.

According to this embodiment, the first to Nth circuit blocks are disposed along the first direction. The circuit blocks on the ends of the first to Nth circuit blocks are the first and second scan driver blocks, and the data driver block is disposed as another circuit block. Each of the first and second scan driver blocks is a circuit block which realizes the function of a scan driver for scanning the scan line of a display panel. The data driver block is a circuit block which implements the function of a data driver for driving the data line of the display panel. For example, a first scan signal group from the first scan driver block can be input to the display panel from the left side, and a second scan signal group from the second scan driver block can be input to the display panel from the right side. Specifically, a scan signal output pad can be disposed on the side of the first and second scan driver block of the integrated circuit device in the second direction, and the output pad of the data signal from the data driver block is disposed near the center of the integrated circuit device. Therefore, an integrated circuit device which scans the scan line of the display panel and drives the data line of the display panel can be efficiently mounted, and the display panel can be comb-tooth driven, for example. This allows output lines of scan signals from the scan driver block or output lines of data signals from the data driver block to be efficiently and simply provided. As a result, the width of the integrated circuit device in the second direction can be reduced, whereby a narrow integrated circuit device can be provided.

In the integrated circuit device according to this embodiment, the circuit blocks excluding the circuit blocks on the ends may include:

a logic circuit block which sets grayscale characteristic adjustment data;

a grayscale voltage generation circuit block which generates a grayscale voltage based on the set adjustment data; and a power supply circuit block which generates a power supply voltage; and the data driver block(s) may receive the grayscale voltage from the grayscale voltage generation circuit block and drive the data line.

According to this embodiment, the first to Nth circuit blocks further include the logic circuit block, the grayscale voltage generation circuit block, and the power supply circuit block. In this embodiment, the data driver block is disposed between the logic circuit block and the grayscale voltage generation circuit block and the power supply circuit block. Therefore, wiring or transistor arrangement can be enabled by utilizing the space on the side of the logic circuit block and the power supply circuit block in the second direction or the fourth direction opposite to the second direction, whereby the wiring (routing) and arrangement (placement) efficiency can be increased. As a result, the width of the integrated circuit device in the second direction can be reduced, whereby a narrow integrated circuit device can be provided.

In the integrated circuit device according to this embodiment, the power supply circuit block may be disposed between the first scan driver block and the data driver block; and the logic circuit block and the grayscale voltage generation circuit block may be disposed between the second scan driver block and the data driver block.

According to this embodiment, wiring can be provided by utilizing the space on the side of the power supply circuit block in the second direction or the fourth direction, whereby wiring efficiency can be increased.

In the integrated circuit device according to this embodiment, the data driver block(s) may be disposed between one block and another block, the one block including the logic circuit block and the grayscale voltage generation circuit block, the another block including the power supply circuit block.

This allows wiring to be formed using the space on the side of the power supply circuit block and the logic circuit block in the second direction or the fourth direction, whereby the wiring efficiency can be increased.

In the integrated circuit device according to this embodiment, the logic circuit block and the grayscale voltage generation circuit block may be adjacently disposed along the first direction.

This reduces the width of the integrated circuit device in the second direction in comparison with a method of disposing the logic circuit block and the grayscale voltage generation circuit block along the second direction, whereby a narrow integrated circuit device can be provided. Moreover, even if the circuit configuration of one of the logic circuit block and the grayscale voltage generation circuit block has been changed, other circuit blocks can be prevented from being affected, whereby the design efficiency can be improved.

In the integrated circuit device according to this embodiment, the grayscale voltage generation circuit block may be disposed between the data driver block and the logic circuit block.

This allows an adjustment data signal line or a grayscale voltage output line to be efficiently provided, whereby wiring efficiency can be increased.

In the integrated circuit device according to this embodiment, the circuit block(s) of the first to Nth circuit blocks excluding the circuit blocks on the ends may include at least one memory block which stores image data; and the memory block and the data driver block may be adjacently disposed along the first direction.

This reduces the width of the integrated circuit device in the second direction in comparison with a method of disposing the memory block and the data driver block along the second direction, whereby a narrow integrated circuit device can be provided. Moreover, when the configuration of the memory block or the data driver block or the like is changed, the effects on other circuit blocks can be minimized.

In the integrated circuit device according to this embodiment, the circuit block(s) of the first to Nth circuit blocks excluding the circuit blocks on the ends may include first to Ith memory blocks (I is an integer of two or more) and first to Ith data driver blocks respectively disposed adjacent to the first to Ith memory blocks along the first direction.

This allows arrangement of the first to Ith memory blocks in a number optimum for the number of bits of image data to be stored and the corresponding first to Ith data driver blocks. Moreover, the width of the integrated circuit device in the second direction and the length of the integrated circuit device in the first direction can be adjusted by the number of blocks, whereby the width in the second direction can be reduced.

In the integrated circuit device according to this embodiment, the grayscale voltage generation circuit block may include:

a select voltage generation circuit which outputs a select voltage based on a power supply voltage; and a grayscale voltage select circuit which selects and outputs the grayscale voltage based on the adjustment data set by the logic circuit block and the select voltage.

In the integrated circuit device according to this embodiment, the select voltage generation circuit may be disposed on a side of the grayscale voltage select circuit in the second direction or a fourth direction opposite to the second direction.

This allows an adjustment data signal line and a select voltage signal line to be efficiently provided.

In the integrated circuit device according to this embodiment, a grayscale voltage output line to which the grayscale voltage from the grayscale voltage generation circuit block is output may be provided over the first to Nth circuit blocks along the first direction.

This allows a grayscale voltage signal line to be efficiently provided by utilizing the region of the first to Nth circuit blocks.

In the integrated circuit device according to this embodiment, the circuit block(s) of the first to Nth circuit blocks excluding the circuit blocks on the ends may include at least one memory block which stores image data; and in the memory block, a shield line may be provided in an upper layer of a bitline, and a grayscale voltage output line to which the grayscale voltage from the grayscale voltage generation circuit block is output may be provided in an upper layer of the shield line.

This effectively prevents a situation in which the voltage level of the bitline is erroneously changed due to a coupling capacitor.

In the integrated circuit device according to this embodiment, in the memory block, the bitline may be provided along the first direction, and the shield line may be provided along the first direction to overlap the bitline.

This achieves effective bitline shielding.

The integrated circuit device according to this embodiment may comprise:

a first interface region provided along the fourth side on a side of the first to Nth circuit blocks in the second direction;

wherein the power supply circuit block may generate a plurality of power supply voltages supplied to the first to Nth circuit blocks; and one of the power supply voltages at a highest potential may be supplied as a power supply voltage of at least one of the first and second scan driver blocks through a power supply voltage supply line provided in the first interface region.

The integrated circuit device according to this embodiment may comprise:

a first interface region provided along the fourth side on a side of the first to Nth circuit blocks in the second direction; and a second interface region provided along the second side on a side of the first to Nth circuit blocks in a fourth direction opposite to the second direction.

Another embodiment of the invention relates to an electronic instrument comprising:

the above integrated circuit device; and a display panel driven by the integrated circuit device.

Another embodiment of the invention relates to an integrated circuit device comprising:

first to Nth circuit blocks (N is an integer of two or more) disposed along a first direction when a direction from a first side which is a short side of the integrated circuit device toward a third side opposite to the first side is the first direction and a direction from a second side which is a long side of the integrated circuit device toward a fourth side opposite to the second side is a second direction; and a scan driver block for driving a scan line;

the scan driver block being disposed along the first direction on a side of the first to Nth circuit blocks in the second direction.

In this embodiment, the first to Nth circuit blocks are disposed along the first direction. The scan driver block for driving the scan line is disposed along the first direction on the side of the first to Nth circuit blocks in the second direction. This allows the scan signal output line from the scan driver block to be provided in the second direction along a short path. As a result, the scan signal output line can be simply provided, whereby an increase in the wiring region of the scan signal output line due to intersection with other signal lines can be reduced.

In the integrated circuit device according to this embodiment, a power supply line for supplying a power supply voltage of the scan driver block may be provided in the scan driver block along the first direction.

Therefore, it is unnecessary to provide the power supply line over the first to Nth circuit blocks, whereby the first to Nth circuit blocks can be prevented from adverse affects such as malfunction due to coupling with the power supply line to which a high power supply voltage is supplied. When it is necessary to provide the power supply line with a guard ring or the like due to high voltage, the wiring region of the power supply lines can be provided almost inside the scan driver block. Moreover, the power supply lines can be easily connected with all circuits which generate the scan signal, whereby the power supply lines can be efficiently provided. Therefore, layout design can be facilitated.

The integrated circuit device according to this embodiment may comprise:

a pad electrically connected with the scan line;

wherein the scan driver block may include:

a level shifter which converts a voltage level of a scan signal for scanning the scan line;

an output circuit including an output transistor for outputting one of a high-potential-side power supply voltage and a low-potential-side power supply voltage to the pad based on the scan signal of which the voltage level has been converted by the level shifter; and the output transistor may be disposed in a lower layer of the pad.

According to this embodiment, the width of the integrated circuit device in the second direction can be reduced, whereby a narrow integrated circuit device can be provided.

The integrated circuit device according to this embodiment may comprise:

a pad electrically connected with the scan line; and at least one data driver block for driving a data line;

wherein a drive signal output line through which the data driver block(s) outputs a drive signal for driving the data line may be provided in the scan driver block along the second direction; and a scan signal output line through which a scan signal for the scan driver block to scan the scan line is output may be electrically connected with the pad through a wiring layer differing from the drive signal output line.

According to this embodiment, the scan signal output line can be connected with the pad from the scan driver block disposed along the first direction of the integrated circuit device along a short path. This minimizes the adverse effects of the high-voltage power supply line on other circuit blocks.

In the integrated circuit device according to this embodiment, the first to Nth circuit blocks may include:

a logic circuit block which sets grayscale characteristic adjustment data;

a grayscale voltage generation circuit block which generates a grayscale voltage based on the set adjustment data; and at least one data driver block which receives the grayscale voltage from the grayscale voltage generation circuit block and drives a data line; and a power supply circuit block which generates a power supply voltage; and the data driver block(s) may be disposed between the logic circuit block and the grayscale voltage generation circuit block and the power supply circuit block.

According to this embodiment, the first to Nth circuit blocks are disposed along the first direction, and include the logic circuit block, the grayscale voltage generation circuit block, the data driver block, and the power supply circuit block. In this embodiment, the data driver block is disposed between the logic circuit block and the grayscale voltage generation circuit block and the power supply circuit block. Therefore, wiring or transistor arrangement can be enabled by utilizing the space on the side of the logic circuit block and the power supply circuit block in the second direction or the fourth direction opposite to the second direction, whereby the wiring (routing) and arrangement (placement) efficiency can be increased. Since the data driver block can be disposed near the center of the integrated circuit device, output lines of data signals from the data driver block can be efficiently and simply provided. As a result, the width of the integrated circuit device in the second direction can be reduced, whereby a narrow integrated circuit device can be provided.

In the integrated circuit device according to this embodiment, the power supply circuit block may generate a plurality of power supply voltages supplied to the first to Nth circuit blocks; and a power supply voltage of the scan driver block may be one of the power supply voltages at a highest potential.

In the integrated circuit device according to this embodiment, the grayscale voltage generation circuit block may include:

a select voltage generation circuit which outputs a select voltage based on a power supply voltage; and a grayscale voltage select circuit which selects and outputs the grayscale voltage based on the adjustment data set by the logic circuit block and the select voltage; and the select voltage generation circuit may be disposed on a side of the grayscale voltage select circuit in the second direction or a fourth direction opposite to the second direction.

This allows an adjustment data signal line and a select voltage signal line to be efficiently provided.

In the integrated circuit device according to this embodiment, the grayscale voltage generation circuit block may be disposed between the data driver block and the logic circuit block.

This allows an adjustment data signal line, a select voltage signal line, and a grayscale voltage signal line to be efficiently provided.

In the integrated circuit device according to this embodiment, the logic circuit block and the grayscale voltage generation circuit block may be adjacently disposed along the first direction.

This reduces the width of the integrated circuit device in the second direction in comparison with a method of disposing the logic circuit block and the grayscale voltage generation circuit block along the second direction, whereby a narrow integrated circuit device can be provided. Moreover, even if the circuit configuration of one of the logic circuit block and the grayscale voltage generation circuit block has been changed, other circuit blocks can be prevented from being affected, whereby the design efficiency can be improved.

In the integrated circuit device according to this embodiment, the first to Nth circuit blocks may include at least one memory block which stores image data; and the memory block and the data driver block may be adjacently disposed along the first direction.

This reduces the width of the integrated circuit device in the second direction in comparison with a method of disposing the memory block and the data driver block along the second direction, whereby a narrow integrated circuit device can be provided. Moreover, when the configuration of the memory block or the data driver block or the like is changed, the effects on other circuit blocks can be minimized.

In the integrated circuit device according to this embodiment, the first to Nth circuit blocks may include first to Ith memory blocks (I is an integer of two or more) and first to Ith data driver blocks respectively disposed adjacent to the first to Ith memory blocks along the first direction.

This allows arrangement of the first to Ith memory blocks in a number optimum for the number of bits of image data to be stored and the corresponding first to Ith data driver blocks. Moreover, the width of the integrated circuit device in the second direction and the length of the integrated circuit device in the first direction can be adjusted by the number of blocks, whereby the width in the second direction can be reduced.

In the integrated circuit device according to this embodiment, the first to Nth circuit blocks may include at least one memory block which stores image data; and in the memory block, a shield line may be provided in an upper layer of a bitline, and a grayscale voltage output line to which the grayscale voltage from the grayscale voltage generation circuit block is output may be provided in an upper layer of the shield line.

This effectively prevents a situation in which the voltage level of the bitline is erroneously changed due to a coupling capacitor.

In the integrated circuit device according to this embodiment, in the memory block, the bitline may be provided along the first direction, and the shield line may be provided along the first direction to overlap the bitline.

This achieves effective bitline shielding.

The integrated circuit device according to this embodiment may comprise:

a first interface region provided along the fourth side on a side of the first to Nth circuit blocks in the second direction; and a second interface region provided along the second side on a side of the first to Nth circuit blocks in a fourth direction opposite to the second direction.

A further embodiment of the invention relates to an electronic instrument comprising:

the above integrated circuit device; and a display panel driven by the integrated circuit device.

These embodiments of the invention will be described in detail below. Note that the embodiments described below do not in any way limit the scope of the invention laid out in the claims herein. In addition, not all of the elements of the embodiments described below should be taken as essential requirements of the invention.

1. COMPARATIVE EXAMPLE

FIG. 1A shows an integrated circuit device 500 which is a comparative example of one embodiment of the invention. The integrated circuit device 500 shown in FIG. 1A includes a memory block MB (display data RAM) and a data driver block DB. The memory block MB and the data driver block DB are disposed along a direction D2. The memory block MB and the data driver block DB are ultra-flat blocks of which the length along a direction D1 is longer than the width in the direction D2.

Image data supplied from a host is written into the memory block MB. The data driver block DB converts the digital image data written into the memory block MB into an analog data voltage, and drives data lines of a display panel. In FIG. 1A, the image data signal flows in the direction D2. Therefore, in the comparative example shown in FIG. 1A, the memory block MB and the data driver block DB are disposed along the direction D2 corresponding to the signal flow. This reduces the path between the input and the output so that a signal delay can be optimized, whereby an efficient signal transmission can be achieved.

However, the comparative example shown in FIG. 1A has the following problems.

Figure 2A:
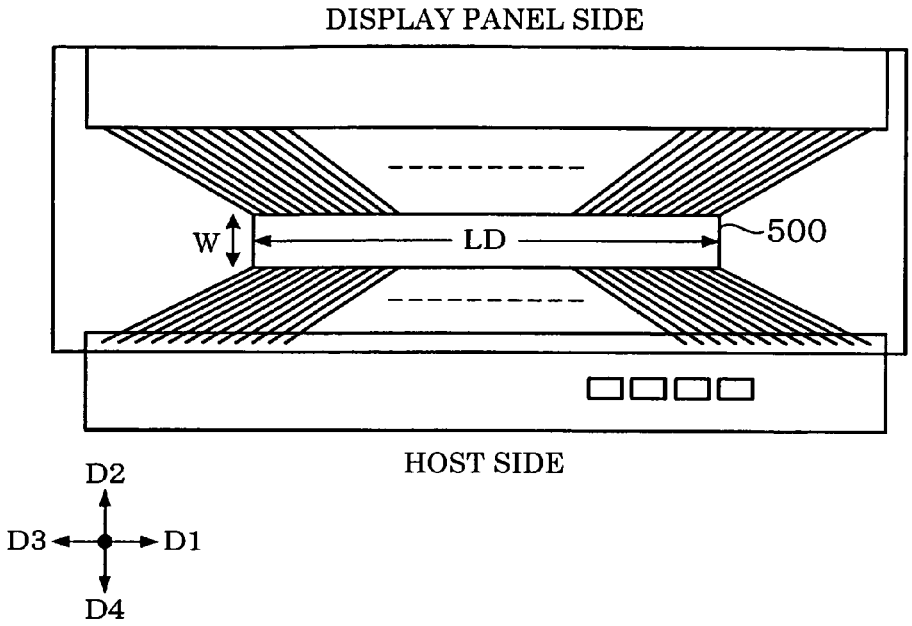
FIGS. 2A and 2B are illustrative of mounting of an integrated circuit device.

First, a reduction in the chip size is required for an integrated circuit device such as a display driver in order to reduce cost. However, if the chip size is reduced by merely shrinking the integrated circuit device 500 by using a microfabrication technology, the size of the integrated circuit device 500 is reduced not only in the short side direction but also in the long side direction. Therefore, it becomes difficult to mount the integrated circuit device 500 as shown in FIG. 2A. Specifically, it is desirable that the output pitch be 22 μm or more, for example. However, the output pitch is reduced to 17 μm by merely shrinking the integrated circuit device 500 as shown in FIG. 2A, for example, whereby it becomes difficult to mount the integrated circuit device 500 due to the narrow pitch. Moreover, the number of glass substrates obtained is decreased due to an increase in the glass frame of the display panel, whereby cost is increased.

Figure 1B:
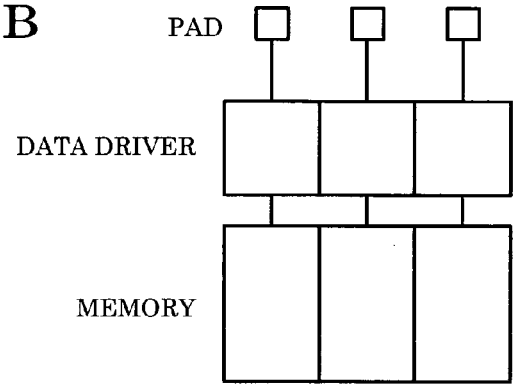
Figure 1C:
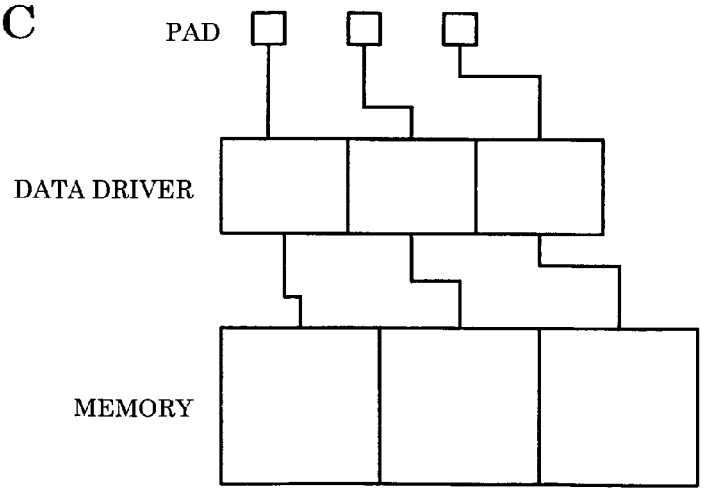

Second, the configurations of the memory and the data driver of the display driver are changed corresponding to the type of display panel (amorphous TFT or low-temperature polysilicon TFT), the number of pixels (QCIF, QVGA, or VGA), the specification of the product, and the like. Therefore, in the comparative example shown in FIG. 1A, even if the pad pitch, the cell pitch of the memory, and the cell pitch of the data driver coincide in one product as shown in FIG. 1B, the pitches do not coincide as shown in FIG. 1C when the configurations of the memory and the data driver are changed. If the pitches do not coincide as shown in FIG. 1C, an unnecessary wiring region for absorbing the pitch difference must be formed between the circuit blocks. In particular, in the comparative example shown in FIG. 1A in which the block is made flat in the direction D1, the area of an unnecessary wiring region for absorbing the pitch difference is increased. As a result, the width W of the integrated circuit device 500 in the direction D2 is increased, whereby cost is increased due to an increase in the chip area.

If the layout of the memory and the data driver is changed so that the pad pitch coincides with the cell pitch in order to avoid such a problem, the development period is increased, whereby cost is increased. Specifically, since the circuit configuration and the layout of each circuit block are individually designed and the pitch is adjusted thereafter in the comparative example shown in FIG. 1A, unnecessary area is provided or the design becomes inefficient.

2. Configuration of Integrated Circuit Device

Figure 3:
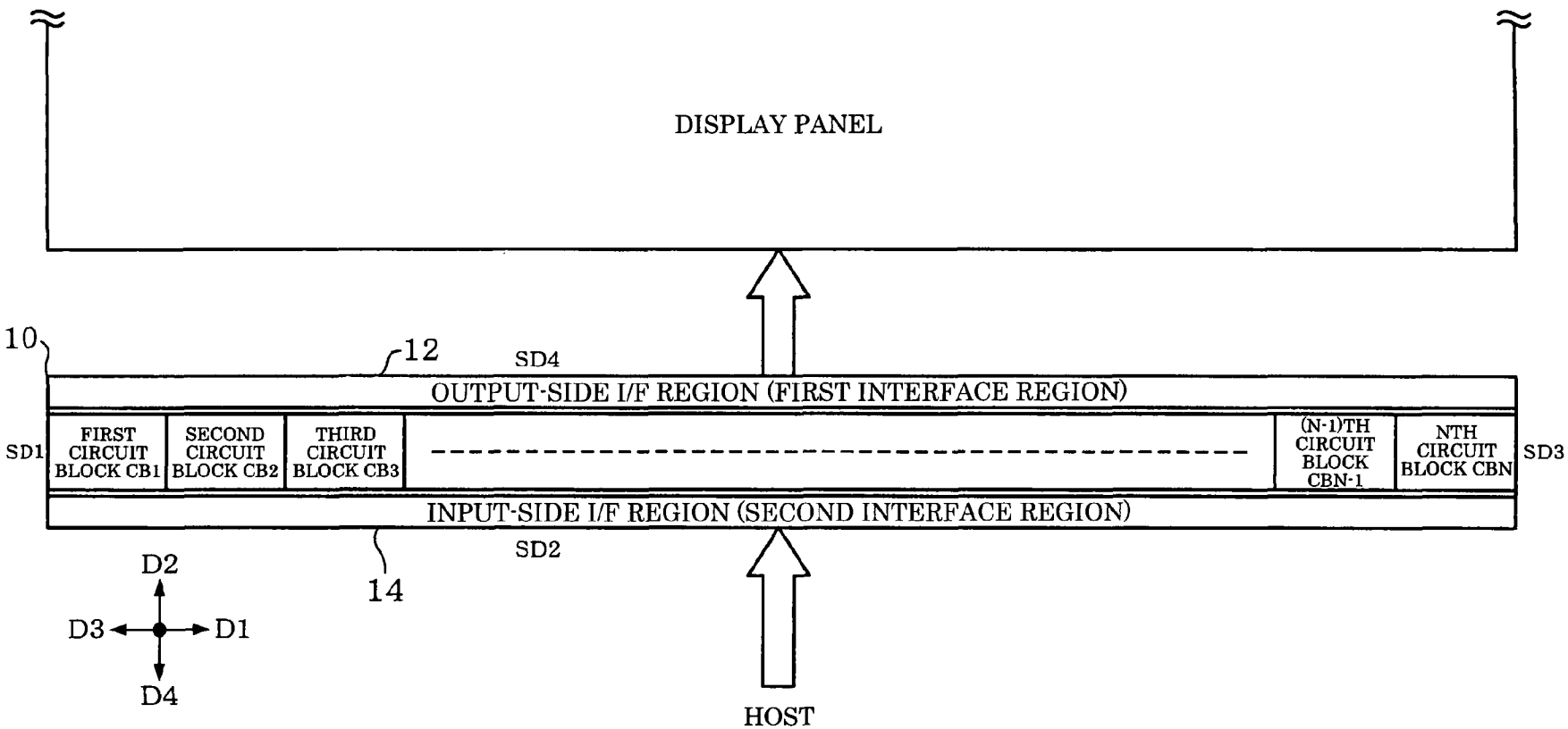
FIG. 3 is a configuration example of an integrated circuit device according to one embodiment of the invention.

FIG. 3 shows a configuration example of an integrated circuit device 10 according to one embodiment of the invention which can solve the above-described problems. In this embodiment, the direction from a first side SD1 (short side) of the integrated circuit device 10 toward a third side SD3 opposite to the first side SD1 is defined as a first direction D1, and the direction opposite to the first direction D1 is defined as a third direction D3. The direction from a second side SD2 (long side) of the integrated circuit device 10 toward a fourth side SD4 opposite to the second side SD2 is defined as a second direction D2, and the direction opposite to the second direction D2 is defined as a fourth direction D4. In FIG. 3, the left side of the integrated circuit device 10 is the first side SD1, and the right side is the third side SD3. However, the left side may be the third side SD3, and the right side may be the first side SD1.

As shown in FIG. 3, the integrated circuit device 10 according to this embodiment includes first to Nth circuit blocks CB1 to CBN (N is an integer larger than one) disposed along the direction D1. Specifically, while the circuit blocks are arranged in the direction D2 in the comparative example shown in FIG. 1A, the circuit blocks CB1 to CBN are arranged in the direction D1 in this embodiment. Each circuit block is a relatively square block differing from the ultra-flat block as in the comparative example shown in FIG. 1A.

The integrated circuit device 10 includes an output-side I/F region 12 (first interface region in a broad sense) provided along the side SD4 and on the D2 side of the first to Nth circuit blocks CB1 to CBN. The integrated circuit device 10 includes an input-side I/F region 14 (second interface region in a broad sense) provided along the side SD2 and on the D4 side of the first to Nth circuit blocks CB1 to CBN. In more detail, the output-side I/F region 12 (first I/O region) is disposed on the D2 side of the circuit blocks CB1 to CBN without other circuit blocks interposed therebetween, for example. The input-side I/F region 14 (second I/O region) is disposed on the D4 side of the circuit blocks CB1 to CBN without other circuit blocks interposed therebetween, for example. Specifically, only one circuit block (data driver block) exists in the direction D2 at least in the area in which the data driver block exists. When the integrated circuit device 10 is used as an intellectual property (IP) core and incorporated in another integrated circuit device, the integrated circuit device 10 may be configured to exclude at least one of the I/F regions 12 and 14.

The output-side (display panel side) I/F region 12 is a region which serves as an interface between the integrated circuit device 10 and the display panel, and includes pads and various elements such as output transistors and protective elements connected with the pads. In more detail, the output-side I/F region 12 includes output transistors for outputting data signals to data lines and scan signals to scan lines, for example. When the display panel is a touch panel, the output-side I/F region 12 may include input transistors.

The input-side (host side) I/F region 14 is a region which serves as an interface between the integrated circuit device 10 and a host (MPU, image processing controller, or baseband engine), and may include pads and various elements connected with the pads, such as input (input-output) transistors, output transistors, and protective elements. In more detail, the input-side I/F region 14 includes input transistors for inputting signals (digital signals) from the host, output transistors for outputting signals to the host, and the like.

An output-side or input-side I/F region may be provided along the short side SD1 or SD3. Bumps which serve as external connection terminals may be provided in the I/F (interface) regions 12 and 14, or may be provided in other regions (first to Nth circuit blocks CB1 to CBN). When providing the bumps in the region other than the I/F regions 12 and 14, the bumps are formed by using a small bump technology (e.g. bump technology using resin core) other than a gold bump technology.

The first to Nth circuit blocks CB1 to CBN may include at least two (or three) different circuit blocks (circuit blocks having different functions). Taking an example in which the integrated circuit device 10 is a display driver, the circuit blocks CB1 to CBN may include at least two of a data driver block, a memory block, a scan driver block, a logic circuit block, a grayscale voltage generation circuit block, and a power supply circuit block. In more detail, the circuit blocks CB1 to CBN may include at least a data driver block and a logic circuit block, and may further include a grayscale voltage generation circuit block. When the integrated circuit device 10 includes a built-in memory, the circuit blocks CB1 to CBN may further include a memory block.

FIG. 4 shows an example of various types of display drivers and circuit blocks provided in the display drivers. In an amorphous thin film transistor (TFT) panel display driver including a built-in memory (RAM), the circuit blocks CB1 to CBN include a memory block, a data driver (source driver) block, a scan driver (gate driver) block, a logic circuit (gate array circuit) block, a grayscale voltage generation circuit (γ-correction circuit) block, and a power supply circuit block. In a low-temperature polysilicon (LTPS) TFT panel display driver including a built-in memory, since the scan driver can be formed on a glass substrate, the scan driver block may be omitted. The memory block may be omitted in an amorphous TFT panel display driver which does not include a memory, and the memory block and the scan driver block may be omitted in a low-temperature polysilicon TFT panel display driver which does not include a memory. In a color super twisted nematic (CSTN) panel display driver and a thin film diode (TFD) panel display driver, the grayscale voltage generation circuit block may be omitted.

Figure 5A:
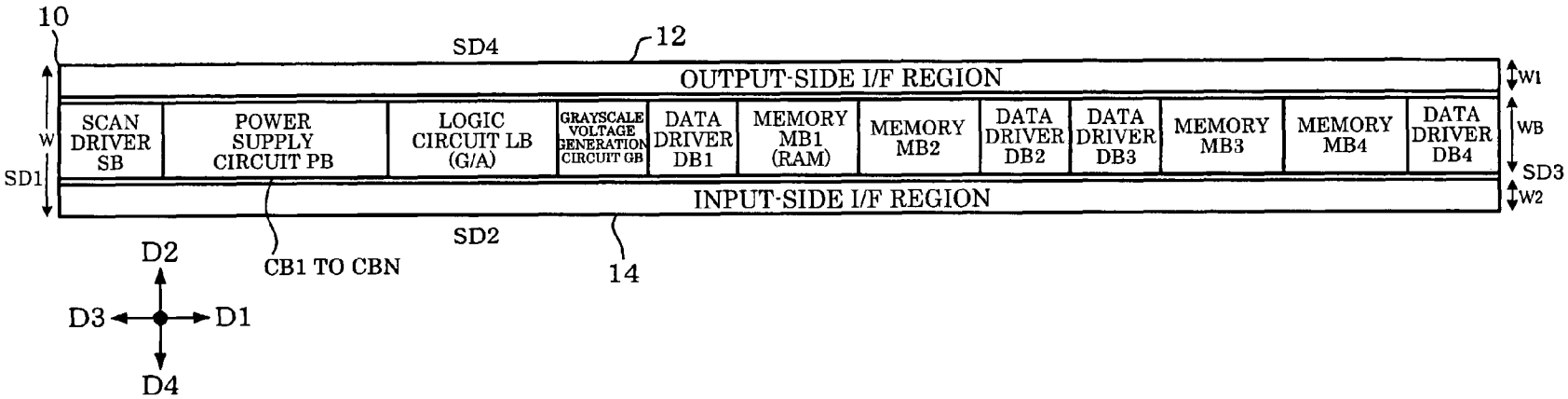
FIGS. 5A and 5B are planar layout examples of the integrated circuit device according to one embodiment of the invention.
Figure 5B:
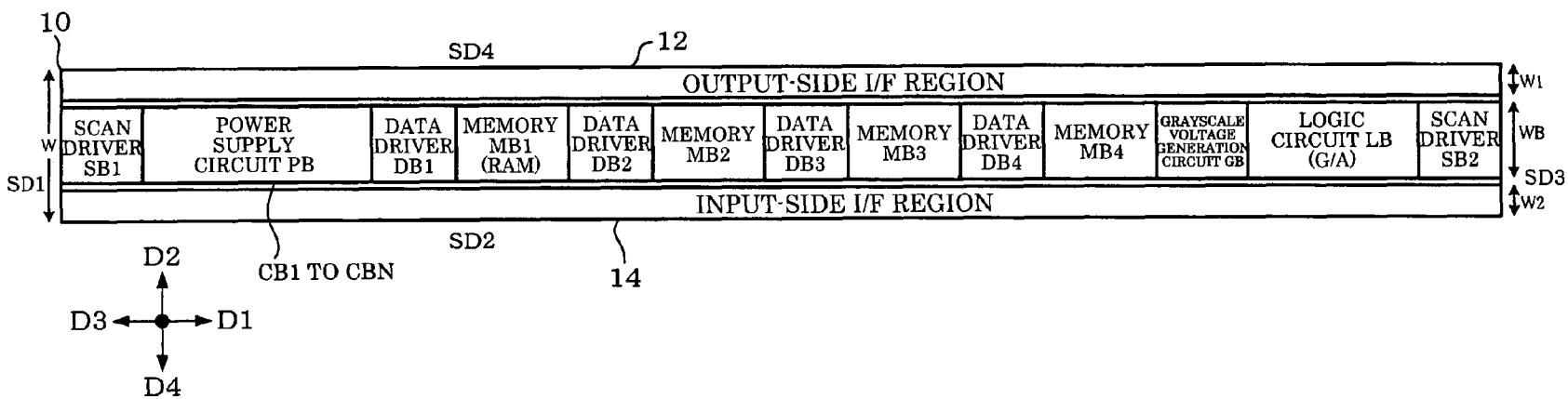

FIGS. 5A and 5B show examples of a planar layout of the integrated circuit device 10 as the display driver according to this embodiment. FIGS. 5A and 5B are examples of an amorphous TFT panel display driver including a built-in memory. FIG. 5A shows a QCIF and 32-grayscale display driver, and FIG. 5B shows a QVGA and 64-grayscale display driver.

In FIGS. 5A and 5B, the first to Nth circuit blocks CB1 to CBN include first to fourth memory blocks MB1 to MB4 (first to Ith memory blocks in a broad sense; I is an integer larger than one). The first to Nth circuit blocks CB1 to CBN include first to fourth data driver blocks DB1 to DB4 (first to Ith data driver blocks in a broad sense) respectively disposed adjacent to the first to fourth memory blocks MB1 to MB4 along the direction D1. In more detail, the memory block MB1 and the data driver block DB1 are disposed adjacent to each other along the direction D1, and the memory block MB2 and the data driver block DB2 are disposed adjacent to each other along the direction D1. The memory block MB1 adjacent to the data driver block DB1 stores image data (display data) used by the data driver block DB1 to drive the data line, and the memory block MB2 adjacent to the data driver block DB2 stores image data used by the data driver block DB2 to drive the data line.

In FIG. 5A, the data driver block DB1 (Jth data driver block in a broad sense; $1 \leqq J < I$) of the data driver blocks DB1 to DB4 is disposed adjacently on the D3 side of the memory block MB1 (Jth memory block in a broad sense) of the memory blocks MB1 to MB4. The memory block MB2 ((J+1)th memory block in a broad sense) is disposed adjacently on the D1 side of the memory block MB1. The data driver block DB2 ((J+1)th data driver block in a broad sense) is disposed adjacently on the D1 side of the memory block MB2. The arrangement of the memory blocks MB3 and MB4 and the data driver blocks DB3 and DB4 is the same as described above. In FIG. 5A, the memory block MB1 and the data driver block DB1 and the memory block MB2 and the data driver block DB2 are disposed line-symmetrical with respect to the borderline between the memory blocks MB1 and MB2, and the memory block MB3 and the data driver block DB3 and the memory block MB4 and the data driver block DB4 are disposed line-symmetrical with respect to the borderline between the memory blocks MB3 and MB4. In FIG. 5A, the data driver blocks DB2 and DB3 are disposed adjacent to each other. However, another circuit block may be disposed between the data driver blocks DB2 and DB3.

In FIG. 5B, the data driver block DB1 (Jth data driver block) of the data driver blocks DB1 to DB4 is disposed adjacently on the D3 side of the memory block MB1 (Jth memory block) of the memory blocks MB1 to MB4. The data driver block DB2 ((J+1)th data driver block) is disposed on the D1 side of the memory block MB1. The memory block MB2 ((J+1)th memory block) is disposed on the D1 side of the data driver block DB2. The data driver block DB3, the memory block MB3, the data driver block DB4, and the memory block MB4 are disposed in the same manner as described above. In FIG. 5B, the memory block MB1 and the data driver block DB2, the memory block MB2 and the data driver block DB3, and the memory block MB3 and the data driver block DB4 are respectively disposed adjacent to each other. However, another circuit block may be disposed between these blocks.

The layout arrangement shown in FIG. 5A has an advantage in that a column address decoder can be used in common between the memory blocks MB1 and MB2 or the memory blocks MB3 and MB4 (between the Jth and (J+1)th memory blocks). The layout arrangement shown in FIG. 5B has an advantage in that the wiring pitch of the data signal output lines from the data driver blocks DB1 to DB4 to the output-side I/F region 12 can be equalized so that the wiring efficiency can be increased.

The layout arrangement of the integrated circuit device 10 according to this embodiment is not limited to those shown in FIGS. 5A and 5B. For example, the number of memory blocks and data driver blocks may be set at 2, 3, or 5 or more, or the memory block and the data driver block may not be divided into blocks. A modification in which the memory block is not disposed adjacent to the data driver block is also possible. A configuration is also possible in which the memory block, the scan driver block, the power supply circuit block, or the grayscale voltage generation circuit block is not provided. A circuit block having a width significantly small in the direction D2 (narrow circuit block having a width less than the width WB) may be provided between the circuit blocks CB1 to CBN and the output-side I/F region 12 or the input-side I/F region 14. The circuit blocks CB1 to CBN may include a circuit block in which different circuit blocks are arranged in stages in the direction D2. For example, the scan driver circuit and the power supply circuit may be formed in one circuit block.

Figure 6A:
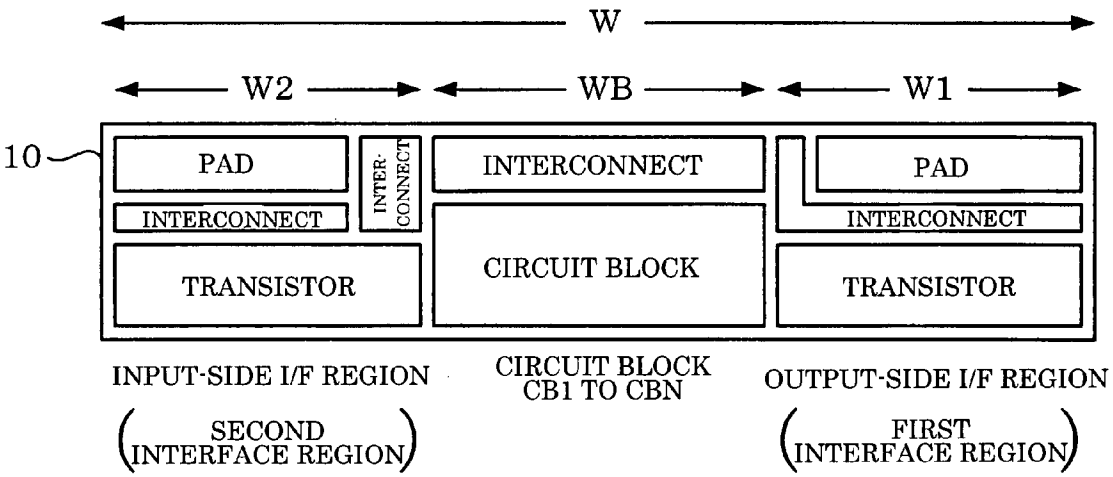
FIGS. 6A and 6B are examples of cross-sectional views of the integrated circuit device.

FIG. 6A shows an example of a cross-sectional view of the integrated circuit device 10 according to this embodiment along the direction D2. W1, WB, and W2 respectively indicate the widths of the output-side I/F region 12, the circuit blocks CB1 to CBN, and the input-side I/F region 14 in the direction D2. W indicates the width of the integrated circuit device 10 in the direction D2.

In this embodiment, as shown in FIG. 6A, other circuit blocks may not be provided between the circuit blocks CB1 to CBN (data driver block DB) and the output-side and input-side I/F regions 12 and 14. Therefore, the relationship "$W1+WB+W2 \leqq W < W1+2\times WB+W2$" is satisfied, whereby a narrow integrated circuit device can be realized. In more detail, the width W in the direction D2 may be set at "W<2 mm". More specifically, the width W in the direction D2 may be set at "W<1.5 mm". It is preferable that "W>0.9 mm" taking inspection and mounting of the chip into consideration. The length LD in the long side direction may be set at "15 mm<LD<27 mm". A chip shape ratio SP=LD/W may be set at "SP>10". More specifically, the chip shape ratio SP may be set at "SP>12".

The widths W1, WB, and W2 shown in FIG. 6A indicate the widths of transistor formation regions (bulk regions or active regions) of the output-side I/F region 12, the circuit blocks CB1 to CBN, and the input-side I/F region 14, respectively. Specifically, output transistors, input transistors, input-output transistors, transistors of electrostatic protection elements, and the like are formed in the I/F regions 12 and 14. Transistors which make up the circuits are formed in the circuit blocks CB1 to CBN. The widths W1, WB, and W2 are determined based on well regions and diffusion regions in which the transistors are formed. In order to realize a narrower integrated circuit device, it is preferable to form bumps (active surface bumps) on the transistors of the circuit blocks CB1 to CBN. In more detail, a resin core bump, in which the core is formed of a resin and a metal layer is formed on the surface of the resin, or the like is formed on the transistor (active region). The bumps (external connection terminals) are connected with the pads disposed in the I/F regions 12 and 14 through metal interconnects. The widths W1, WB, and W2 according to this embodiment are not the widths of the bump formation regions, but the widths of the transistor formation regions formed under the bumps.

The widths of the circuit blocks CB1 to CBN in the direction D2 may be identical, for example. In this case, it suffices that the width of each circuit block be substantially identical, and the width of each circuit block may differ in the range of several to 20 μm (several tens of microns), for example. When a circuit block with a different width exists in the circuit blocks CB1 to CBN, the width WB may be the maximum width of the circuit blocks CB1 to CBN. In this case, the maximum width may be the width of the data driver block in the direction D2, for example. When the integrated circuit device includes a memory, the maximum width may be the width of the memory block in the direction D2. A space region with a width of about 20 to 30 μm may be provided between the circuit blocks CB1 to CBN and the I/F regions 12 and 14, for example.

In the embodiment, a pad in which the number of stages in the direction D2 is one or more may be disposed in the output-side I/F region 12. Therefore, the width W1 of the output-side I/F region 12 in the direction D2 may be set at "0.13 mm≦W1≦0.4 mm" taking the pad width (e.g. 0.1 mm) and the pad pitch into consideration. Since a pad in which the number of stages in the direction D2 is one can be disposed in the input-side I/F region 14, the width W2 of the input-side I/F region 14 may be set at "0.1 mm≦W2≦0.2 mm". In order to realize a narrow integrated circuit device, wiring for a logic signal from the logic circuit block, a grayscale voltage signal from the grayscale voltage generation circuit block, and power supply must be formed on the circuit blocks CB1 to CBN by using global lines. The total wiring width is about 0.8 to 0.9 mm, for example. Therefore, the widths WB of the circuit blocks CB1 to CBN may be set at "0.65 mm≦WB≦1.2 mm" taking the total wiring width into consideration.

Since "0.65 mm≦WB≦1.2 mm" is satisfied even if W1=0.4 mm and W2=0.2 mm, "WB>W1+W2" is satisfied. When the widths W1, WB, and W2 are minimum values, W1=0.13 mm, WB=0.65 mm, and W2=0.1 mm so that the width W of the integrated circuit device is about 0.88 mm. Therefore, "W=0.88 mm<2×WB=1.3 mm" is satisfied. When the widths W1, WB, and W2 are maximum values, W1=0.4 mm, WB=1.2 mm, and W2=0.2 mm so that the width W of the integrated circuit device is about 1.8 mm. Therefore, "W=1.8 mm<2×WB=2.4 mm" is satisfied. Therefore, the relational expression "W<2×WB" is satisfied, whereby a narrow integrated circuit device is realized.

Figure 6B:
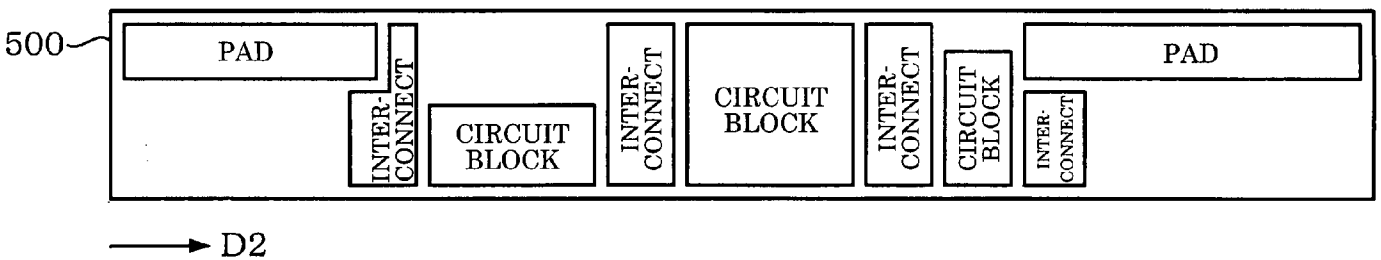

In the comparative example shown in FIG. 1A, two or more circuit blocks are disposed along the direction D2 as shown in FIG. 6B. Moreover, wiring regions are formed between the circuit blocks and between the circuit blocks and the I/F region in the direction D2. Therefore, since the width W of the integrated circuit device 500 in the direction D2 (short side direction) is increased, a slim chip cannot be realized. Therefore, even if the chip is shrunk by using a macrofabrication technology, the length LD in the direction D1 (long side direction) is decreased, as shown in FIG. 2A, so that the output pitch becomes narrow, whereby it becomes difficult to mount the integrated circuit device 500.

Figure 2B:
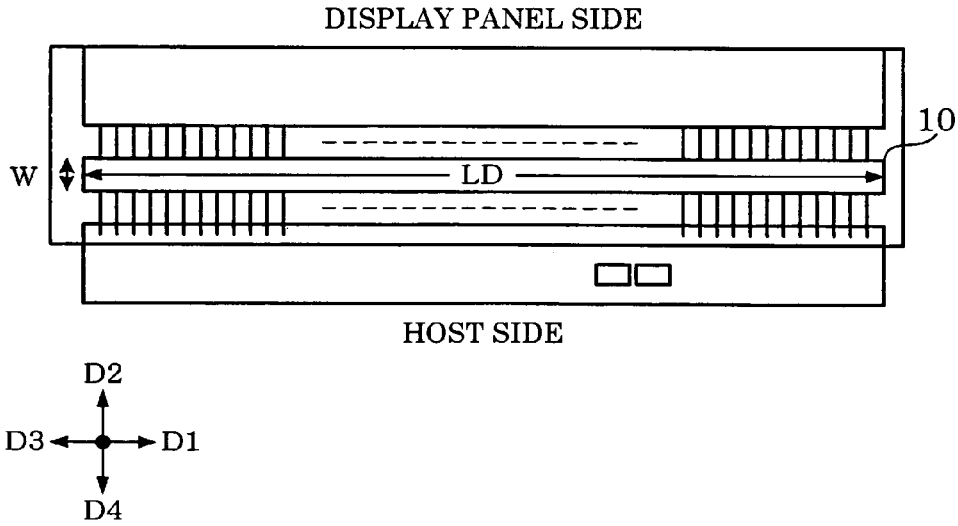

In this embodiment, the circuit blocks CB1 to CBN are disposed along the direction D1 as shown in FIGS. 3, 5A, and 5B. As shown in FIG. 6A, the transistor (circuit element) can be disposed under the pad (bump) (active surface bump). Moreover, the signal lines can be formed between the circuit blocks and between the circuit blocks and the I/F by using the global lines formed in the upper layer (lower layer of the pad) of the local lines in the circuit blocks. Therefore, since the width W of the integrated circuit device 10 in the direction D2 can be reduced while maintaining the length LD of the integrated circuit device 10 in the direction D1 as shown in FIG. 2B, a very slim chip can be realized. As a result, since the output pitch can be maintained at 22 μm or more, for example, mounting can be facilitated.

In this embodiment, since the circuit blocks CB1 to CBN are disposed along the direction D1, it is possible to easily deal with a change in the product specifications and the like. Specifically, since product of various specifications can be designed by using a common platform, the design efficiency can be increased. For example, when the number of pixels or the number of grayscales of the display panel is increased or decreased in FIGS. 5A and 5B, it is possible to deal with such a situation merely by increasing or decreasing the number of blocks of memory blocks or data driver blocks, the number of readings of image data in one horizontal scan period, or the like. FIGS. 5A and 5B show an example of an amorphous TFT panel display driver including a memory. When developing a low-temperature polysilicon TFT panel product including a memory, it suffices to remove the scan driver block from the circuit blocks CB1 to CBN. When developing a product which does not include a memory, it suffices to remove the memory block from the circuit blocks CB1 to CBN. In this embodiment, even if the circuit block is removed corresponding to the specification, since the effect on the remaining circuit blocks is minimized, the design efficiency can be increased.

In this embodiment, the widths (heights) of the circuit blocks CB1 to CBN in the direction D2 can be uniformly adjusted to the width (height) of the data driver block or the memory block, for example. Since it is possible to deal with an increase or decrease in the number of transistors of each circuit block by increasing or decreasing the length of each circuit block in the direction D1, the design efficiency can be further increased. For example, when the number of transistors is increased or decreased in FIGS. 5A and 5B due to a change in the configuration of the grayscale voltage generation circuit block or the power supply circuit block, it is possible to deal with such a situation by increasing or decreasing the length of the grayscale voltage generation circuit block or the power supply circuit block in the direction D1.

As a second comparative example, a narrow data driver block may be disposed in the direction D1, and other circuit blocks such as the memory block may be disposed along the direction D1 on the D4 side of the data driver block, for example. However, in the second comparative example, since the data driver block having a large width lies between other circuit blocks such as the memory block and the output-side I/F region, the width W of the integrated circuit device in the direction D2 is increased, so that it is difficult to realize a slim chip. Moreover, an additional wiring region is formed between the data driver block and the memory block, whereby the width W is further increased. Furthermore, when the configuration of the data driver block or the memory block is changed, the pitch difference described with reference to FIGS. 1B and 1C occurs, whereby the design efficiency cannot be increased.

As a third comparative example of this embodiment, only circuit blocks (e.g. data driver blocks) having the same function may be divided and arranged in the direction D1. However, since the integrated circuit device can be provided with only a single function (e.g. function of the data driver) in the third comparative example, development of various products cannot be realized. In this embodiment, the circuit blocks CB1 to CBN include circuit blocks having at least two different functions. Therefore, various integrated circuit devices corresponding to various types of display panels can be provided as shown in FIGS. 4, 5A, and 5B.

3. Circuit Configuration

Figure 7:
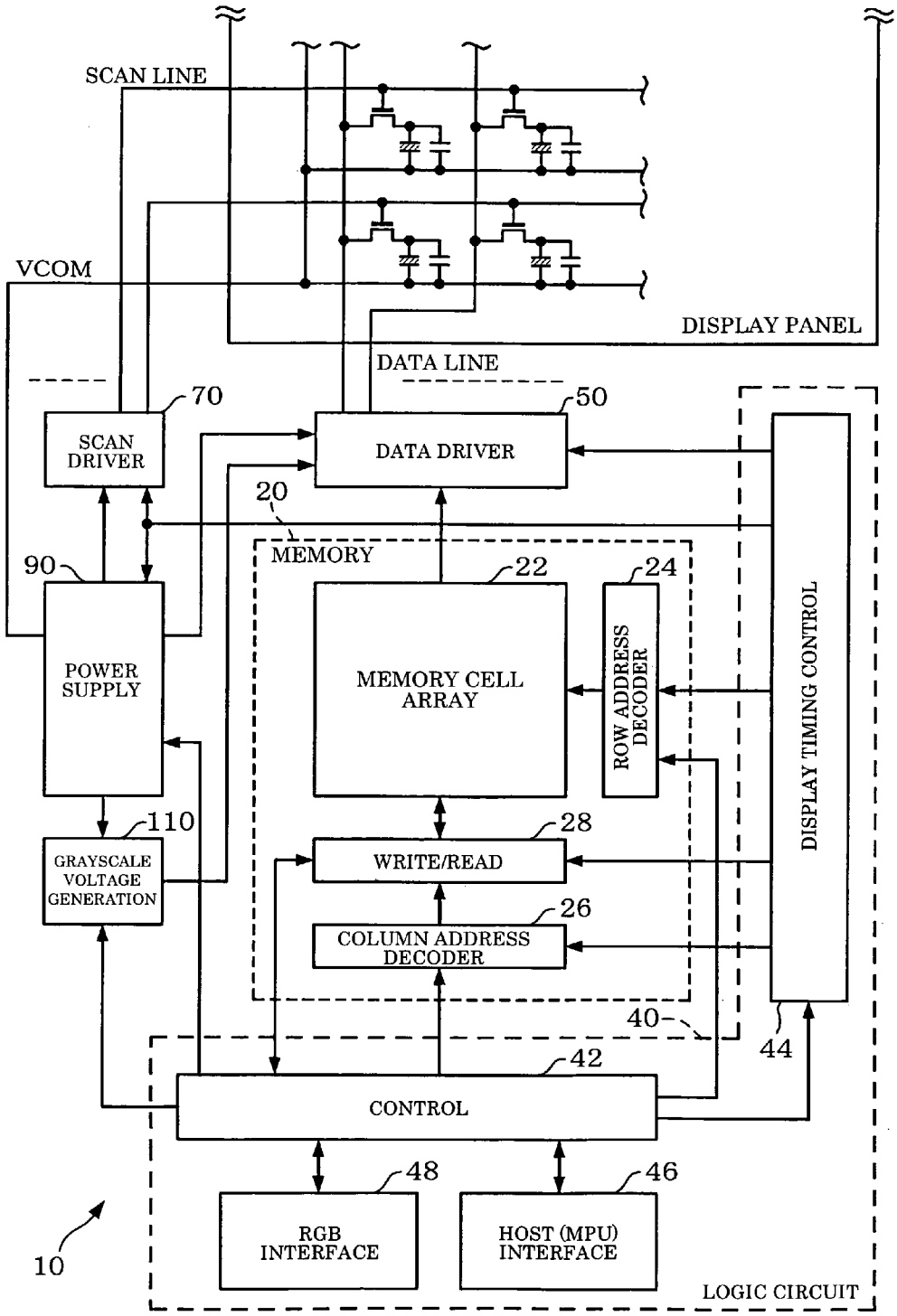
FIG. 7 is a circuit configuration example of the integrated circuit device.

FIG. 7 shows a circuit configuration example of the integrated circuit device 10. The circuit configuration of the integrated circuit device 10 is not limited to the circuit configuration shown in FIG. 7. Various modifications and variations may be made. A memory 20 (display data RAM) stores image data. A memory cell array 22 includes a plurality of memory cells, and stores image data (display data) for at least one frame (one screen). In this case, one pixel is made up of R, G, and B subpixels (three dots), and 6-bit (k-bit) image data is stored for each subpixel, for example. A row address decoder 24 (MPU/LCD row address decoder) decodes a row address and selects a wordline of the memory cell array 22. A column address decoder 26 (MPU column address decoder) decodes a column address and selects a bitline of the memory cell array 22. A write/read circuit 28 (MPU write/read circuit) writes image data into the memory cell array 22 or reads image data from the memory cell array 22. An access region of the memory cell array 22 is defined by a rectangle having a start address and an end address as opposite vertices. Specifically, the access region is defined by the column address and the row address of the start address and the column address and the row address of the end address so that memory access is performed.

A logic circuit 40 (e.g. automatic placement and routing circuit) generates a control signal for controlling display timing, a control signal for controlling data processing timing, and the like. The logic circuit 40 may be formed by automatic placement and routing such as a gate array (G/A). A control circuit 42 generates various control signals and controls the entire device. In more detail, the control circuit 42 outputs grayscale characteristic (γ-characteristic) adjustment data (γ-correction data) to a grayscale voltage generation circuit 110 and controls voltage generation of a power supply circuit 90. The control circuit 42 controls write/read processing for the memory using the row address decoder 24, the column address decoder 26, and the write/read circuit 28. A display timing control circuit 44 generates various control signals for controlling display timing, and controls reading of image data from the memory into the display panel. A host (MPU) interface circuit 46 realizes a host interface which accesses the memory by generating an internal pulse each time accessed by the host. An RGB interface circuit 48 realizes an RGB interface which writes motion picture RGB data into the memory based on a dot clock signal. The integrated circuit device 10 may be configured to include only one of the host interface circuit 46 and the RGB interface circuit 48.

In FIG. 7, the host interface circuit 46 and the RGB interface circuit 48 access the memory 20 in pixel units. Image data designated by a line address and read in line units is supplied to a data driver 50 in line cycle at an internal display timing independent of the host interface circuit 46 and the RGB interface circuit 48.

Figure 8A:
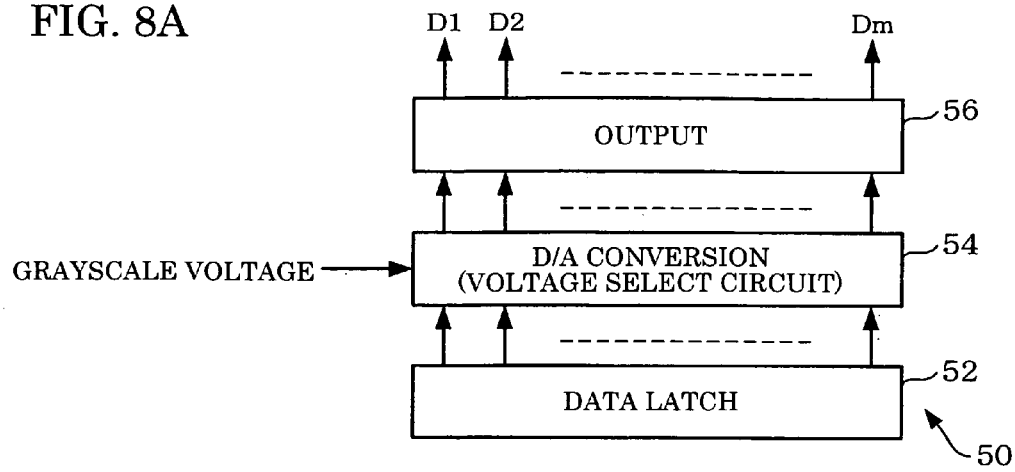
FIGS. 8A, 8B, and 8C are illustrative of configuration examples of a data driver and a scan driver.

The data driver 50 is a circuit for driving a data line of the display panel. FIG. 8A shows a configuration example of the data driver 50. A data latch circuit 52 latches the digital image data from the memory 20. A D/A conversion circuit 54 (voltage select circuit) performs D/A conversion of the digital image data latched by the data latch circuit 52, and generates an analog data voltage. In more detail, the D/A conversion circuit 54 receives a plurality of (e.g. 64 stages) grayscale voltages (reference voltages) from the grayscale voltage generation circuit 110, selects a voltage corresponding to the digital image data from the grayscale voltages, and outputs the selected voltage as the data voltage. An output circuit 56 (driver circuit or buffer circuit) buffers the data voltage from the D/A conversion circuit 54, and outputs the data voltage to the data line of the display panel to drive the data line. A part of the output circuit 56 (e.g. output stage of operational amplifier) may not be included in the data driver 50 and may be disposed in other region.

Figure 8B:
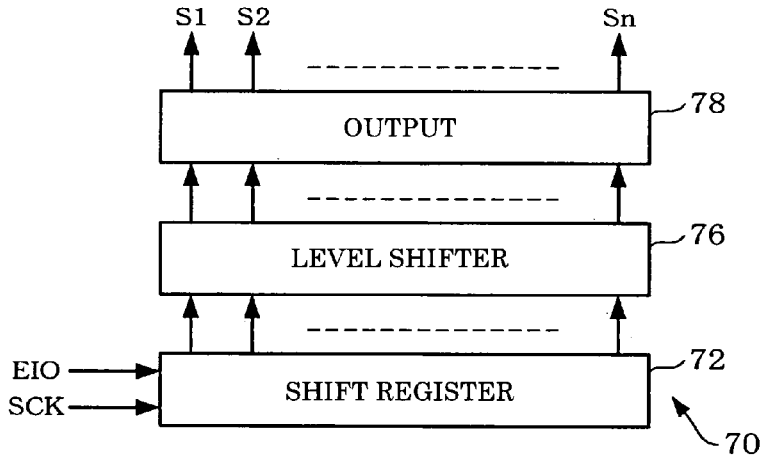
Figure 8C:
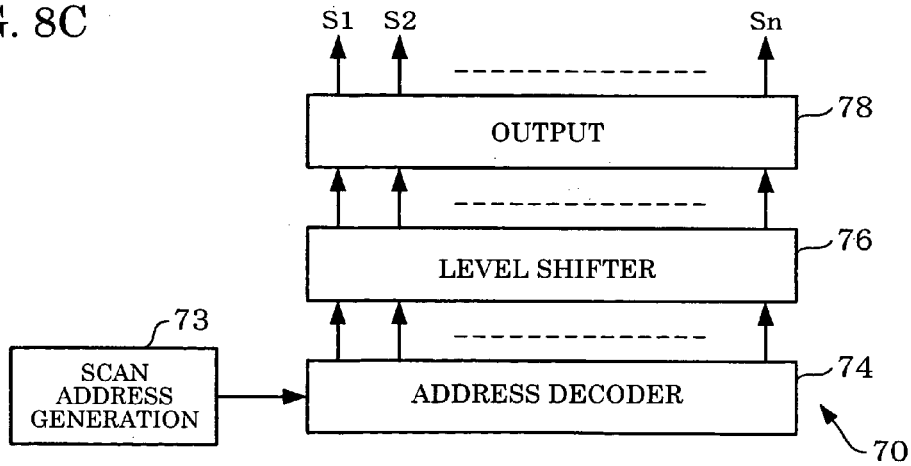

A scan driver 70 is a circuit for driving a scan line of the display panel. FIG. 8B shows a configuration example of the scan driver 70. A shift register 72 includes a plurality of sequentially connected flip-flops, and sequentially shifts an enable input-output signal EIO in synchronization with a shift clock signal SCK. A level shifter 76 converts the voltage level of the signal from the shift register 72 into a high voltage level for selecting the scan line. An output circuit 78 buffers a scan voltage converted and output by the level shifter 76, and outputs the scan voltage to the scan line of the display panel to drive the scan line. The scan driver 70 may be configured as shown in FIG. 8C. In FIG. 8C, a scan address generation circuit 73 generates and outputs a scan address, and an address decoder decodes the scan address. The scan voltage is output to the scan line specified by the decode processing through the level shifter 76 and the output circuit 78.

Figure 9A:
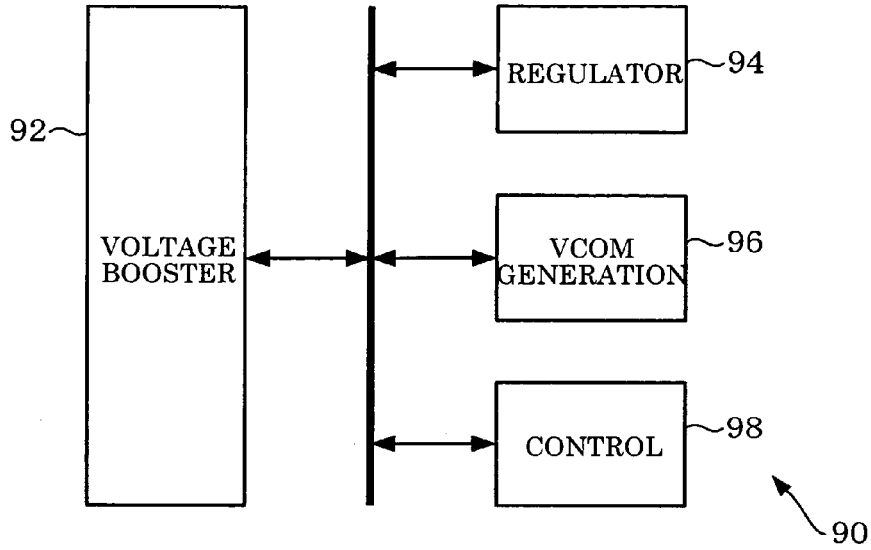
FIGS. 9A and 9B are configuration examples of a power supply circuit and a grayscale voltage generation circuit.

The power supply circuit 90 is a circuit which generates various power supply voltages. FIG. 9A shows a configuration example of the power supply circuit 90. A voltage booster circuit 92 is a circuit which generates a boosted voltage by boosting an input power source voltage or an internal power supply voltage by a charge-pump method using a boost capacitor and a boost transistor, and may include first to fourth voltage booster circuits and the like. A high voltage used by the scan driver 70 and the grayscale voltage generation circuit 110 can be generated by the voltage booster circuit 92. A regulator circuit 94 regulates the level of the boosted voltage generated by the voltage booster circuit 92. A VCOM generation circuit 96 generates and outputs a voltage VCOM supplied to a common electrode of the display panel. A control circuit 98 controls the power supply circuit 90, and includes various control registers and the like.

Figure 9B:
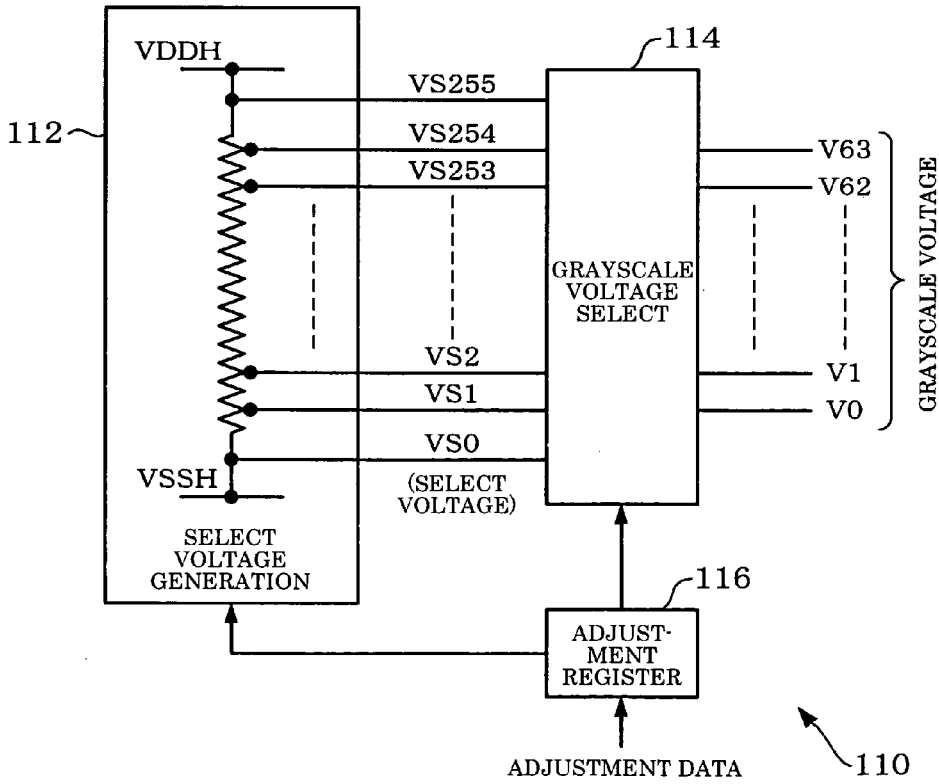

The grayscale voltage generation circuit 110 (γ-correction circuit) is a circuit which generates grayscale voltages. FIG. 9B shows a configuration example of the grayscale voltage generation circuit 110. A select voltage generation circuit 112 (voltage divider circuit) outputs select voltages VS0 to VS255 (R select voltages in a broad sense) based on high-voltage power supply voltages VDDH and VSSH generated by the power supply circuit 90. In more detail, the select voltage generation circuit 112 includes a ladder resistor circuit including a plurality of resistor elements connected in series. The select voltage generation circuit 112 outputs voltages obtained by dividing the power supply voltages VDDH and VSSH using the ladder resistor circuit as the select voltages VS0 to VS255. A grayscale voltage select circuit 114 selects 64 (S in a broad sense; R>S) voltages from the select voltages VS0 to VS255 in the case of using 64 grayscales based on the grayscale characteristic adjustment data set in an adjustment register 116 by the logic circuit 40, and outputs the selected voltages as grayscale voltages V0 to V63. This enables generation of a grayscale voltage having grayscale characteristics (γ-correction characteristics) optimum for the display panel. In the case of performing a polarity reversal drive, a positive ladder resistor circuit and a negative ladder resistor circuit may be provided in the select voltage generation circuit 112.

The resistance value of each resistor element of the ladder resistor circuit may be changed based on the adjustment data set in the adjustment register 116. An impedance conversion circuit (voltage-follower-connected operational amplifier) may be provided in the select voltage generation circuit 112 or the grayscale voltage select circuit 114.

Figure 10A:
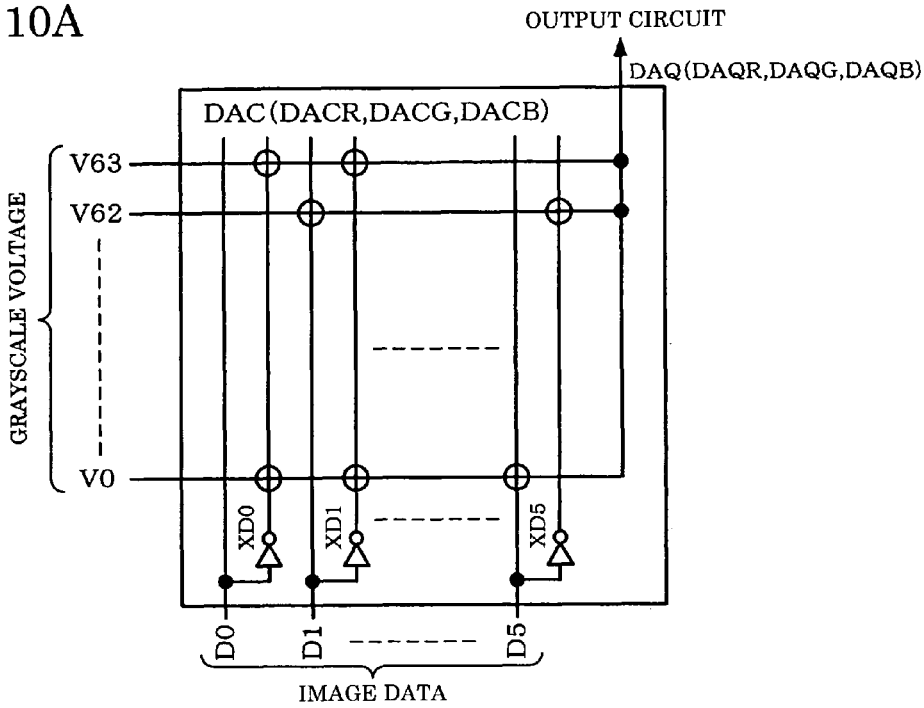
FIGS. 10A, 10B, and 10C are configuration examples of a D/A conversion circuit and an output circuit.

FIG. 10A shows a configuration example of a digital-analog converter (DAC) included in the D/A conversion circuit 54 shown in FIG. 8A. The DAC shown in FIG. 10A may be provided in subpixel units (or pixel units), and may be formed by a ROM decoder and the like. The DAC selects one of the grayscale voltages V0 to V63 from the grayscale voltage generation circuit 110 based on 6-bit digital image data D0 to D5 and inverted data XD0 to XD5 from the memory 20 to convert the image data D0 to D5 into an analog voltage. The DAC outputs the resulting analog voltage signal DAQ (DAQR, DAQG, DAQB) to the output circuit 56.

When R, G, and B data signals are multiplexed and supplied to a low-temperature polysilicon TFT display driver or the like (FIG. 10C), R, G, and B image data may be D/A converted by using one common DAC. In this case, the DAC shown in FIG. 10A is provided in pixel units.

Figure 10B:
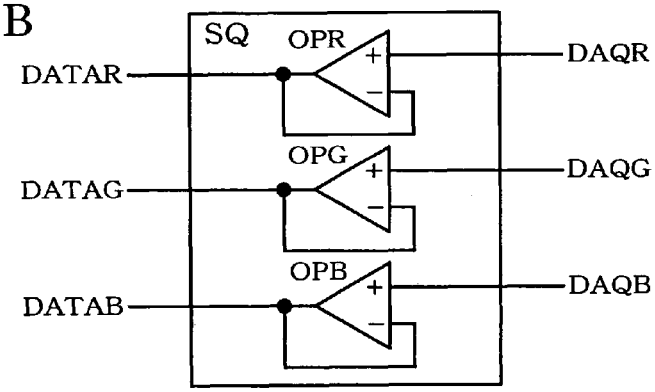
Figure 10C:
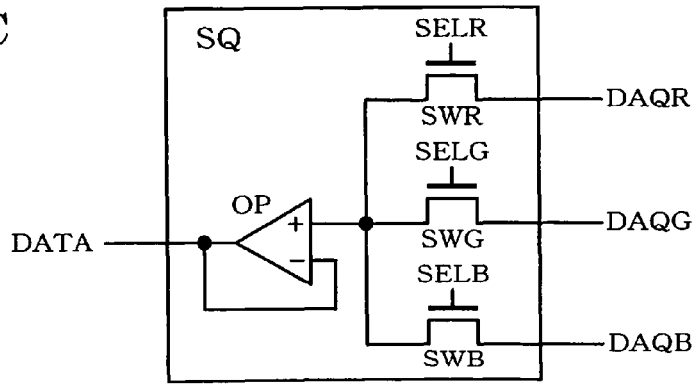

FIG. 10B shows a configuration example of an output section SQ included in the output circuit 56 shown in FIG. 8A. The output section SQ shown in FIG. 10B may be provided in pixel units. The output section SQ includes R (red), G (green), and B (blue) impedance conversion circuits OPR, OPG, and OPB (voltage-follower-connected operational amplifiers), performs impedance conversion of the signals DAQR, DAQG, and DAQB from the DAC, and outputs data signals DATAR, DATAG, and DATAB to R, G, and B data signal output lines. When using a low-temperature polysilicon TFT panel, switch elements (switch transistors) SWR, SWG, and SWB as shown in FIG. 10C may be provided, and the impedance conversion circuit OP may output a data signal DATA in which the R, G, and B data signals are multiplexed. The data signals may be multiplexed over a plurality of pixels. Only the switch elements and the like may be provided in the output section SQ without providing the impedance conversion circuit as shown in FIGS. 10B and 10C.

4. Arrangement of Scan Driver, Data Driver, Power Supply Circuit, etc.

4.1 Arrangement of Scan Driver Block 4.1.1 First Configuration Example

Figure 11:
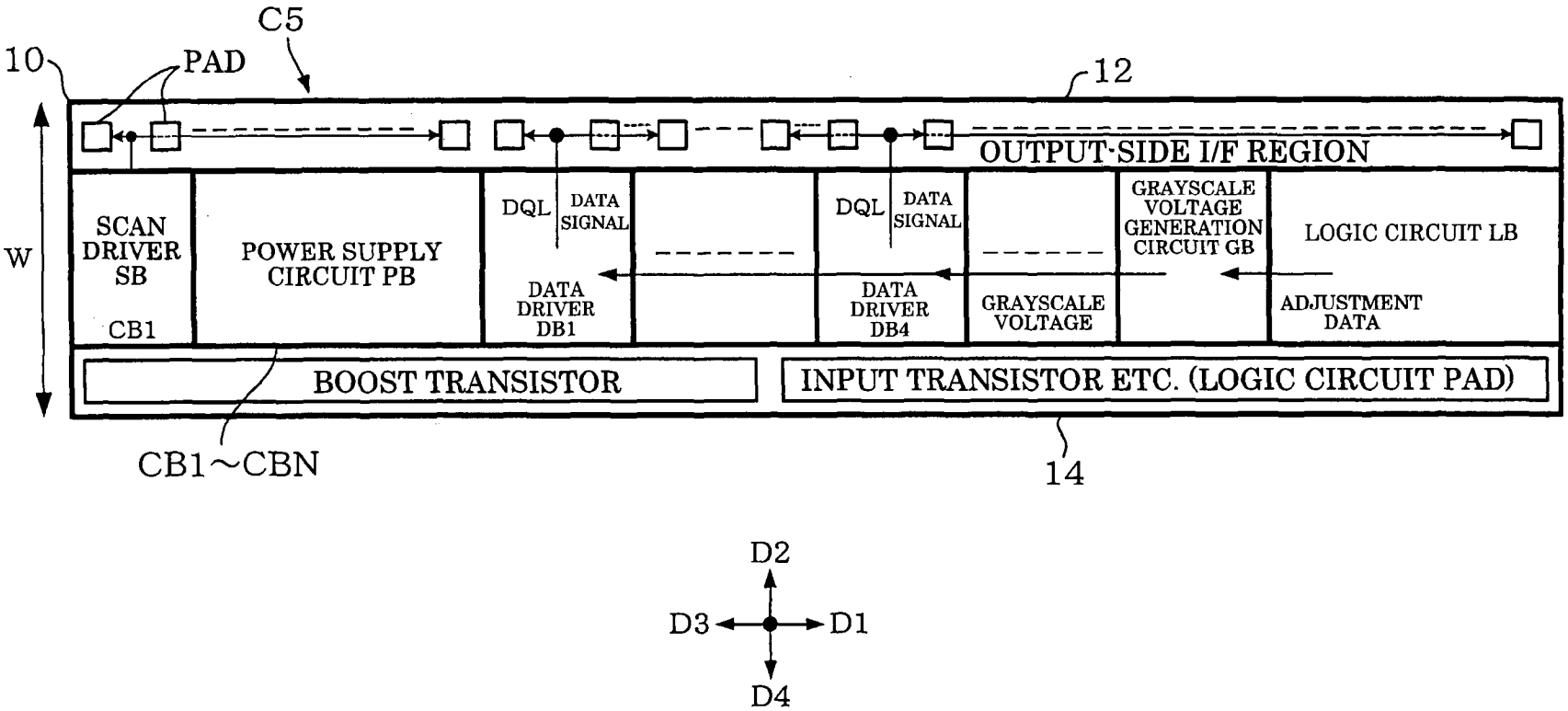
FIG. 11 is a view illustrative of an arrangement method of a scan driver block in a first configuration example.

In a first configuration example according to this embodiment, the circuit blocks CB1 to CBN include a scan driver block SB for driving the scan line, as shown in FIG. 11. In more detail, the scan driver block SB is disposed as the first circuit block CB1 of the circuit blocks CB1 to CBN. Specifically, one of the circuit blocks on both ends of the circuit blocks CB1 to CBN is the scan driver block.

In FIG. 11, the circuit blocks of the circuit blocks CB1 to CBN excluding the scan driver block SB may include at least one data driver block (data driver blocks DB1 to DB4 in FIG. 11) for driving the data line.

For example, the number of data lines of the display panels driven by the data driver blocks DB1 to DB4 may be greater than the number of scan lines of the display panel scanned by the scan driver block SB, and the output circuit may be formed as shown in FIG. 10B. In the integrated circuit device 10, the circuit blocks CB1 to CBN are disposed along the direction D1 in order to reduce the width W in the direction D2. The scan driver block is disposed on one end of the circuit blocks CB1 to CBN, and the data driver blocks DB1 to DB4 are disposed as other circuit blocks. This allows the data driver blocks DB1 to DB4 of the circuit blocks CB1 to CBN to be disposed so that the data signal is output from the output pad provided near the center of the fourth side SD4 of the integrated circuit device 10. Therefore, it is possible to satisfy a demand for a reduction in the picture frame size. Moreover, the length of the wiring between the output pad and the data line of the display panel and the wiring region can be reduced, and the mounting area can be reduced. The above effects may also be obtained when the output circuit is formed as shown in FIG. 10C in order to reduce the number of output pads.

In FIG. 11, a power supply circuit block PB is disposed between the scan driver block SB and the data driver block DB1 (one of at least one data driver block). The direction D1 according to this embodiment is not limited to the right direction, but may be the left direction. The first circuit block CB1 (scan driver block SB) is not be limited to the circuit block on the left end of the integrated circuit device 10, but may be the circuit block on the right end.

If the power supply circuit block PB or the like with a relatively large circuit area is disposed as shown in FIG. 11, the scan signal output pad and the output transistor formed under the pad can be disposed by utilizing the space (space indicated by C5) on the side of the power supply circuit block PB or the like in the direction D2. Therefore, the wiring efficiency in the output-side I/F region 12 can be improved, whereby the width W of the integrated circuit device in the direction D2 can be reduced. As a result, a narrow integrated circuit device 10 can be realized.

Figure 12A:
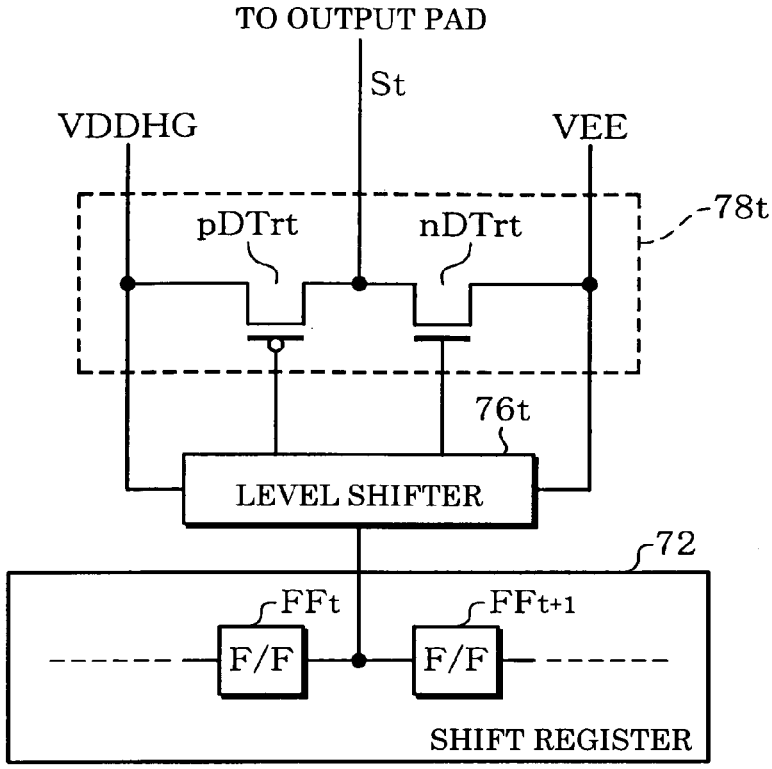
FIGS. 12A and 12B illustrate configuration examples of output transistors of a scan driver.
Figure 12B:
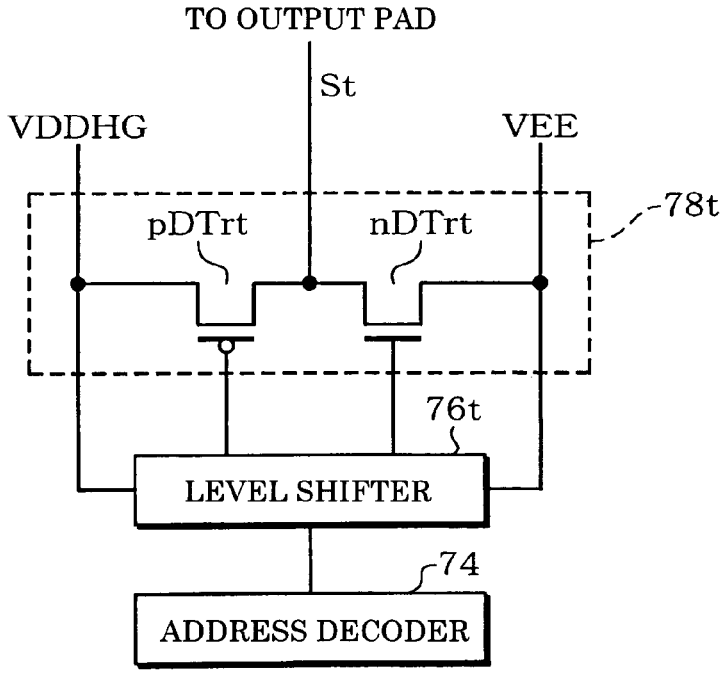

FIGS. 12A and 12B illustrate configuration examples of the output transistors formed under the scan signal output pad. The shift register 72 shown in FIG. 8B includes cascade-connected flip-flops FF1 to FFn each of which corresponds to each of scan lines S1 to Sn. FIG. 12A shows the configuration of one output of the scan driver 70 shown in FIG. 8B corresponding to the scan line St ($1 \leqq t \leqq n$; t is an integer). FIG. 12B shows the configuration of one output of the scan driver 70 shown in FIG. 8C corresponding to the scan line St.

As shown in FIG. 12A, the voltage level of an output signal from the flip-flop FFt is converted by the level shifter 76*t*. A high-potential-side power supply voltage VDDHG and a low-potential-side power supply voltage VEE are supplied to the level shifter 76*t*. The level shifter 76*t* converts the voltage level of the output signal from the flip-flop FFt into the voltage level of the high-potential-side power supply voltage VDDHG or the low-potential-side power supply voltage VEE. The output from the level shifter 76*t* serves as a gate signal of the output transistors of the output circuit 78*t*. The output transistors include a P-type metal oxide semiconductor (MOS) transistor pDTrt and an N-type MOS transistor nDTrt of which the drains are connected, for example. The high-potential-side power supply voltage VDDHG is supplied to the source of the transistor pDTrt, and the low-potential-side power supply voltage VEE is supplied to the source of the transistor nDTrt. The high-potential-side power supply voltage VDDHG and the low-potential-side power supply voltage VEE are generated by the voltage booster circuit 92 shown in FIG. 9A in a power supply circuit block PB.

At least one of the transistors pDTrt and nDTrt of the output circuit 78*t* of each output of the scan driver 70 shown in FIG. 12A is formed in the lower layer of the output pad.

In FIG. 12B, the voltage level of a decode result output signal from an address decoder 74 is converted by the level shifter 76*t*. At least one of the transistors pDTrt and nDTrt of the output circuit 78*t* of each output of the scan driver 70 shown in FIG. 12B is formed in the lower layer of the output pad.

The width W of the integrated circuit device 10 in the direction D2 can be further reduced by forming some or all of the output transistors under the output pad, whereby a narrow integrated circuit device 10 can be realized.

In FIG. 11, the scan driver block SB and the power supply circuit block PB are adjacently disposed along the direction D1. Specifically, it is necessary to supply a high power supply voltage (e.g. 20 V or −20 V) generated by the power supply circuit block PB (voltage booster circuit) to the scan driver block SB. A high-voltage power supply line can be connected along a short path by adjacently disposing the scan driver block SB and the power supply circuit block PB, whereby an adverse effect due to noise generated from the high-voltage power supply line can be minimized.

The number of lines connecting the scan driver block SB with another circuit block (e.g. power supply circuit block PB or logic circuit block LB) is small. On the other hand, the number of lines connecting the scan driver block SB with the output-side I/F region 12 is very large. Specifically, it is necessary to connect a number of output signal lines from the scan driver block SB to the pads in the output-side I/F region 12 or the output transistors formed under the pads. Therefore, the scan signal output pads can be disposed in the space (space indicated by C5) which exists in the output-side I/F region 12 on the side of the power supply circuit block PB in the direction D2 by adjacently disposing the scan driver block SB and the power supply circuit block PB along the direction D1. This allows a number of output signal lines from the scan driver block SB to be connected with the pads or the output transistors formed under the pads. Therefore, the wiring efficiency in the output-side I/F region 12 can be improved, whereby the width W of the integrated circuit device 10 in the direction D2 can be reduced. As a result, a narrow integrated circuit device 10 can be realized.

A modification is also possible in which another circuit block is inserted between the scan driver block SB and the power supply circuit block PB. In this case, the power supply circuit block PB may be disposed at least between the scan driver block SB and the grayscale voltage generation circuit block GB and the logic circuit block LB (data driver block).

4.1.2 Second Configuration Example

Figure 13:
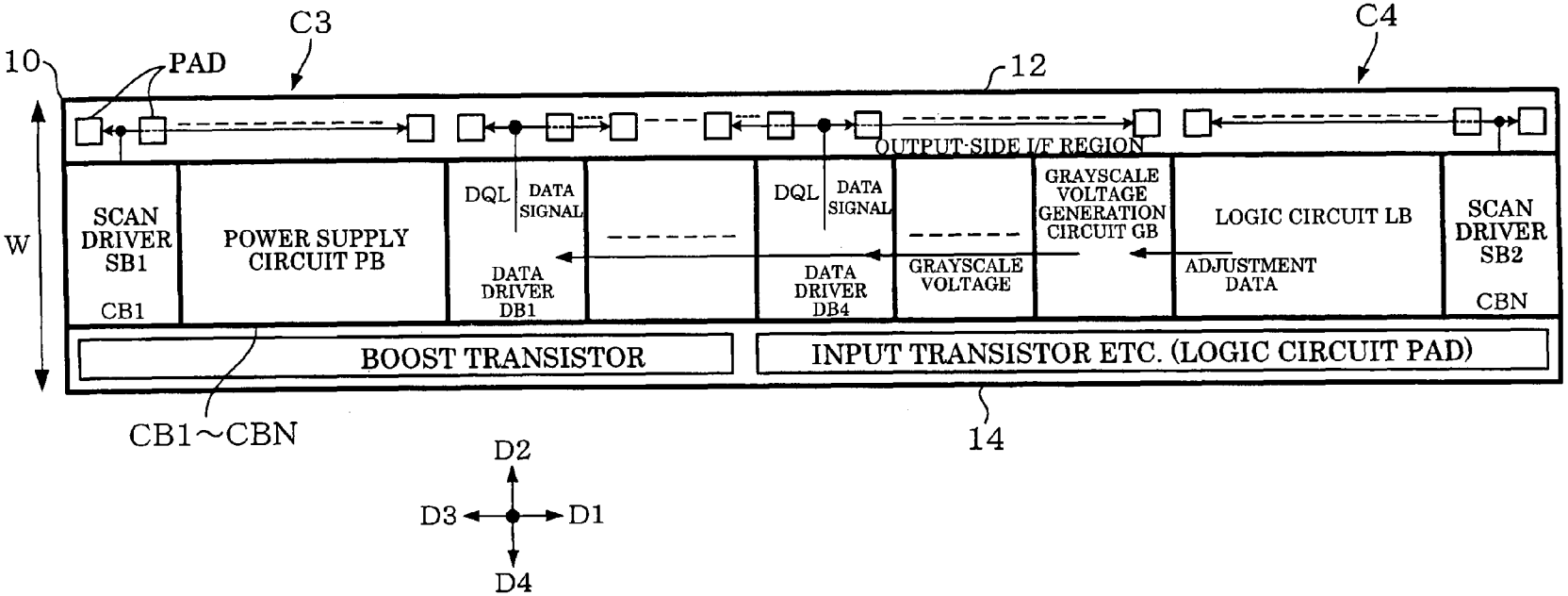
FIG. 13 is a view illustrative of an arrangement method of a scan driver block in a second configuration example.

In a second configuration example according to this embodiment, the circuit blocks CB1 to CBN include a first scan driver block SB1 and a second scan driver block SB2 for driving the scan line, as shown in FIG. 13. In more detail, the first scan driver block SB1 is disposed as the first circuit block CB1 (circuit block on the side SD1) of the circuit blocks CB1 to CBN. The second scan driver block SB2 is disposed as the Nth circuit block CBN (circuit block on the side SD3) of the circuit blocks CB1 to CBN. Specifically, the circuit blocks on both ends of the first to Nth circuit blocks disposed along the direction D1 of the integrated circuit device 10 are the first and second scan driver blocks SB1 and SB2. In this case, the number of circuit blocks disposed along the direction D1 of the integrated circuit device 10 is three or more (N≧3).

In FIG. 13, the circuit blocks of the circuit blocks CB1 to CBN excluding the first and second scan driver blocks SB1 and SB2 may include at least one data driver block (data driver blocks DB1 to DB4 in FIG. 13) for driving the data line.

In FIG. 13, the power supply circuit block PB is disposed between the scan driver block SB1 and the data driver blocks DB1 to DB4. The logic circuit block LB and the grayscale voltage generation circuit block GB are disposed between the scan driver block SB2 and the data driver blocks DB1 to DB4.

If the first and second scan driver blocks SB1 and SB2 are disposed as the circuit blocks CB1 and CBN positioned on both ends of the integrated circuit device 10, as shown in FIG. 13, a first scan signal group from the first scan driver block SB1 can be input to the display panel from the left side, and a second scan signal group from the second scan driver block SB2 can be input to the display panel from the right side, for example. This realizes efficient mounting and a comb-tooth drive of the display panel, for example.

When the first and second scan driver blocks SB1 and SB2 are disposed on the ends of the integrated circuit device 10, as shown in FIG. 13, it is preferable to dispose the scan signal output pads on both ends of the output-side I/F region 12 taking the wiring efficiency into consideration. In FIG. 13, the data driver blocks DB1 to DB4 are disposed near the center of the integrated circuit device 10. Therefore, it is preferable to dispose the data signal output pads near the center of the output-side I/F region 12 taking the wiring efficiency into consideration.

If the power supply circuit block PB and the logic circuit block LB with a relatively large circuit area are disposed on either end of the data driver blocks DB1 to DB4, as shown in FIG. 13, the scan signal output pads and the output transistors formed under the pads can be disposed by utilizing the space (space indicated by C3 and C4) on the side of the power supply circuit block PB and the logic circuit block LB in the direction D2. Therefore, the wiring efficiency in the output-side I/F region 12 can be improved, whereby the width W of the integrated circuit device 10 in the direction D2 can be reduced. As a result, a narrow integrated circuit device 10 can be realized.

In the second configuration example, at least one of the transistors pDTrt and nDTrt of the output circuit 78*t* of each output of the scan driver 70 shown in FIG. 12A is also formed in the lower layer of the output pad.

In FIG. 12B, the voltage level of a decode result output signal from an address decoder 74 is converted by the level shifter 76*t*. At least one of the transistors pDTrt and nDTrt of the output circuit 78*t* of each output of the scan driver 70 shown in FIG. 12B is formed in the lower layer of the output pad.

The width W of the integrated circuit device 10 in the direction D2 can be further reduced by forming some or all of the output transistors under the output pad, whereby a narrow integrated circuit device 10 can be realized.

In FIG. 13, the logic circuit block LB and the scan driver block SB2 are adjacently disposed along the direction D1. Specifically, since only the logic circuit block LB among the circuit blocks CB1 to CBN is connected with the scan driver block SB2 through signal lines, the logic circuit block LB and the scan driver block SB2 are adjacently disposed in this manner. Note that a modification is also possible in which the logic circuit block LB and the scan driver block SB2 are not adjacently disposed. In FIG. 13, it is preferable to supply a high power supply voltage (e.g. 20 V or −20 V) generated by the power supply circuit block PB to the scan driver block SB2 using a line formed in the output-side I/F region 12 along the direction D1. This minimizes the adverse effects of the high-voltage power supply line on other circuit blocks.

Figure 14:
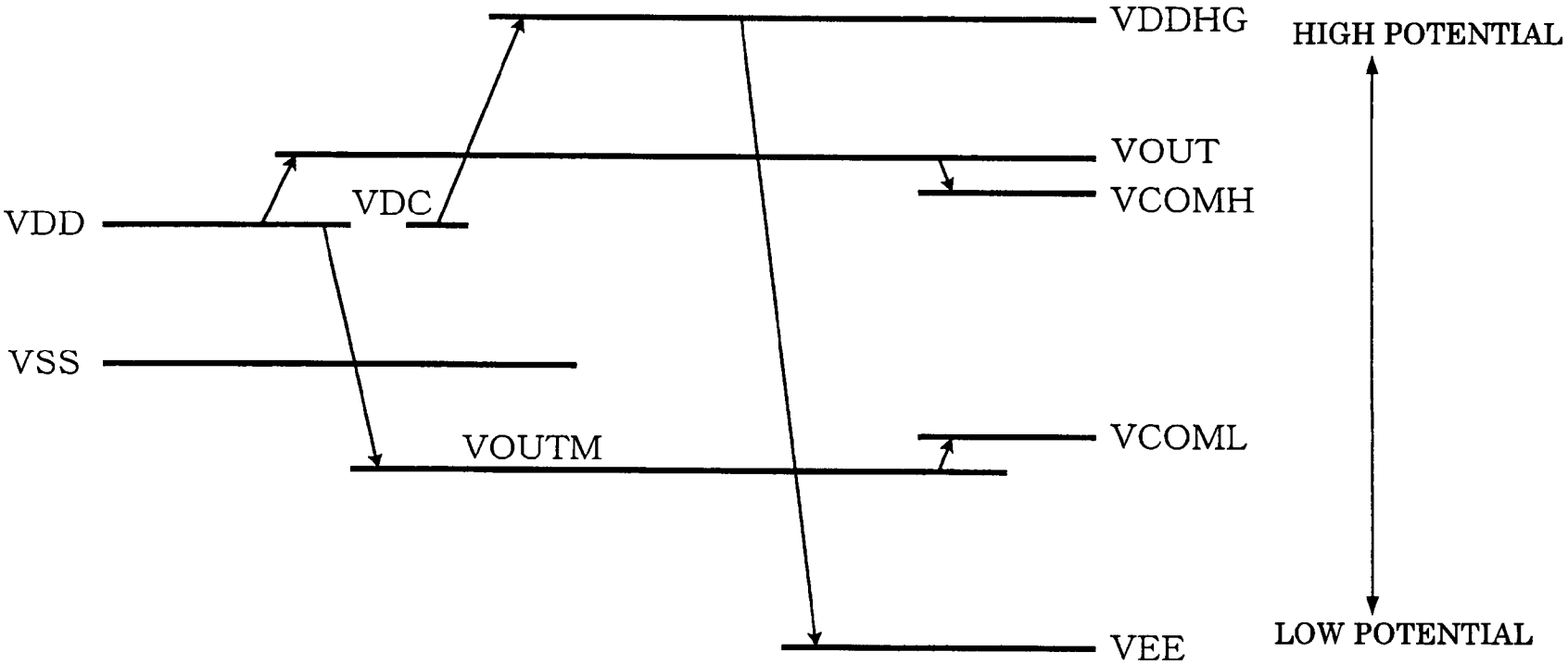
FIG. 14 is a view showing an example of the potential relationship among power supply voltages.

FIG. 14 shows an example of the potential relationship among various power supply voltages generated by the power supply circuit block PB. In the power supply circuit block PB, the voltage booster circuit 92 shown in FIG. 9A increases the voltage between the system power supply voltage VDD and the system ground power supply voltage VSS to generate a power supply voltage VOUT. The voltage booster circuit 92 increases the voltage between the system power supply voltage VDD and the system ground power supply voltage VSS in the negative direction to generate a voltage VOUTM lower in potential than the system ground power supply voltage VSS. The voltage booster circuit 92 increases the system power supply voltage VDD or a specific internal voltage VDC in the positive direction to generate the high-potential-side power supply voltage VDDHG, and increases the high-potential-side power supply voltage VDDHG in the negative direction to generate the low-potential-side power supply voltage VEE.

The regulator circuit 94 regulates the potential of the power supply voltage VOUT to generate a high-potential-side voltage VCOMH of the voltage VCOM. The regulator circuit 94 regulates the potential of the voltage VOUTM to generate a low-potential-side voltage VCOML of the voltage VCOM. The regulator circuit 94 may also generate a power supply voltage VCORE (not shown) by decreasing the potential of the system power supply voltage VDD.

The voltage VOUT is supplied as the power supply voltage of the data driver blocks DB1 to DB4 and a grayscale voltage generation circuit block GB. The power supply voltage VCORE is supplied as the power supply voltage of a logic circuit block LB (memory block MB when a memory is provided). The high-potential-side voltage VCOMH and the low-potential-side voltage VCOML of the voltage VCOM are supplied as the common voltage of the display panel. The high-potential-side power supply voltage VDDHG and the low-potential-side power supply voltage VEE are supplied as the power supply voltages (e.g. source voltage of the output transistor shown in FIGS. 12A and 12B) of the scan driver block.

The power supply circuit block PB thus generates a plurality of power supply voltages supplied to the circuit blocks CB1 to CBN. The high-potential-side power supply voltage VDDHG, which is the highest power supply voltage, is supplied as the power supply voltage supply of at least one of the scan driver blocks SB1 and SB2 through a power supply voltage supply line provided in the output-side I/F region 12 (first interface region in a broad sense).

In FIG. 13, the scan driver block SB1 and the power supply circuit block PB are adjacently disposed along the direction D1. Specifically, it is necessary to supply a high power supply voltage (e.g. 20 V or −20 V) generated by the power supply circuit block PB (voltage booster circuit) to the scan driver block SB1. A high-voltage power supply line can be connected along a short path by adjacently disposing the scan driver block SB1 and the power supply circuit block PB, whereby an adverse effect due to noise generated from the wiring of the high-voltage power supply can be minimized.

The number of lines connecting the scan driver block SB1 with another circuit block (e.g. power supply circuit block PB or logic circuit block LB) is small. On the other hand, the number of lines connecting the scan driver block SB1 with the output-side I/F region 12 is very large. Specifically, it is necessary to connect a number of output signal lines from the scan driver block SB1 to the pads in the output-side I/F region 12 or the output transistors formed under the pads. Therefore, the scan signal output pads can be disposed in the space (space indicated by C3) which exists in the output-side I/F region 12 on the side of the power supply circuit block PB in the direction D2 by adjacently disposing the scan driver block SB1 and the power supply circuit block PB along the direction D1. This allows a number of output signal lines from the scan driver block SB1 to be connected with the pads or the output transistors formed under the pads. Therefore, the wiring efficiency in the output-side I/F region 12 can be improved, whereby the width W of the integrated circuit device 10 in the direction D2 can be reduced. As a result, a narrow integrated circuit device 10 can be realized.

A modification is also possible in which another circuit block is inserted between the scan driver block SB1 and the power supply circuit block PB. In this case, the power supply circuit block PB may be disposed at least between the scan driver block SB1 and the grayscale voltage generation circuit block GB and the logic circuit block LB (data driver block).

Figure 15A:
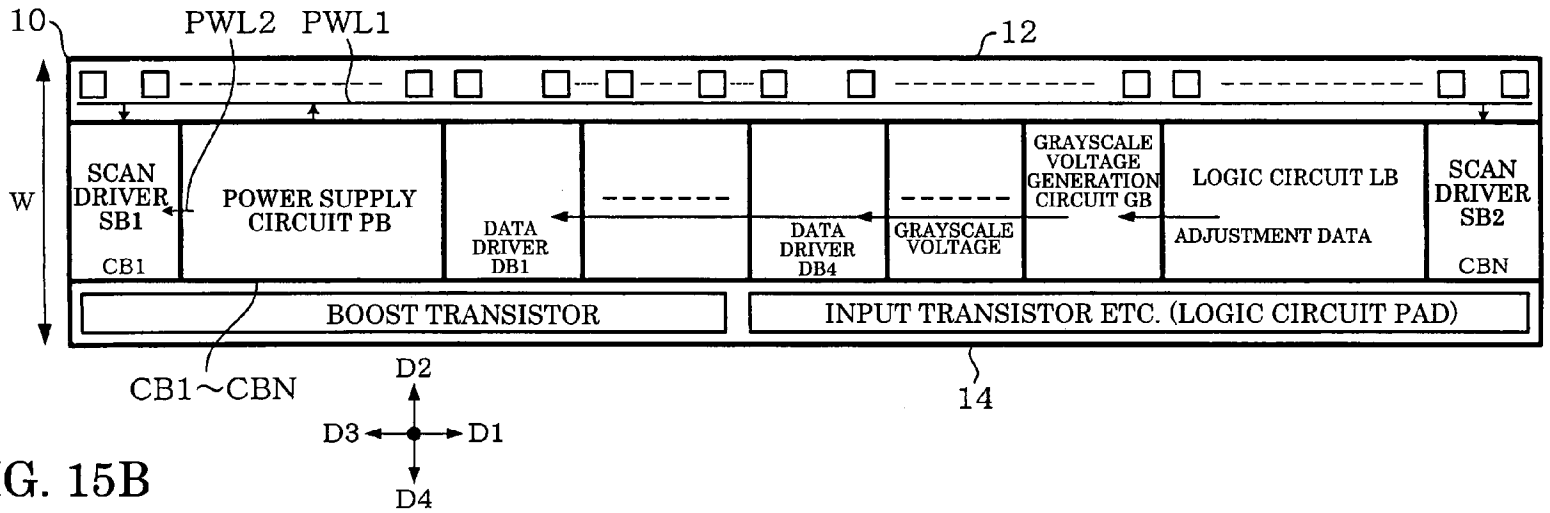
FIGS. 15A and 15B are views illustrative of a power supply voltage supply line in the second configuration example.
Figure 15B:
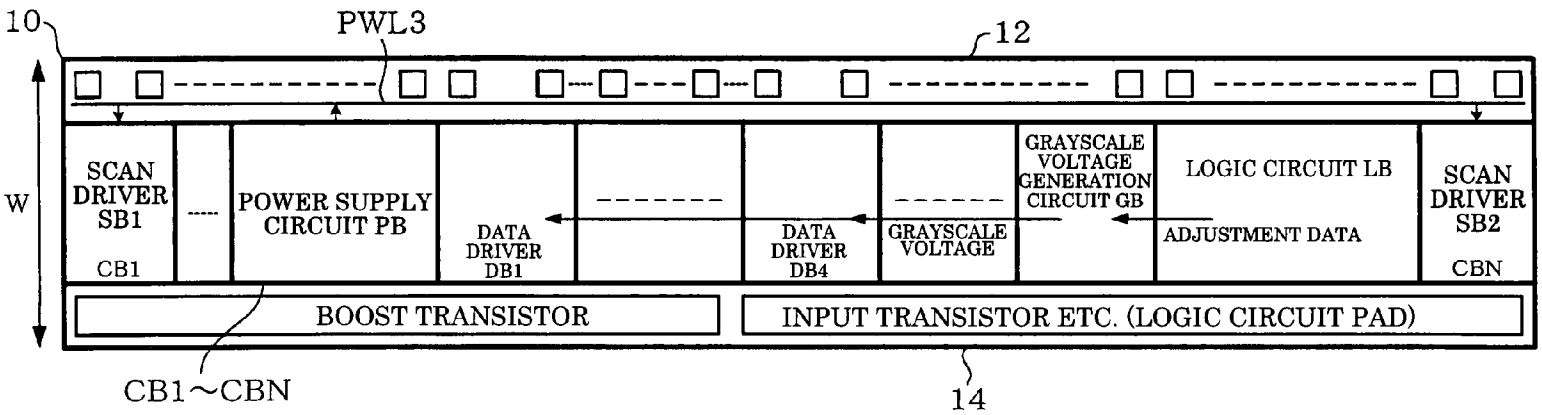

FIGS. 15A and 15B illustrate arrangement examples of the power supply voltage supply lines from the power supply circuit block PB to the scan driver blocks SB1 and SB2. In FIG. 15A, the power supply voltage is supplied to the scan driver blocks SB1 and SB2 through a power supply voltage supply line PWL1 provided in the output-side I/F region 12. When the power supply circuit block PB is disposed adjacent to the scan driver block SB1, as shown in FIG. 15A, the power supply voltage may be supplied through a power supply voltage supply line PWL2 provided between the power supply circuit block PB and the scan driver block SB1 without using the power supply voltage supply line PWL1 provided in the output-side I/F region 12.

When the power supply circuit block PB is not disposed adjacent to the scan driver block SB1, as shown in FIG. 15B, it is preferable to supply the power supply voltage through a power supply voltage supply line PWL3 provided in the output-side I/F region 12.

In FIG. 14, the low-potential-side power supply voltage VEE is lower in potential than the system ground power supply voltage VSS. Note that this embodiment is not limited thereto. For example, the low-potential-side power supply voltage VEE may be equal in potential to or higher in potential than the system ground power supply voltage VSS. When the low-potential-side power supply voltage VEE is lower in potential than the system ground power supply voltage VSS and is higher in voltage with respect to the system ground power supply voltage VSS, it is preferable to supply the low-potential-side power supply voltage VEE to the scan driver block through the power supply voltage supply lines PWL1, PWL2, and PWL3 in the same manner as the high-potential-side power supply voltage VDDHG.

This prevents a situation in which the high power supply voltage generated by the power supply circuit block PB and supplied through the power supply line extending over the data driver block, the grayscale voltage generation circuit block, and the logic circuit block adversely affects other circuit blocks, or the wiring region is increased as a result of providing power supply line to avoid the data driver block, the grayscale voltage generation circuit block, and the logic circuit block.

4.1.3 Third Configuration Example

In a third configuration example according to this embodiment, the scan driver block SB is disposed along the direction D1 on the side of the circuit blocks CB1 to CBN in the direction D2, differing from FIGS. 5A and 5B.

Figure 16A:
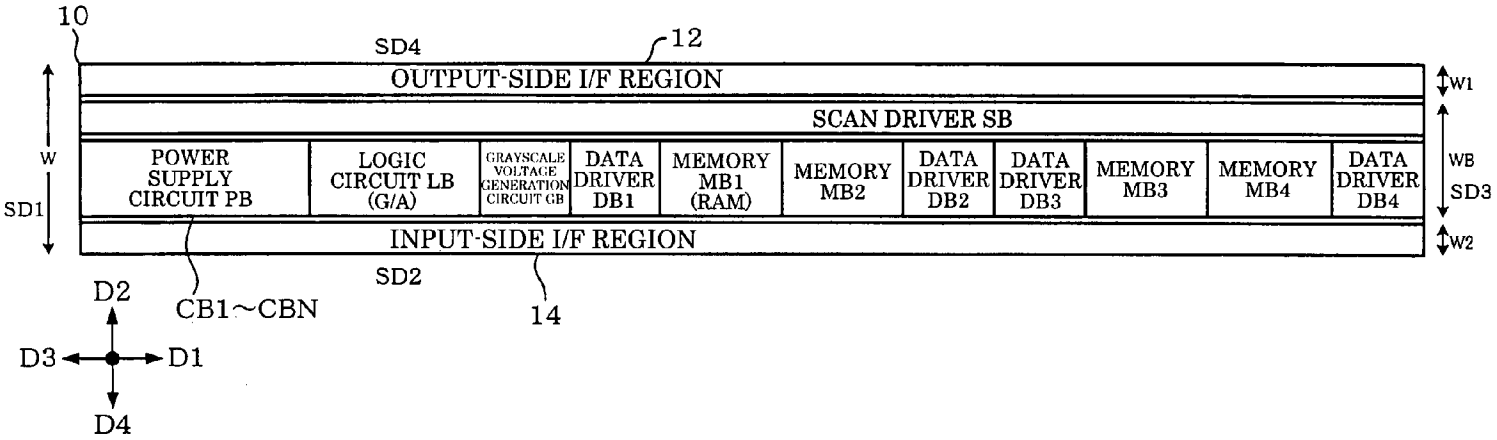
FIGS. 16A and 16B are planar layout examples of an integrated circuit device in a third configuration example.
Figure 16B:
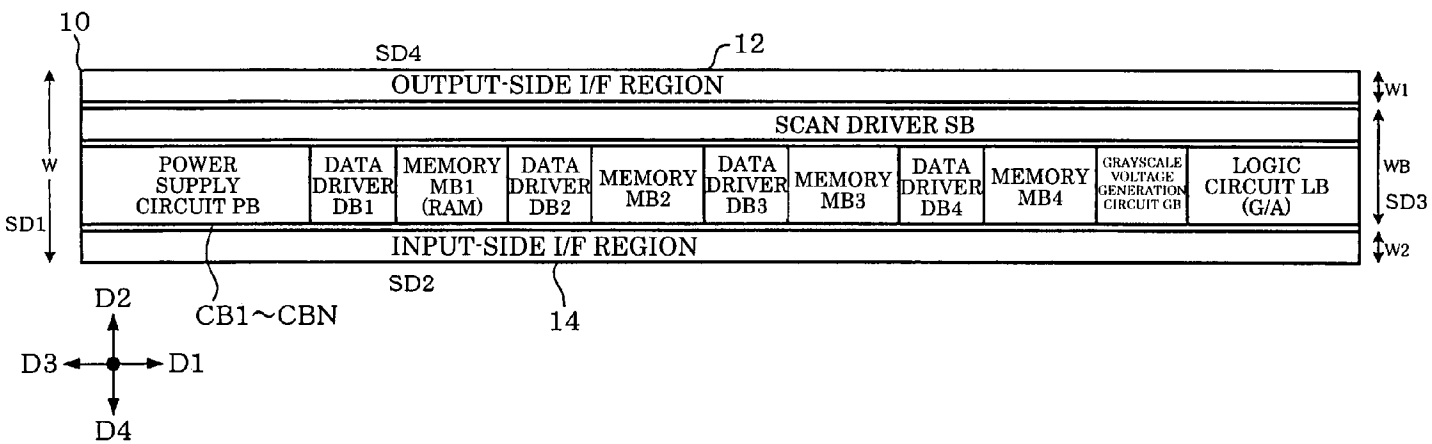

FIGS. 16A and 16B illustrate examples of the planar layout of the integrated circuit device 10 in the third configuration example according to this embodiment. In FIGS. 16A and 16B, the same sections as in FIGS. 5A and 5B are indicated by the same symbols. Description of these sections is appropriately omitted.

In the third configuration example, as shown in FIGS. 16A and 16B, the scan driver block SB is disposed along the direction D1 on the side of the circuit blocks CB1 to CBN in the direction D2, differing from FIG. 3. Specifically, the scan driver block SB using a high voltage differing from that of the circuit blocks CB1 to CBN as the power supply voltage is disposed along the direction D1 in which the circuit blocks CB1 to CBN are arranged.

The layout arrangement of the integrated circuit device 10 in the third configuration example according to this embodiment is not limited to those shown in FIGS. 16A and 16B. For example, the number of memory blocks and data driver blocks may be two, three, or five or more, or the memory block and the data driver block may not be divided into blocks. A modification in which the memory block is not adjacent to the data driver block is also possible. The memory block, the power supply circuit block, or the grayscale voltage generation circuit block may not be provided. A circuit block with a significantly small width in the direction D2 (narrow circuit block with a width equal to or less than the width W) may be provided between the circuit blocks CB1 to CBN and the output-side I/F region 12 or the input-side I/F region 14. The circuit blocks CB1 to CBN may include a circuit block in which different circuit blocks are arranged in stages in the direction D2.

Figure 17A:
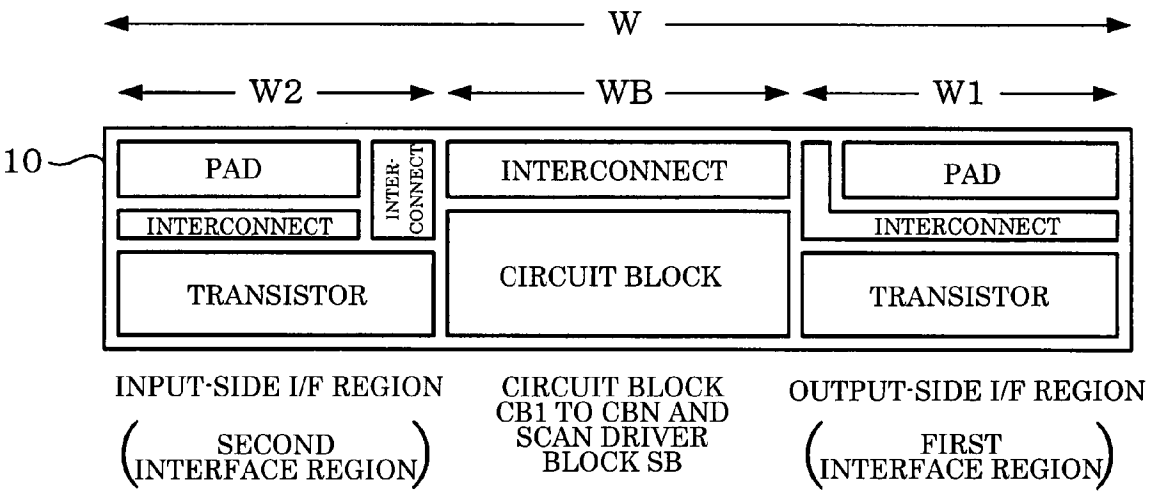
FIGS. 17A and 17B are examples of a cross-sectional view of the integrated circuit device in the third configuration example.

FIG. 17A shows an example of a cross-sectional view of the integrated circuit device 10 according to this embodiment along the direction D2. W1, WB, and W2 respectively indicate the widths of the output-side I/F region 12, the circuit blocks CB1 to CBN and the scan driver block SB, and the input-side I/F region 14 in the direction D2. W indicates the width of the integrated circuit device 10 in the direction D2.

In this embodiment, as shown in FIG. 17A, other circuit blocks may not be provided between the circuit blocks CB1 to CBN (data driver block DB) and the scan driver block SB and the output-side and input-side I/F regions 12 and 14. Therefore, the relationship "W1+WB+W2≦W≦W1+2×WB+W2" is satisfied, whereby a narrow integrated circuit device can be realized. In more detail, the width W in the direction D2 may be set at "W<2 mm". More specifically, the width W in the direction D2 may be set at "W<1.5 mm". It is preferable that "W>0.9 mm" taking inspection and mounting of the chip into consideration. The length LD in the long side direction may be set at "15 mm<LD<27 mm". A chip shape ratio SP=LD/W may be set at "SP>10". More specifically, the chip shape ratio SP may be set at "SP>12".

The widths W1, WB, and W2 shown in FIG. 17A indicate the widths of transistor formation regions (bulk regions or active regions) of the output-side I/F region 12, the circuit blocks CB1 to CBN and the scan driver block SB, and the input-side I/F region 14, respectively. Specifically, output transistors, input transistors, input-output transistors, transistors of electrostatic protection elements, and the like are formed in the I/F regions 12 and 14. Transistors which make up the circuits are formed in the circuit blocks CB1 to CBN. The widths W1, WB, and W2 are determined based on well regions and diffusion regions in which the transistors are formed. In order to realize a narrower integrated circuit device, it is preferable to form bumps (active surface bumps) on the transistors of the circuit blocks CB1 to CBN and the scan driver block SB. In more detail, a resin core bump, in which the core is formed of a resin and a metal layer is formed on the surface of the resin, or the like is formed on the transistor (active region). The bumps (external connection terminals) are connected with the pads disposed in the I/F regions 12 and 14 through metal interconnects. The widths W1, WB, and W2 of the embodiment are not the widths of the bump formation regions, but the widths of the transistor formation regions formed under the bumps.

The widths of the circuit blocks CB1 to CBN in the direction D2 may be identical, for example. In this case, it suffices that the width of each circuit block be substantially identical, and the width of each circuit block may differ in the range of several to 20 μm (several tens of microns), for example. When a circuit block with a different width exists in the circuit blocks CB1 to CBN, the width WB may be the maximum width of the circuit blocks CB1 to CBN. In this case, the maximum width may be the width of the data driver block and the scan driver block SB in the direction D2, for example. When the integrated circuit device includes a memory, the maximum width may be the width of the memory block and the scan driver block SB in the direction D2. A space region with a width of about 20 to 30 μm may be provided between the circuit blocks CB1 to CBN and the I/F regions 12 and 14, for example.

In the third configuration example according to this embodiment, a pad in which the number of stages in the direction D2 is one or more may be disposed in the output-side I/F region 12. Therefore, the width W1 of the output-side I/F region 12 in the direction D2 may be set at "0.13 mm≦W1≦0.4 mm" taking the pad width (e.g. 0.1 mm) and the pad pitch into consideration. Since a pad in which the number of stages in the direction D2 is one can be disposed in the input-side I/F region 14, the width W2 of the input-side I/F region 14 may be set at "0.1 mm≦W2≦0.2 mm". In order to realize a narrow integrated circuit device, wiring for a logic signal from the logic circuit block, a grayscale voltage signal from the grayscale voltage generation circuit block, and power supply must be formed on the circuit blocks CB1 to CBN and the scan driver block SB using global lines. The total wiring width is about 0.8 to 0.9 mm, for example. Therefore, the widths WB of the circuit blocks CB1 to CBN and the scan driver block SB may be set at "0.65 mm≦WB≦1.2 mm" taking the total wiring width into consideration.

Since "0.65 mm≦WB≦1.2 mm" is satisfied even if W1=0.4 mm and W2=0.2 mm, WB>W1+W2 is satisfied. When the widths W1, WB, and W2 are minimum values, W1=0.13 mm, WB=0.65 mm, and W2=0.1 mm so that the width W of the integrated circuit device is about 0.88 mm. Therefore, "W=0.88 mm<2×WB=1.3 mm" is satisfied. When the widths W1, WB, and W2 are maximum values, W1=0.4 mm, WB=1.2 mm, and W2=0.2 mm so that the width W of the integrated circuit device is about 1.8 mm. Therefore, "W=1.8 mm<2×WB=2.4 mm" is satisfied. Therefore, the relational expression "W<2×WB" is satisfied, whereby a narrow integrated circuit device is realized.

Figure 17B:
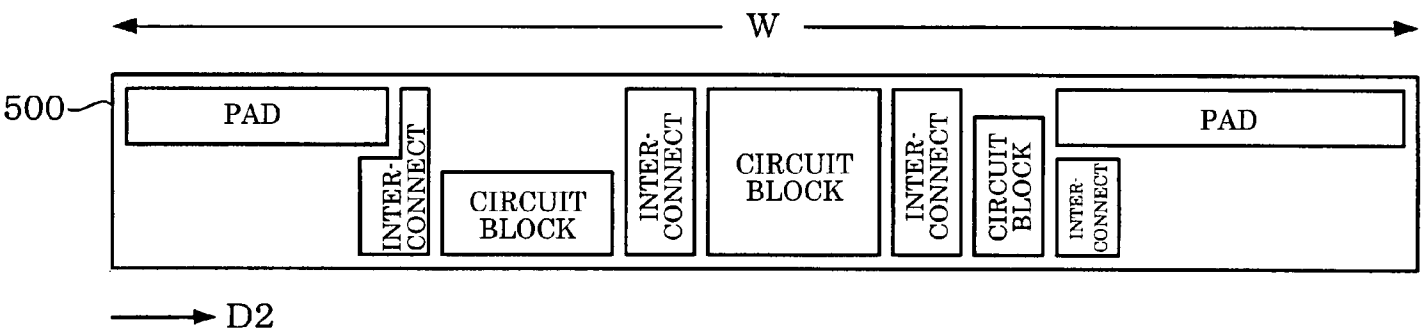

In the comparative example shown in FIG. 1A, two or more circuit blocks are disposed along the direction D2, as shown in FIG. 17B. Moreover, wiring regions are formed between the circuit blocks and between the circuit blocks and the I/F region in the direction D2. Therefore, since the width W of the integrated circuit device 500 in the direction D2 (short side direction) is increased, a narrow chip cannot be realized. Therefore, even if the chip is shrunk by using a microfabrication technology, the length LD in the direction D1 (long side direction) is decreased, as shown in FIG. 2A, so that the output pitch becomes narrow, whereby it becomes difficult to mount the integrated circuit device 500.

In the third configuration example according to this embodiment, although the scan driver block SB is disposed on the side of the circuit blocks CB1 to CBN in the direction D2, as shown in FIGS. 16A and 16B, the circuit blocks CB1 to CBN are disposed along the direction D1. As shown in FIG. 17A, the transistor (circuit element) can be disposed under the pad (bump) (active surface bump). Moreover, the signal lines can be formed between the circuit blocks and between the circuit blocks and the I/F region using the global lines formed in the upper layer (lower layer of the pad) of the local lines which are lines in the circuit blocks. Therefore, since the width W in the direction D2 can be reduced while maintaining the length LD of the integrated circuit device 10 in the direction D1, as shown in FIG. 2B, a very narrow chip can be realized. As a result, the output pitch can be maintained at 22 μm or more, for example, whereby mounting can be facilitated.

In this embodiment, since the circuit blocks CB1 to CBN are disposed along the direction D1, it is possible to easily deal with a change in the product specification and the like. Specifically, since product of various specifications can be designed using a common platform, the design efficiency can be improved. For example, when the number of pixels or the number of grayscales of the display panels is increased or decreased in FIGS. 16A and 16B, it is possible to deal with such a situation merely by increasing or decreasing the number of memory blocks or data driver blocks, the number of image data read operations in one horizontal scan period, or the like. FIGS. 16A and 16B illustrate examples of an amorphous TFT panel display driver including a memory. When developing a low-temperature polysilicon TFT panel product including a memory, it suffices to remove the scan driver block SB. When developing a product which does not include a memory, it suffices to remove the memory block. In this embodiment, even if the circuit block is removed corresponding to the specification, since the effect on other circuit blocks is minimized, the design efficiency can be improved.

In this embodiment, the widths (heights) of the circuit blocks CB1 to CBN in the direction D2 can be adjusted to the width (height) of the data driver block or the memory block, for example. When the number of transistors of each circuit block is increased or decreased, since it is possible to deal with such a situation by increasing or decreasing the length of each circuit block in the direction D1, the design efficiency can be further improved. For example, when the number of transistors of each circuit block is increased or decreased in FIGS. 16A and 16B due to a change in the configuration of the grayscale voltage generation circuit block or the power supply circuit block, it is possible to deal with such a situation by increasing or decreasing the length of the grayscale voltage generation circuit block or the power supply circuit block in the direction D1.

As a second comparative example, a narrow data driver block may be disposed in the direction D1, and other circuit blocks such as the memory block may be disposed along the direction D1 adjacent to the data driver block in the direction D4, for example. However, since the data driver block having a large width lies between the circuit blocks such as the memory block and the output-side I/F region in the second comparative example, the width W of the integrated circuit device in the direction D2 is increased, whereby it is difficult to realize a narrow chip. Moreover, an unnecessary wiring region is formed between the data driver block and the memory block, whereby the width W is further increased. Furthermore, when the configuration of the data driver block or the memory block is changed, the pitch difference described with reference to FIGS. 1B and 1C occurs, whereby the design efficiency cannot be improved.

As a third comparative example of the third configuration example according to this embodiment, only one circuit block (e.g. data driver block) may be divided into blocks and arranged in the direction D1. However, since the integrated circuit device can be provided with only a single function (e.g. function of the data driver) in the third comparative example, development of various product cannot be realized. In this embodiment, the circuit blocks CB1 to CBN include at least two circuit blocks having different functions. Therefore, various integrated circuit devices corresponding to various types of display panels can be provided, as shown in FIGS. 4, 16A, and 16B.

Figure 18:
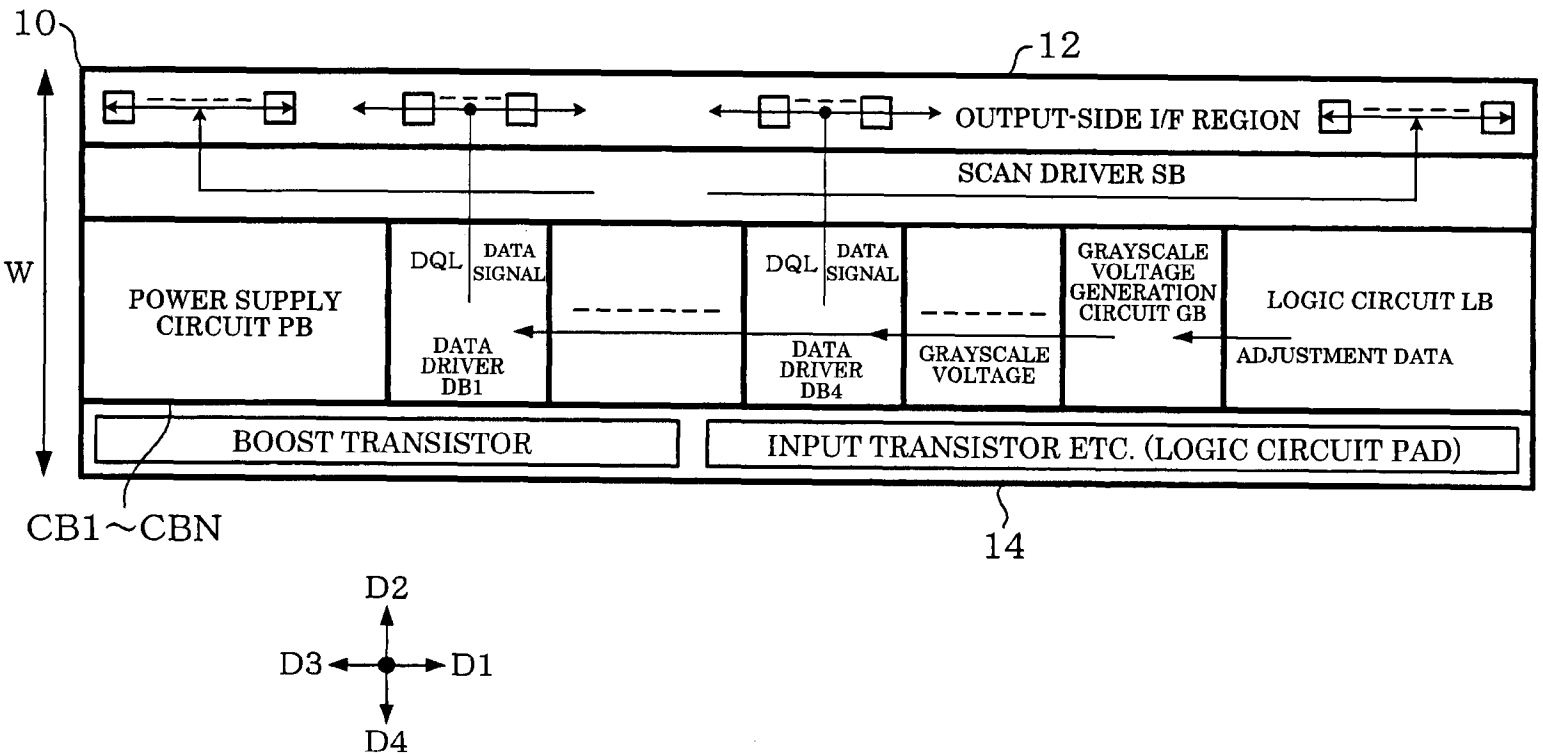
FIG. 18 is a view illustrative of an arrangement method of a scan driver block in the third configuration example.

In the third configuration example according to this embodiment, the scan driver block SB for scanning the scan line is disposed along the direction D1 on the side of the circuit blocks CB1 to CBN, disposed along the direction D1, in the direction D2, as shown in FIG. 18. When the pad electrically connected with the scan line of the display driver is disposed on the side of the scan driver block SB in the direction D1, the scan driver block SB can output the scan signal through the scan signal output line connected with the pad along a short path. As a result, the scan signal output line can be simply provided, whereby an increase in the wiring region of the scan signal output line due to intersection with other signal lines can be reduced.

A plurality of voltage levels are necessary as the voltage level of the power supply voltage for driving the display panel. In general, power supply voltages at the highest potential and the lowest potential are used as the power supply voltages of the scan driver block SB.

The power supply voltages are generated by the power supply circuit block PB in the same manner as described with reference to FIG. 14.

In the scan driver block SB1, it is necessary to provide the power supply lines in order to supply a high power supply voltage to all the circuits which generate the scan signal. The power supply lines can be provided in the scan driver block SB along the direction D1 by disposing the scan driver block SB as shown in FIG. 18. Therefore, the power supply lines can be easily connected with all the circuits which generate the scan signal, whereby the power supply lines can be efficiently provided.

Figure 19A:
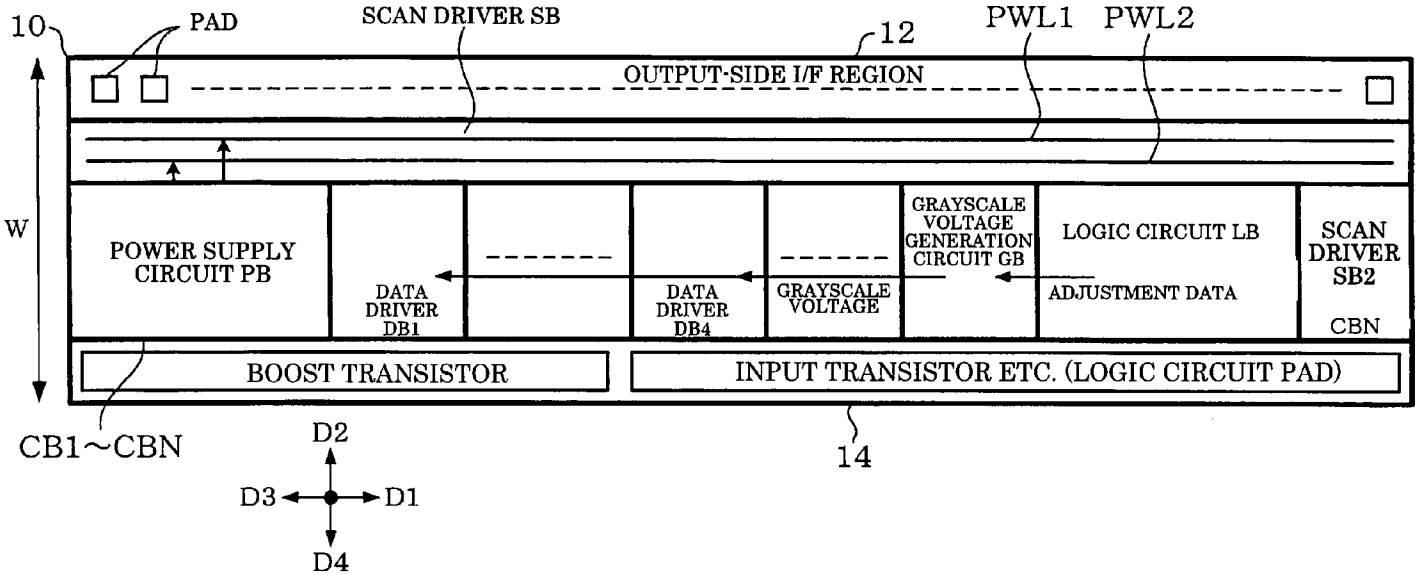
FIGS. 19A and 19B are views illustrative of power supply lines in the third configuration example.
Figure 19B:
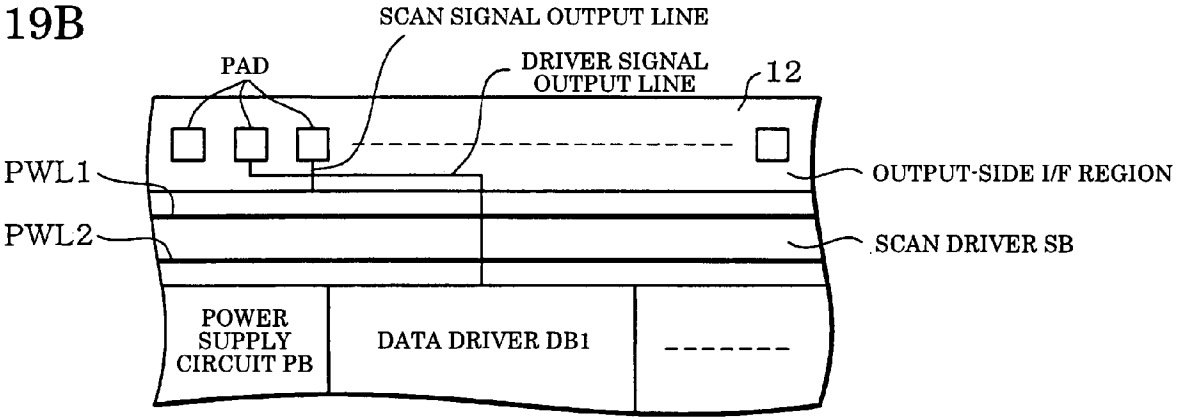

FIGS. 19A and 19B are views illustrative of the power supply lines which supply the power supply voltages of the scan driver block. When the circuit blocks CB1 to CBN are disposed along the direction D1, as shown in FIG. 19, the scan driver block SB is disposed along the direction D1 on the side of the circuit blocks CB1 to CBN in the direction D2. At least the pads electrically connected with the scan lines are disposed in the output-side I/F region 12 along the direction D1.

In the scan driver block SB, the power supply lines PWL1 and PWL2 are provided along the direction D1. The high-potential-side power supply voltage VDDHG generated by the power supply circuit block PB is supplied to the power supply line PWL1. The low-potential-side power supply voltage VEE generated by the power supply circuit block PB is supplied to the power supply line PWL2. For example, the power supply lines PWL1 and PWL2 may be lines in the upper layer of the local lines which connect the transistors of the scan driver block SB.

This makes it unnecessary to provide the power supply lines on the circuit blocks CB1 to CBN, whereby a situation can be reliably prevented in which the circuit blocks CB1 to CBN malfunction due to coupling with the power supply line to which the high power supply voltage is supplied. When it is necessary to provide the power supply line with a guard ring or the like due to high voltage, the wiring region of the power supply lines can be provided almost inside the scan driver block SB, whereby the layout design can be facilitated. Moreover, even if the power supply lines PWL1 and PWL2 are provided in the output-side I/F region 12 along the direction D1, adverse effects such as malfunction due to coupling with the power supply line can be reliably prevented.

When supplying the system ground power supply voltage VSS to the scan driver block SB as the low-potential-side power supply voltage VEE, the power supply line PWL2 to which the voltage generated by the power supply circuit block PB is supplied can be omitted, and the system ground power supply voltage VSS can be supplied through the system ground power supply line provided over the entire integrated circuit device.

As shown in FIG. 18, the circuit blocks CB1 to CBN may include at least one data driver block (data driver blocks DB1 to DB4 in FIG. 18) for driving the data line. In this case, a drive signal output line through which the data driver blocks DB1 to DB4 output the drive signal for driving the data line is provided in the scan driver block SB along the direction D2. The scan signal output line from the scan driver block SB is electrically connected with the pad through a wiring layer differing from the drive signal output line in the scan driver block SB. This allows the scan signal output line to be connected from the scan driver block SB disposed along the direction D1 of the integrated circuit device 10 to the pad along a short path. This minimizes the adverse effects of the high-voltage power supply line on other circuit blocks.

In the third configuration example according to this embodiment, at least one output transistor of the scan driver block SB may be provided in the output-side I/F region 12 and disposed in the lower layer of the pad electrically connected with the output transistor.

Figure 20A:
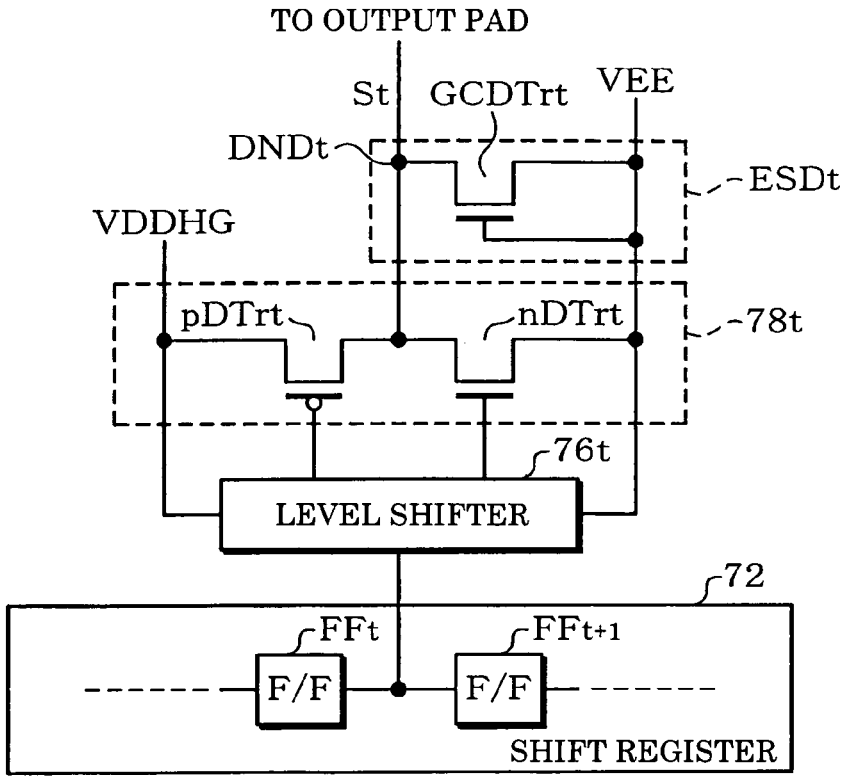
FIGS. 20A and 20B are configuration examples of output transistors of a scan driver in the third configuration example.
Figure 20B:
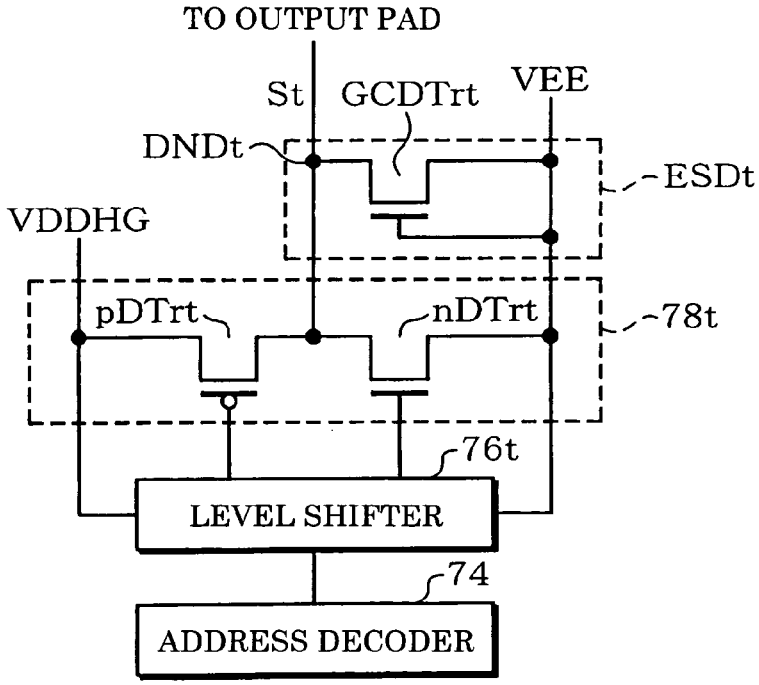

FIGS. 20A and 20B illustrate configuration examples of the output transistors formed under the scan signal output pad. The shift register 72 shown in FIG. 8B includes cascade-connected flip-flops FF1 to FFn each of which corresponds to each of scan lines S1 to Sn. FIG. 20A shows the configuration of one output of the scan driver 70 shown in FIG. 8B corresponding to the scan line St ($1 \leqq t \leqq n$; t is an integer). FIG. 20B shows the configuration of one output of the scan driver 70 shown in FIG. 8C corresponding to the scan line St.

As shown in FIG. 20A, the voltage level of an output signal from the flip-flop FFt is converted by the level shifter 76*t*. A high-potential-side power supply voltage VDDHG and a low-potential-side power supply voltage VEE are supplied to the level shifter 76*t*. The level shifter 76*t* converts the voltage level of the output signal from the flip-flop FFt into the voltage level of the high-potential-side power supply voltage VDDHG or the low-potential-side power supply voltage VEE. The output from the level shifter 76*t* serves as a gate signal of the output transistors of the output circuit 78*t*. The output transistors include a P-type metal oxide semiconductor (MOS) transistor pDTrt and an N-type MOS transistor nDTrt of which the drains are connected, for example. It is preferable that one of the transistors pDTrt and nDTrt be formed in the lower layer of the scan signal output pad. The high-potential-side power supply voltage VDDHG is supplied to the source of the transistor pDTrt, and the low-potential-side power supply voltage VEE is supplied to the source of the transistor nDTrt. The high-potential-side power supply voltage VDDHG and the low-potential-side power supply voltage VEE are generated by the voltage booster circuit 92 shown in FIG. 9A in a power supply circuit block PB.

In FIG. 20A, an electrostatic discharge protection element ESDt is connected. The electrostatic discharge protection element ESDt is formed using an N-type MOS transistor GCDTrt. The gate of the transistor GCDTrt is connected with the source of the transistor GCDTrt. The transistor GCDTrt is provided in parallel with the transistor nDTrt between the drain and the source of the transistor nDTrt. When a high voltage is applied to the drain of the transistor GCDTrt, the transistor GCDTrt releases current to the low-potential-side power supply in order to prevent destruction of the transistor nDTrt. A protection resistor element may be inserted in series between the output pad and a drain node DNDt of the transistor GCDTrt, and a protection resistor element may be inserted in series between the drain node DNDt and the drain of the transistor nDTrt.

In the configuration shown in FIG. 20A, at least one of the electrostatic discharge protection element ESDt provided for each output of the scan driver 70 and the transistors pDTrt and nDTrt of the output circuit 78*t* is formed in the lower layer of the output pad.

In FIG. 20B, the voltage level of a decode result output signal from an address decoder 74 is converted by the level shifter 76*t*. At least one of the electrostatic discharge protection element ESDt provided for each output of the scan driver 70 and the transistors pDTrt and nDTrt of the output circuit 78*t* shown in FIG. 20B is formed in the lower layer of the output pad.

Figure 21A:
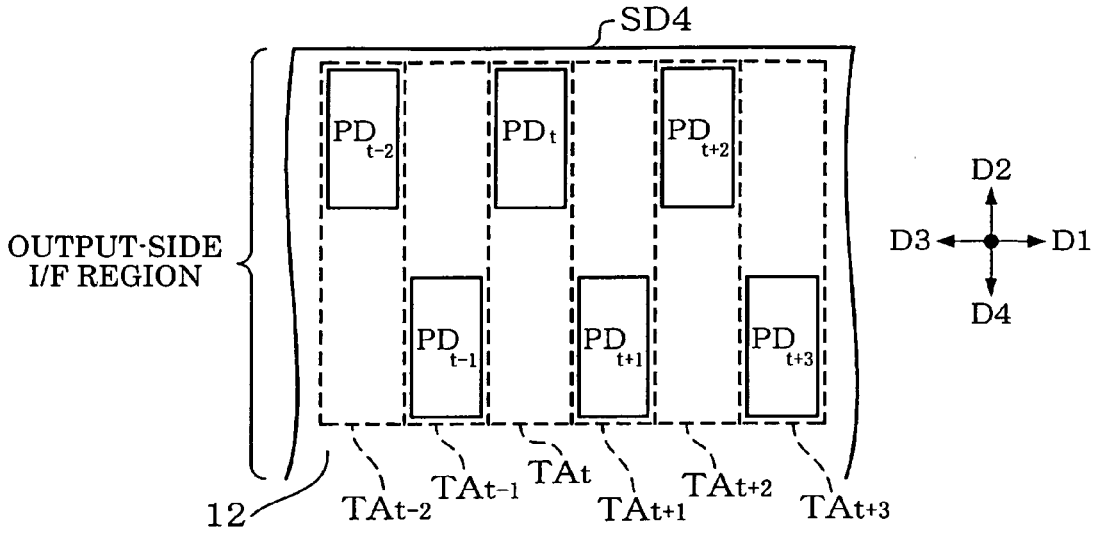
FIGS. 21A, 21B, and 21C are output pad arrangement examples in the third configuration example.

FIG. 21A shows an output pad arrangement example. In FIG. 21A, the pads are disposed in two stages in the direction D2 along the direction D1 on the fourth side SD4 of the output-side I/F region 12. A rectangular transistor formation region, which is longer in the direction D2 (D4), is provided in the lower layer of each pad.

Figure 21B:
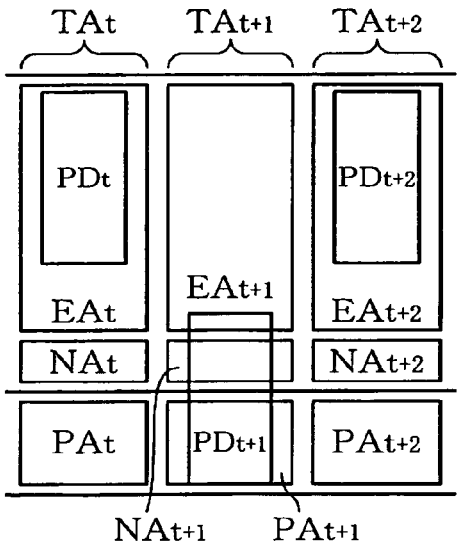

FIG. 21B shows an example of a layout image of each transistor formation region. For example, a transistor formation region TAt in the lower layer of the pad PDt electrically connected with the scan line St includes an electrostatic discharge protection element region EAt in which the electrostatic discharge protection element ESDt is formed, an N-type transistor region NAt in which the transistor nDTrt is formed, and a P-type transistor region PAt in which the transistor pDTrt is formed. The transistor formation region TAt includes the electrostatic discharge protection element region EAt, the N-type transistor region NAt, and the P-type transistor region PAt along the direction D4. Likewise, a transistor formation region TAt+1 is provided in the lower layer of the pad PDt+1. The pad PDt+1 is disposed in the upper layer of an N-type transistor region NAt+1 and a P-type transistor region PAt+1. The transistor formation region in the lower layer of the pad PDt+2 is similar to that of the pad PDt. The pads are disposed in two stages in the direction D2 by alternately disposing the pads in the upper layer of the electrostatic discharge protection element region and the upper layer of the N-type transistor region and the P-type transistor region, for example.

Figure 22:
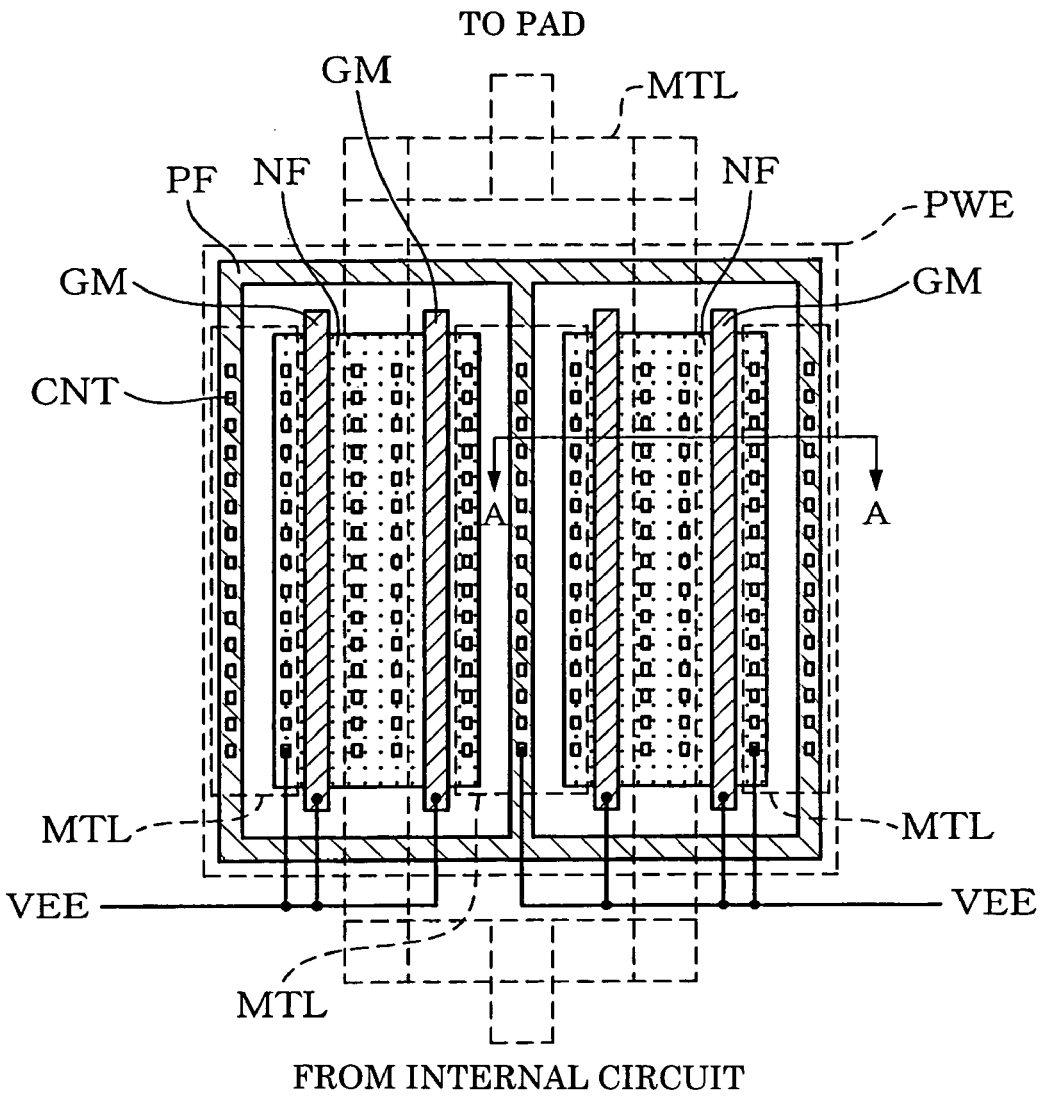
FIG. 22 is an example of a layout plan view of an electrostatic discharge protection element in the third configuration example.
Figure 23:
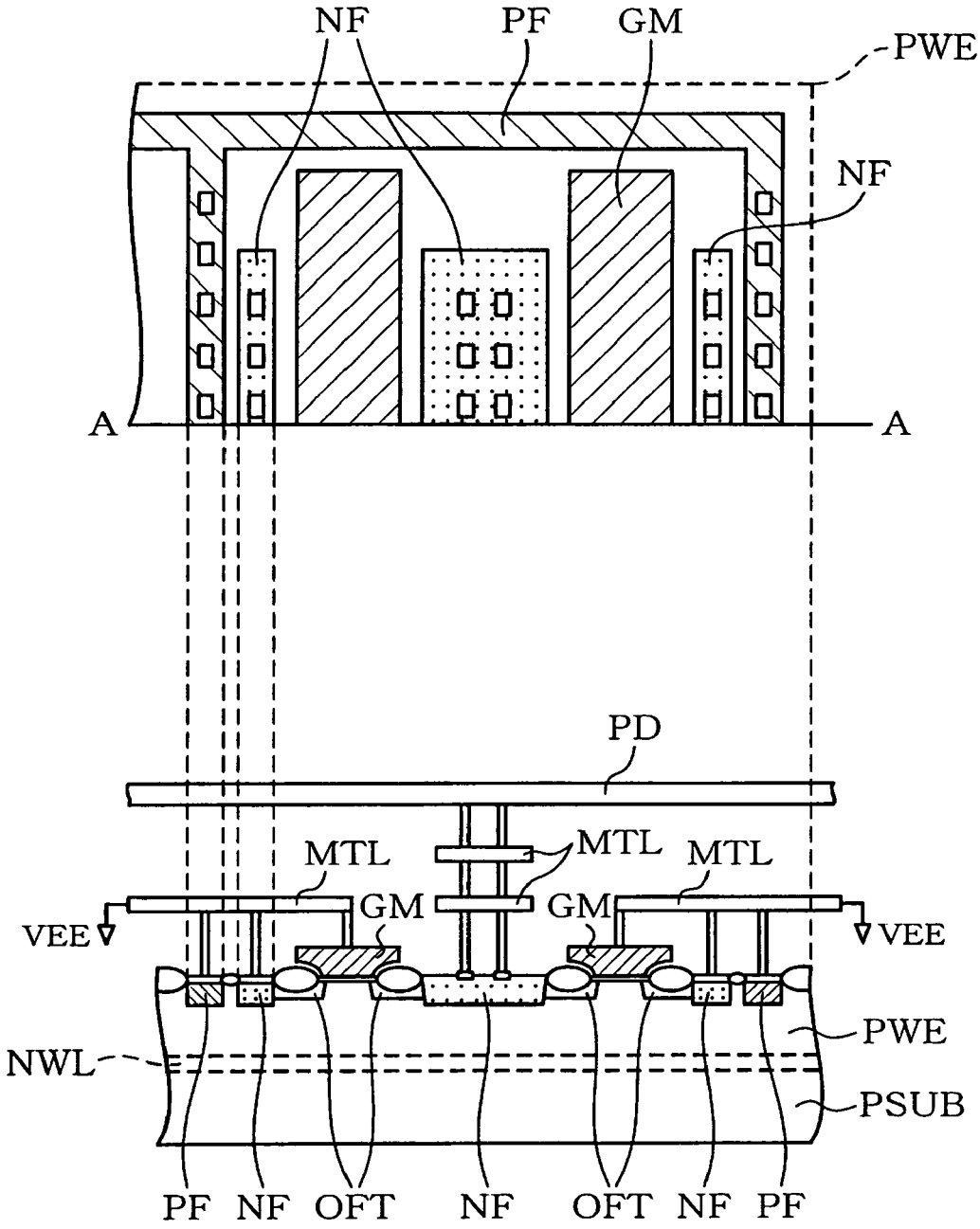
FIG. 23 is a schematic view of an example of the cross-sectional structure of FIG. 22.

FIG. 22 shows an example of a planar layout view of the transistor GCDTrt formed as the electrostatic discharge protection element ESDt. FIG. 23 schematically shows an example of the cross-sectional structure along the line A-A in FIG. 22.

In FIG. 22, a P-type well region PWE is formed in an N-type well region NWL formed in a P-type semiconductor substrate PSUB. In the P-type well region PWE, electrically isolated three N-type impurity diffusion regions NF are formed in each of two regions enclosed by a P-type impurity diffusion region PF. A gate electrode GM is provided between the N-type impurity diffusion regions NF, and the three N-type impurity diffusion regions NF serve as two source regions and one drain region. The low-potential-side power supply voltage VEE is supplied to the P-type impurity diffusion region PF, the N-type impurity diffusion region NF, and the gate electrode GM through contacts CNT.

As shown in FIG. 23, a LOCOS oxide film is formed in a channel region under the gate electrode GM, and an offset layer OFT is formed under the LOCOS oxide film. The N-type impurity diffusion region NF provided as the drain region of the transistor GCDTrt is electrically connected with the pad PDt shown in FIG. 21B through one or more through-holes and wiring layers MTL, for example. In FIG. 23, the drain region of the transistor GCDTrt is provided right under the pad PDt, and the voltage applied to the pad PDt is applied to the drain region along the shortest route through a plurality of paths having almost the same impedance. This enhances electrostatic discharge protection capability.

FIG. 23 illustrates the structure when the transistor GCDTrt is formed in the lower layer of the pad. Note that the transistors nDTrt and pDTrt may also be formed in the lower layer of the pad in the same manner as the transistor GCDTrt. The structure in this case differs from the structure shown in FIG. 23 in that the output from the level shifter is supplied to the gate electrode.

Figure 21C:
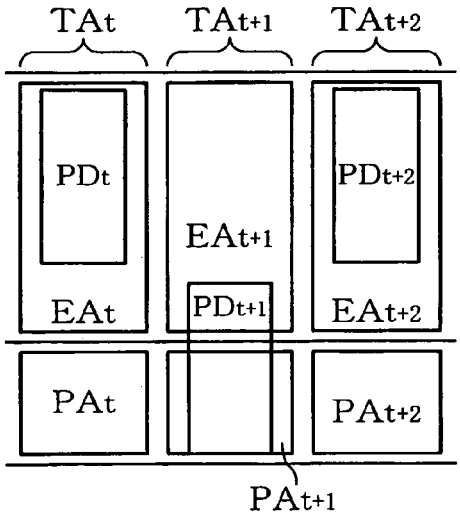

In the electrostatic discharge protection element ESDt, a phenomenon in which a hot spot occurs when static electricity is applied can be prevented by adjusting the shape (including the size) and the contact arrangement so that current does not locally flow in the drain region and the source region of the N-type MOS transistor, for example. In this embodiment, the transistor nDTrt can serve as the electrostatic discharge protection element ESDt. This allows the width in the direction D2 to be further reduced, as shown in FIG. 21C.

The width W of the integrated circuit device 10 in the direction D2 can be further reduced by forming some or all of the output transistors under the output pad, whereby a narrow integrated circuit device 10 can be realized. The width W in the direction D2 can be further reduced by allowing the output transistor to serve as the electrostatic discharge protection element. Moreover, electrostatic discharge protection capability can be increased.

4.2 Arrangement of Data Driver Block

Figure 24:
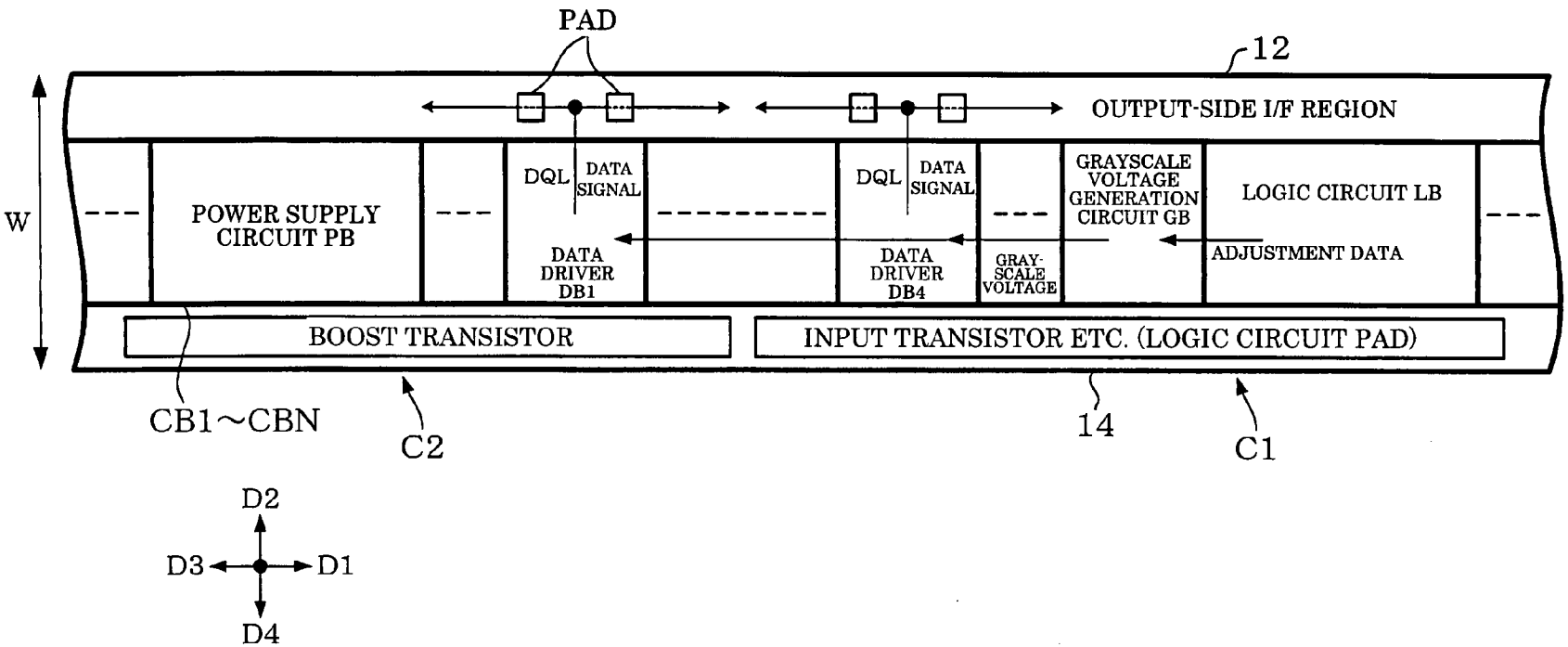
FIG. 24 is a view illustrative of an arrangement method for a logic circuit block, a grayscale voltage generation circuit block, a power supply circuit block, and a data driver block in the first or second configuration example.
Figure 25:
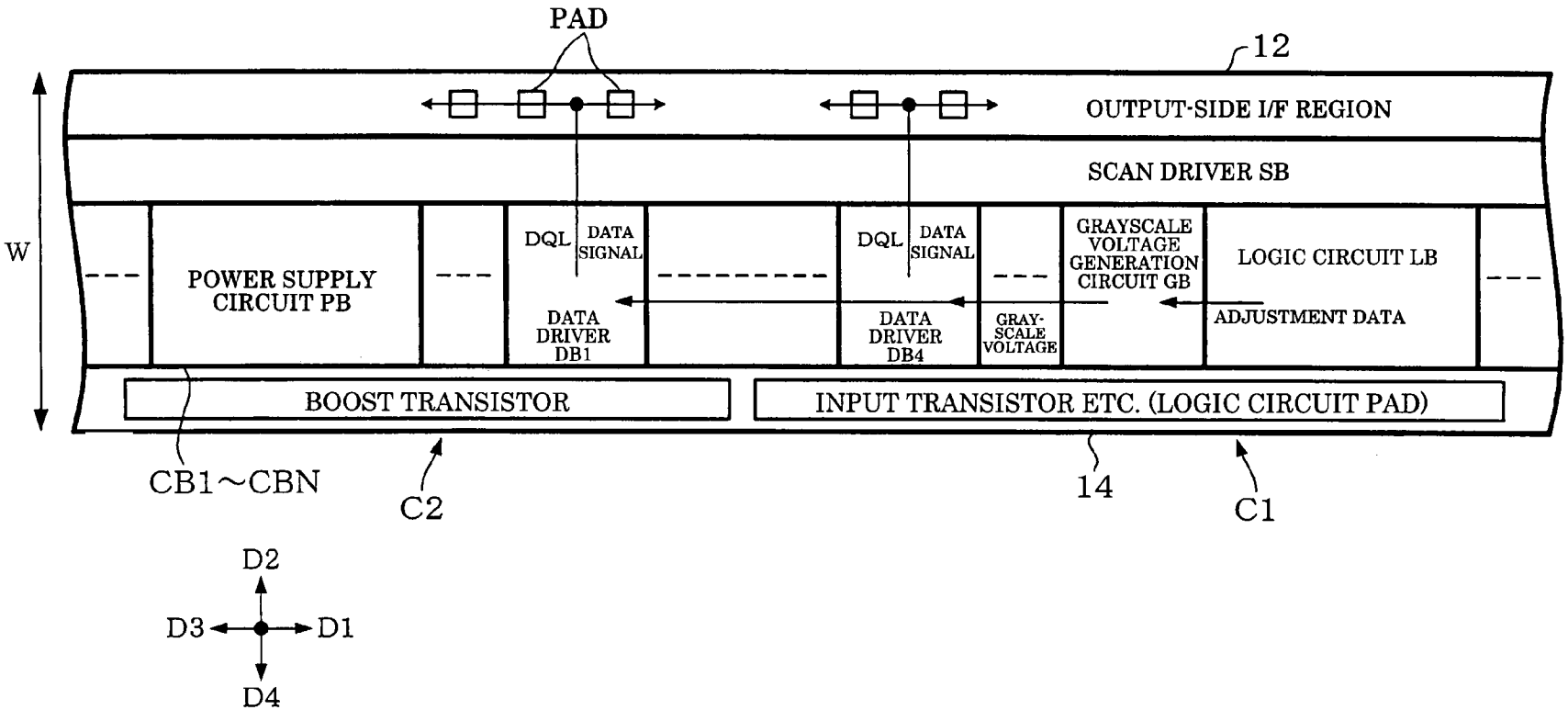
FIG. 25 is a view illustrative of an arrangement method for a logic circuit block, a grayscale voltage generation circuit block, a power supply circuit block, and a data driver block in the third configuration example.

In this embodiment, the circuit blocks of the circuit blocks CB1 to CBN excluding the scan driver block SB include the logic circuit block LB which sets grayscale characteristic adjustment data and the grayscale voltage generation circuit block GB which generates the grayscale voltage based on the set adjustment data, as shown in FIG. 24. Or, the circuit blocks CB1 to CBN include the logic circuit block LB which sets grayscale characteristic adjustment data and the grayscale voltage generation circuit block GB which generates the grayscale voltage based on the set adjustment data, as shown in FIG. 25. The circuit blocks CB1 to CBN also include the data driver blocks DB1 to DB4 (at least one data driver block in a broad sense) for driving the data line and the power supply circuit block PB which generates the power supply voltage. In this embodiment, the data driver blocks DB1 to DB4 are disposed between the logic circuit block LB and the grayscale voltage generation circuit block GB and the power supply circuit block PB.

According to the arrangement shown in FIGS. 24 and 25, the logic circuit block LB, the grayscale voltage generation circuit block GB, and the power supply circuit block PB with a relatively large circuit area are disposed on either side of the data driver blocks DB1 to DB4. Therefore, the logic circuit pad and the input transistor formed under the pad can be disposed by utilizing the space (space indicated by C1) on the side of the logic circuit block LB and the grayscale voltage generation circuit block GB in the direction D4. Moreover, a boost transistor of the power supply circuit with a large transistor size and the like can be disposed by utilizing the space (space indicated by C2) on the side of the power supply circuit block PB in the direction D4. According to the arrangement shown in FIGS. 24 and 25, since the data driver blocks DB1 to DB4 can be disposed near the center of the integrated circuit device, the data signal output lines from the data driver blocks DB1 to DB4 can be efficiently and simply provided in the output-side I/F region 12. Therefore, the wiring efficiency and the arrangement efficiency in the output-side I/F region 12 and the input-side I/F region 14 can be increased, whereby the width W of the integrated circuit device in the direction D2 can be reduced. As a result, a narrow integrated circuit device can be realized.

According to the arrangement shown in FIGS. 24 and 25, the output line of the grayscale voltage generated by the grayscale voltage generation circuit block GB based on the adjustment data from the logic circuit block LB can be efficiently provided and connected with the data driver blocks DB1 to DB4 using a global line or the like. Therefore, the wiring efficiency can be increased, whereby the width of the circuit blocks CB1 to CBN in the direction D2 can be reduced. As a result, a narrow integrated circuit device can be realized.

In FIGS. 24 and 25, the logic circuit block LB and the grayscale voltage generation circuit block GB are adjacently disposed along the direction D1. The reason therefor is as follows.

Figure 26:
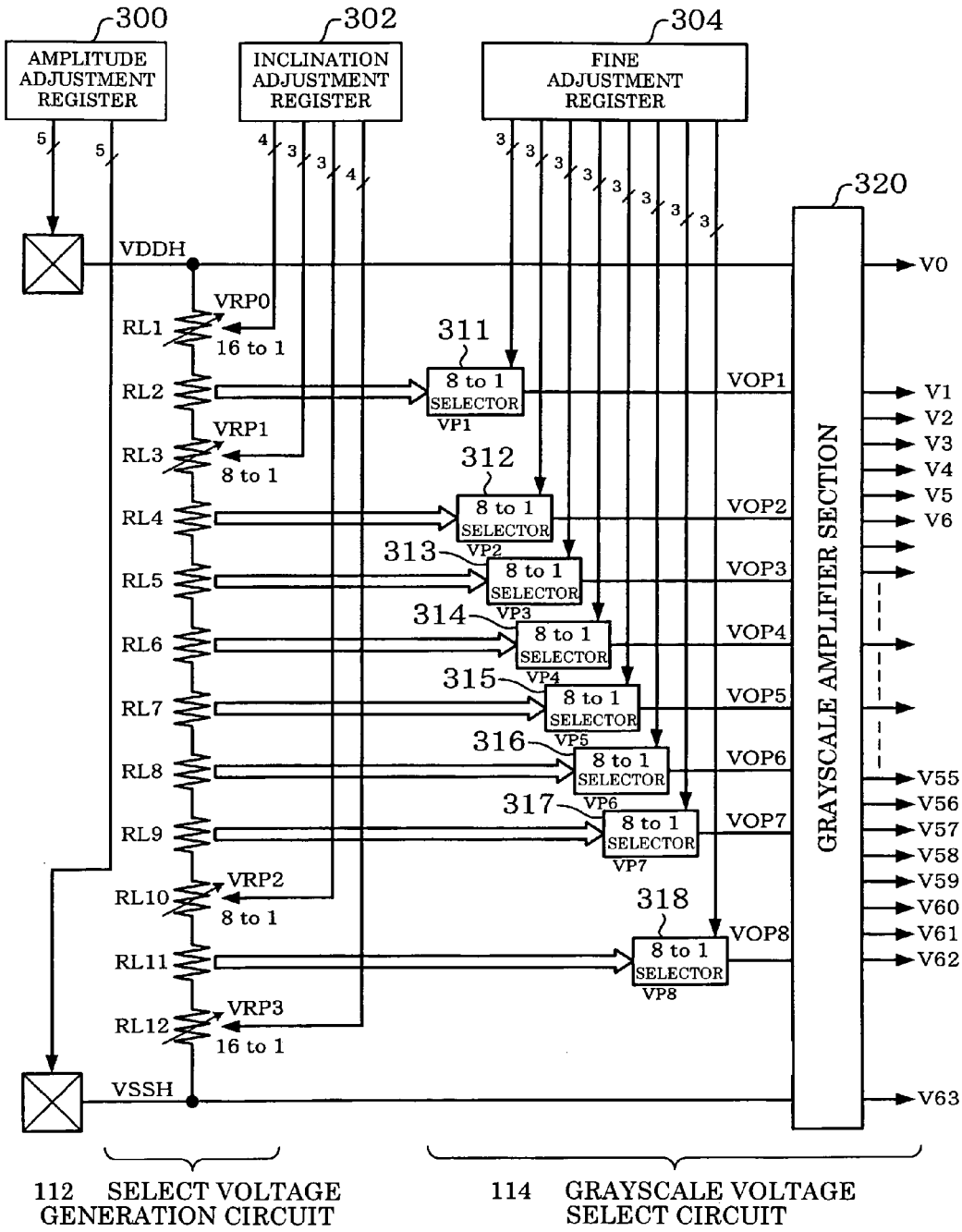
FIG. 26 is a detailed circuit configuration example of a grayscale voltage generation circuit block.
Figure 27A:
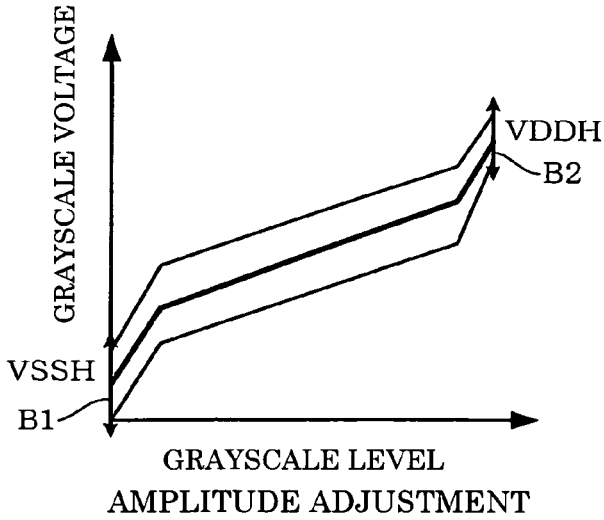
FIGS. 27A, 27B, and 27C are views illustrative of grayscale characteristic adjustment.
Figure 27B:
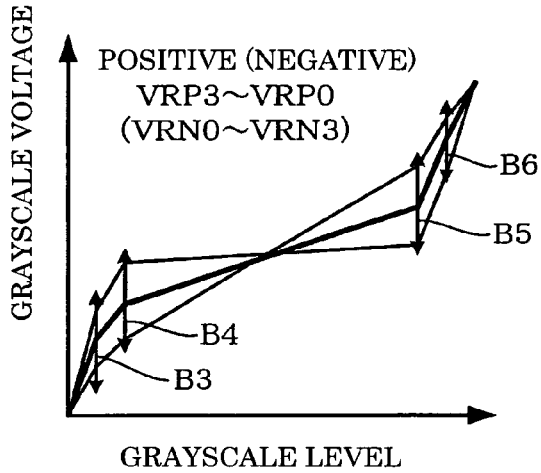
Figure 27C:
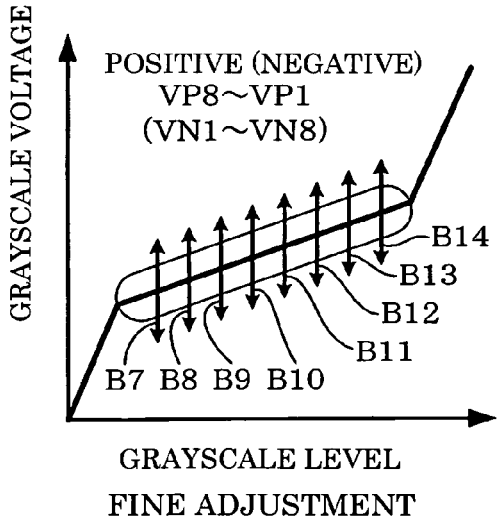

FIG. 26 shows a detailed circuit configuration example of the grayscale voltage generation circuit block GB. The circuit shown in FIG. 26 is a positive circuit. Note that a negative circuit may also be realized using a similar configuration. The grayscale characteristic adjustment data is set in an amplitude adjustment register 300, an inclination adjustment register 302, and a fine adjustment register 304. The adjustment data is set (written) by the logic circuit block LB. For example, the voltage levels of the power supply voltages VDDH and VSSH are changed as indicated by B1 and B2 in FIG. 27A by setting the adjustment data in the amplitude adjustment register 300 so that the amplitude of the grayscale voltage can be adjusted. The grayscale voltage is changed at four points of the grayscale level as indicated by B3 to B6 in FIG. 27B by setting the adjustment data in the inclination adjustment register 302 so that the inclination of the grayscale characteristics can be adjusted. Specifically, the resistance value of a resistor element RL12 of a resistance ladder is changed based on 4-bit adjustment data VRP3 set in the inclination adjustment register 302 so that the inclination can be adjusted as indicated by B3. This also applies to adjustment data VRP2 to VRP0. The grayscale voltage is changed at eight points of the grayscale level as indicated by B7 to B14 in FIG. 27C by setting the adjustment data in the fine adjustment register 304 so that the grayscale characteristics can be finely adjusted. Specifically, an 8-to-1 selector 318 selects one of eight taps of a resistor element RL11 based on 3-bit adjustment data VP8 set in the fine adjustment register 304, and outputs the voltage of the selected tap as an output VOP8. This enables fine adjustment as indicated by B7 in FIG. 27C. This also applies to adjustment data VP7 to VP1.

A grayscale amplifier section 320 outputs the grayscale voltages V0 to V63 based on the outputs VOP1 to VOP8 from the 8-to-1 selectors 311 to 318 and the power supply voltages VDDH and VSSH. In more detail, the grayscale amplifier section 320 includes first to eighth impedance conversion circuits (voltage-follower-connected operational amplifiers) to which the outputs VOP1 to VPOP8 are input. The grayscale voltages V1 to V62 are generated by dividing the output voltages of adjacent impedance conversion circuits of the first to eighth impedance conversion circuits by using resistors, for example.

The grayscale characteristics (γ-characteristics) optimum corresponding to the type of display panel can be obtained by the above-described adjustment, whereby the display quality can be improved.

However, the number of bits of adjustment data for performing such an adjustment is very large, as shown in FIG. 26. Therefore, the number of adjustment data signal lines from the logic circuit block LB to the grayscale voltage generation circuit block GB is also large. As a result, if the logic circuit block LB and the grayscale voltage generation circuit block GB are not disposed adjacent to each other, the chip area may be increased due to the wiring region for the adjustment data signal lines.

In this embodiment, the logic circuit block LB and the grayscale voltage generation circuit block GB are adjacently disposed along the direction D1, as shown in FIGS. 24 and 25. This enables the adjustment data signal lines from the logic circuit block LB to be connected with the grayscale voltage generation circuit block GB along a short path, whereby an increase in the chip area due to the wiring region can be prevented.

As a comparative example of this embodiment, the grayscale voltage generation circuit block GB and the logic circuit block LB may be disposed adjacent to each other along the direction D2. According to the method of the comparative example, since two circuit blocks are stacked (disposed) in the direction D2, the width of the integrated circuit device in the direction D2 is increased. Moreover, when the circuit configuration of one of the circuit blocks stacked in the direction D2 is changed corresponding to the number of pixels or the type of display panel, the specification of the display driver, or the like so that the width in the direction D2 or the length in the direction D1 of the circuit block is changed, the other circuit block is affected by such a change, whereby the design efficiency is decreased.

In this embodiment, the grayscale voltage generation circuit block GB and the logic circuit block LB are disposed along the direction D1. Therefore, since the width W of the integrated circuit device in the direction D2 can be reduced, a narrow chip as shown in FIG. 2B can be realized. Moreover, when the circuit configuration of one of the adjacent circuit blocks is changed corresponding to the type of display panel or the like, it suffices to adjust the length of the circuit block in the direction D1, for example. Therefore, the circuit block can be prevented from being affected by the other circuit block, whereby the design efficiency can be improved.

In FIGS. 24 and 25, the grayscale voltage generation circuit block GB is disposed between the data driver blocks DB1 to DB4 and the logic circuit block LB.

Specifically, the adjustment data signal lines are disposed between the grayscale voltage generation circuit block GB and the logic circuit block LB in FIGS. 24 and 25, and the number of adjustment data signal lines is large as described with reference to FIG. 26. The grayscale voltage generation circuit block GB must output the grayscale voltage to the data driver block DB, and the number of grayscale voltage output lines is very large. Therefore, if the grayscale voltage generation circuit block GB is not disposed between the data driver block DB and the logic circuit block LB, but is disposed on the side of the logic circuit block LB in the direction D1 in FIGS. 24 and 25, not only the adjustment data signal lines but also the grayscale voltage output lines must be disposed between the grayscale voltage generation circuit block GB and the logic circuit block LB. This makes it difficult to provide other signal lines and power supply lines between the grayscale voltage generation circuit block GB and the logic circuit block LB using a global line or the like, whereby the wiring efficiency is decreased.

On the other hand, since the grayscale voltage generation circuit block GB is disposed between the data driver block DB and the logic circuit block LB in FIGS. 24 and 25, the grayscale voltage output lines need not be disposed between the grayscale voltage generation circuit block GB and the logic circuit block LB. Therefore, other signal lines and power supply lines can be disposed between the grayscale voltage generation circuit block GB and the logic circuit block LB using a global line or the like, whereby the wiring efficiency can be increased.

In the embodiment, the data signal output line DQL from the data driver block DB is provided in the data driver block DB along the direction D2, as shown in FIGS. 24 and 25. On the other hand, the data signal output line DQL is provided in the output-side I/F region 12 (first interface region) along the direction D1 (D3). In more detail, the data signal output line DQL is provided in the output-side I/F region 12 along the direction D1 using the global line located in the lower layer of the pad and in the upper layer of the local line (transistor line) inside the output-side I/F region 12. This enables the data signal from the data driver block DB to be appropriately output to the display panel through the pad by efficiently providing the signal lines for the adjustment data, the grayscale voltage, and the data signal as shown in FIGS. 24 and 25. Moreover, if the data signal output line DQL is disposed as shown in FIGS. 24 and 25, the data signal output line DQL can be connected with the pads or the like by utilizing the output-side I/F region 12, whereby an increase in the width W of the integrated circuit device in the direction D2 can be prevented.

In FIGS. 24 and 25, the logic circuit block LB and the grayscale voltage generation circuit block GB are adjacently disposed. Note that a modification is also possible in which the logic circuit block LB is not disposed adjacent to the grayscale voltage generation circuit block GB. A modification is also possible in which the grayscale voltage generation circuit block GB is not disposed between the logic circuit block LB and the data driver blocks DB1 to DB4. The grayscale voltage generation circuit block GB and the data driver block DB4 may or may not be adjacently disposed. In addition, the power supply circuit block PB and the data driver block DB1 may or may not be adjacently disposed.

4.3 Details of Arrangement of Grayscale Voltage Generation Circuit Block

Figure 28A:
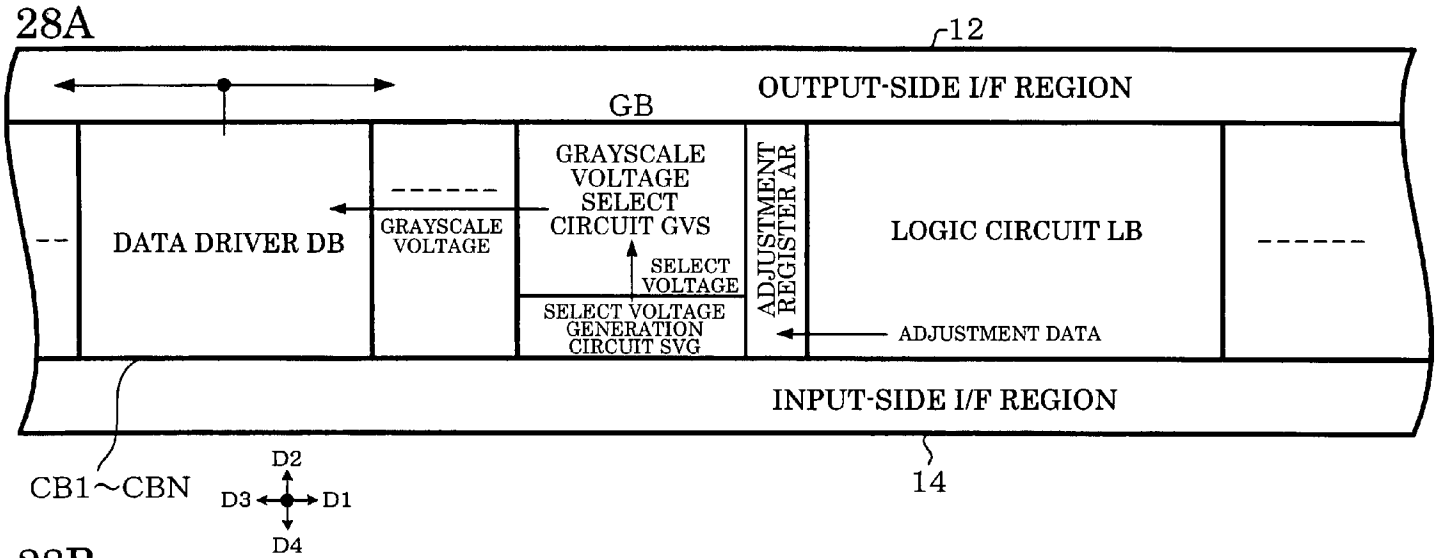
FIGS. 28A and 28B are views illustrative of a detailed arrangement example of the grayscale voltage generation circuit block in the first or second configuration example.
Figure 29A:
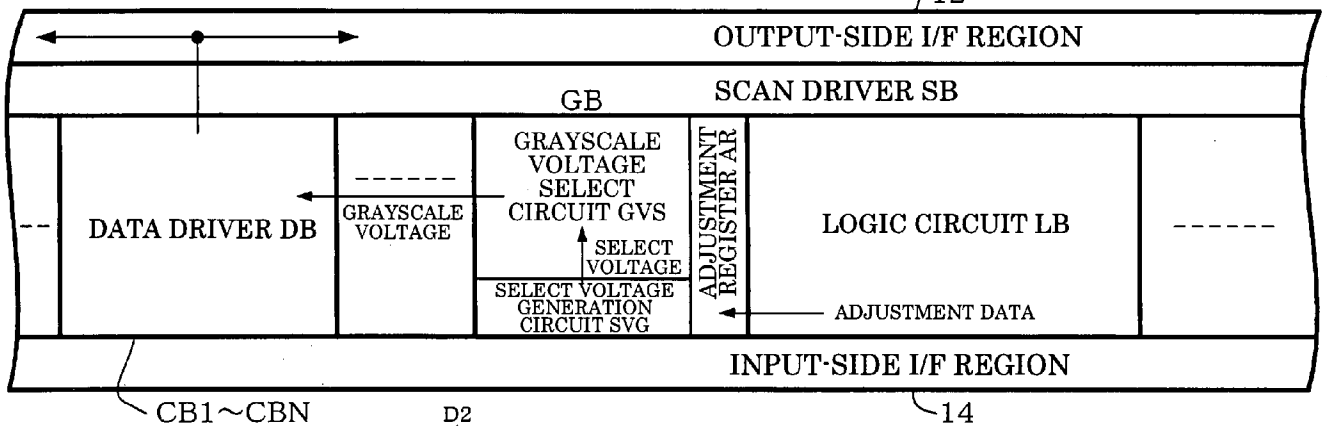
FIGS. 29A and 29B are views illustrative of a detailed arrangement example of the grayscale voltage generation circuit block in the third configuration example.

As shown in FIGS. 28A and 29A, the grayscale voltage generation circuit block GB includes a select voltage generation circuit SVG (voltage divider circuit) which outputs a select voltage (divided voltage) based on the power supply voltage. The grayscale voltage generation circuit block GB includes a grayscale voltage select circuit GVS which selects and outputs the grayscale voltage based on the adjustment data set by the logic circuit block LB and the select voltage. The grayscale voltage generation circuit block GB also includes an adjustment register AR for setting the adjustment data. The adjustment register AR may be included in the logic circuit block LB.

In FIGS. 28A and 29A, the select voltage generation circuit SVG is disposed on the side of the grayscale voltage select circuit GVS in the direction D4. The select voltage generation circuit SVG may be disposed on the side of the grayscale voltage select circuit GVS in the direction D2. The grayscale voltage select circuit GVS is disposed between the data driver block DB and the logic circuit block LB.

According to the arrangement shown in FIGS. 28A and 29A, the grayscale voltage select circuit GVS receives the adjustment data from the logic circuit block LB disposed on the side of the grayscale voltage select circuit GVS in the direction D1 through the adjustment register AR. The grayscale voltage select circuit GVS receives the select voltage from the select voltage generation circuit SVG disposed on the side of the grayscale voltage select circuit GVS in the direction D4. The grayscale voltage select circuit GVS outputs the grayscale voltage generated based on the adjustment data and the select voltage to the data driver block DB disposed on the side of the grayscale voltage select circuit GVS in the direction D3. Therefore, the signals of the adjustment data, the select voltage, and the grayscale voltage flow efficiently, and the crossing area of the signal lines can be minimized. Moreover, since the signal lines of the adjustment data, the select voltage, and the grayscale voltage can be efficiently provided by utilizing a global line or the like, the wiring efficiency can be increased.

Figure 28B:
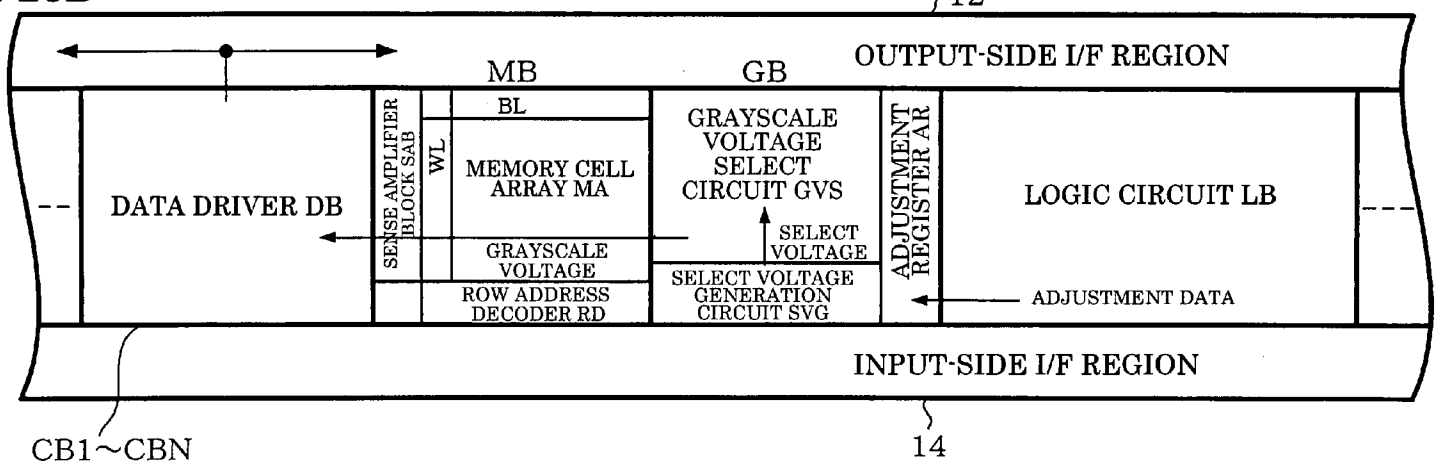
Figure 29B:
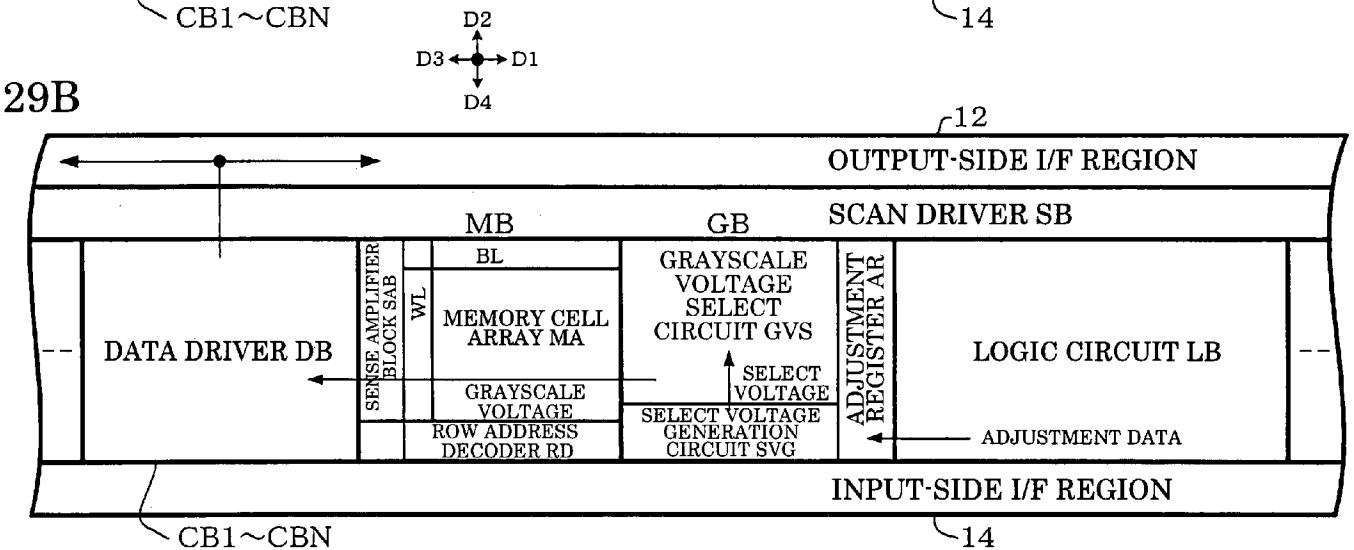

FIGS. 28B and 29B illustrate detailed arrangement examples when the integrated circuit device includes a memory. In FIGS. 28B and 29B, the memory block MB and the data driver block DB are adjacently disposed along the direction D1 (as the circuit blocks of the circuit blocks CB1 to CBN excluding the scan driver block SB). The memory block MB is disposed between the data driver block DB and the grayscale voltage generation circuit block GB.

In the comparative example shown in FIG. 1A, the memory block MB and the data driver block DB are disposed along the direction D2 (short side direction) corresponding to the signal flow. Therefore, since the width of the integrated circuit device in the direction D2 is increased, it is difficult to realize a narrow chip. When the memory block MB or the data driver block DB is changed in the width in the direction D2 or the length in the direction D1 due to a change in the number of pixels of the display panel, the specification of the display driver, the configuration of the memory cell, or the like, the remaining circuit blocks are affected by such a change, whereby the design efficiency is decreased.

In FIGS. 28B and 29B, since the data driver block DB and the memory block MB are disposed along the direction D1, the width W of the integrated circuit device in the direction D2 can be reduced, whereby a narrow chip as shown in FIG. 2B can be realized. Moreover, since it is possible to deal with a change in the number of pixels of the display panel or the like by dividing the memory block, the design efficiency can be improved.

In the comparative example shown in FIG. 1A, since the wordline WL is disposed along the direction D1 (long side direction), a significant signal delay occurs in the wordline WL, whereby the read speed of image data is decreased. In particular, since the wordline WL connected with the memory cells is formed using a polysilicon layer, the signal delay problem is serious. In this case, buffer circuits may be provided between the memory cell arrays in order to reduce the signal delay. However, use of this method increases the circuit scale, whereby cost is increased.

In FIGS. 28B and 29B, the wordline WL is disposed in the memory block MB along the direction D2 (short side direction), and the bitline BL is disposed along the direction D1 (long side direction). In this embodiment, the integrated circuit device has a small width W in the direction D2. Therefore, since the length of the wordline WL in the memory block MB can be reduced, a signal delay in the wordline WL can be significantly reduced in comparison with the comparative example shown in FIG. 1A. Moreover, since it is unnecessary to provide the buffer circuits between the memory cell arrays, the circuit area can be reduced. In the comparative example shown in FIG. 1A, since the wordline WL, which is long in the direction D1 and has a large parasitic capacitance, is selected even when only the access region of the memory is accessed from the host, power consumption is increased. On the other hand, according to the method of dividing the memory into blocks in the direction D1 as in this embodiment, since only the wordline WL of the memory block corresponding to the access region is selected during host access, a reduction in power consumption can be realized. The wordline WL shown in FIGS. 28B and 29B is a wordline connected with the memory cells (transfer transistors) of the memory block MB. The bitline BL shown in FIGS. 28B and 29B is a bitline through which image data stored in the memory block MB is output to the data driver block DB.

5. Details of Memory Block and Data Driver Block 5.1 Block Division

Figure 30A:
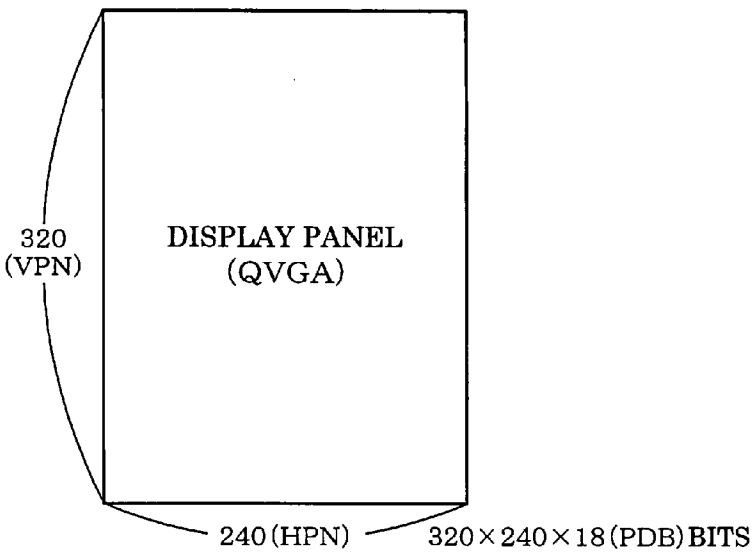
FIGS. 30A and 30B are views illustrative of the arrangement of the memory block and the data driver block in the first or second configuration example.
Figure 31A:
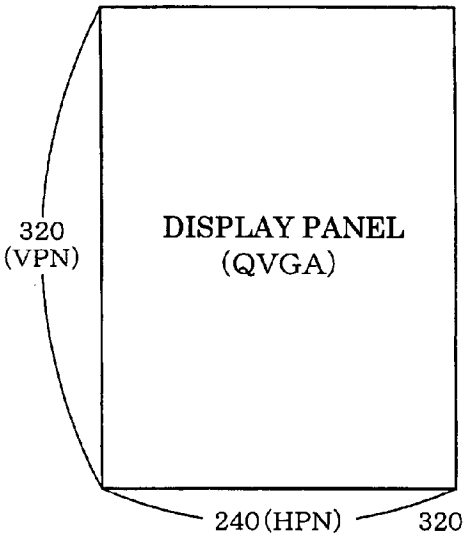
FIGS. 31A and 31B are views illustrative of the arrangement of the memory block and the data driver block in the third configuration example.

Consider the case where the display panel is a QVGA panel in which the number of pixels VPN in the vertical scan direction (data line direction) is 320 and the number of pixels HPN in the horizontal scan direction (scan line direction) is 240, as shown in FIGS. 30A and 31A. Suppose that the number of bits PDB of image (display) data of one pixel is 18 bits (six bits each for R, G, and B). In this case, the number of bits of image data required to display one frame on the display panel is "VPN×HPN×PDB=320×240×18" bits. Therefore, the memory of the integrated circuit device stores at least "320×240×18" bits of image data. The data driver outputs data signals for 240 (=HPN) data lines (data signals corresponding to "240×18" bits of image data) to the display panel in units of horizontal scan periods (in units of periods in which one scan line is scanned).

Figure 30B:
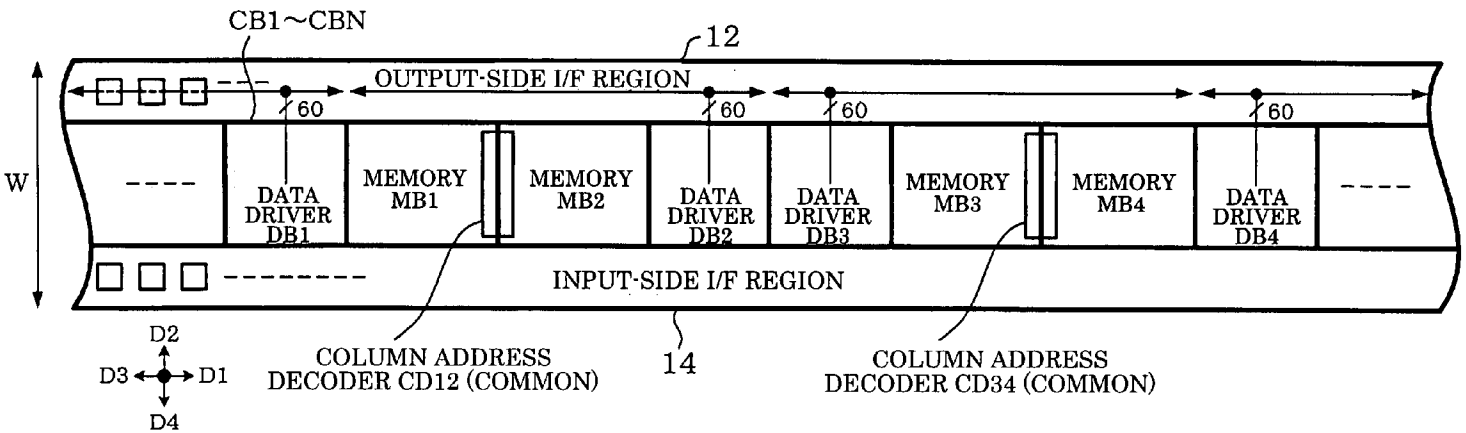
Figure 31B:
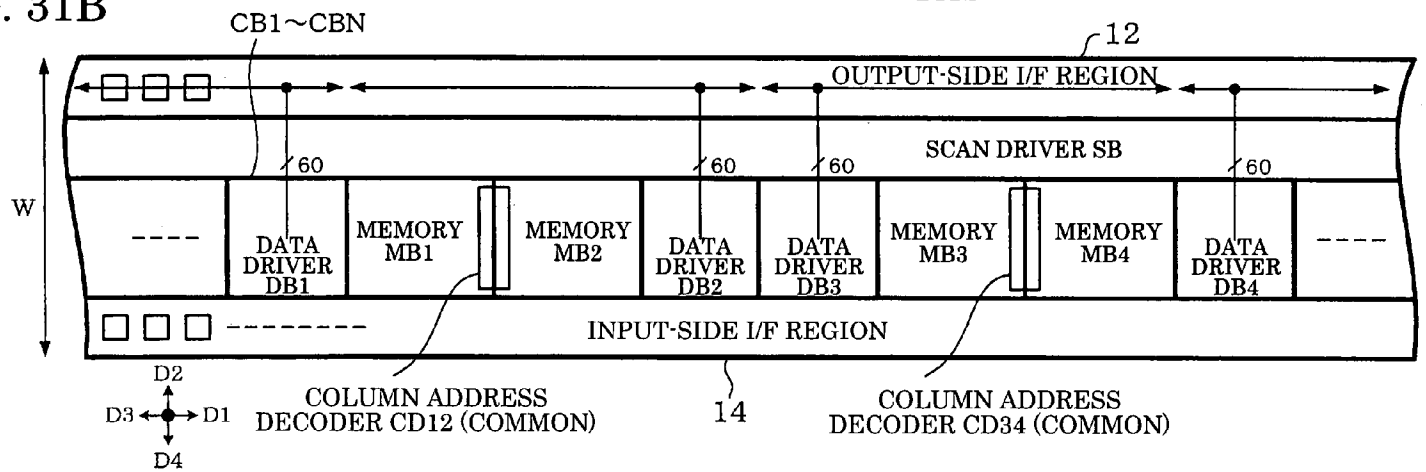

In FIGS. 30B and 31B, the data driver is divided into four (=DBN) data driver blocks DB1 to DB4. The memory is also divided into four (=MBN=DBN) memory blocks MB1 to MB4. Therefore, each of the data driver blocks DB1 to DB4 outputs data signals for 60 (=HPN/DBN=240/4) data lines to the display panel in units of horizontal scan periods. Each of the memory blocks MB1 to MB4 stores "(VPN×HPN×PDB)/MBN=(320×240×18)/4" bits of image data. In FIGS. 30B and 31B, the column address decoder CD12 is used by the memory blocks MB1 and MB2, and the column address decoder CD34 is used by the memory blocks MB3 and MB4.

5.2 Plurality of Read Operations in one Horizontal Scan Period

In FIGS. 30B and 31B, each of the data driver blocks DB1 to DB4 outputs data signals for 60 data lines in one horizontal scan period. Therefore, image data corresponding to data signals for 240 data lines must be read from the data driver blocks DB1 to DB4 corresponding to the data driver blocks DB1 to DB4 in units of horizontal scan periods.

However, when the number of bits of image data read in one horizontal scan period is increased, it is necessary to increase the number of memory cells (sense amplifiers) arranged in the direction D2. As a result, the width W of the integrated circuit device is increased in the direction D2 to hinder a reduction in the width of the chip. Moreover, the length of the wordline WL is increased, whereby a signal delay occurs in the wordline WL.

In this embodiment, image data stored in the memory blocks MB1 to MB4 is read from the memory blocks MB1 to MB4 into the data driver blocks DB1 to DB4 a plurality of times (RN times) in one horizontal scan period.

Figure 32:
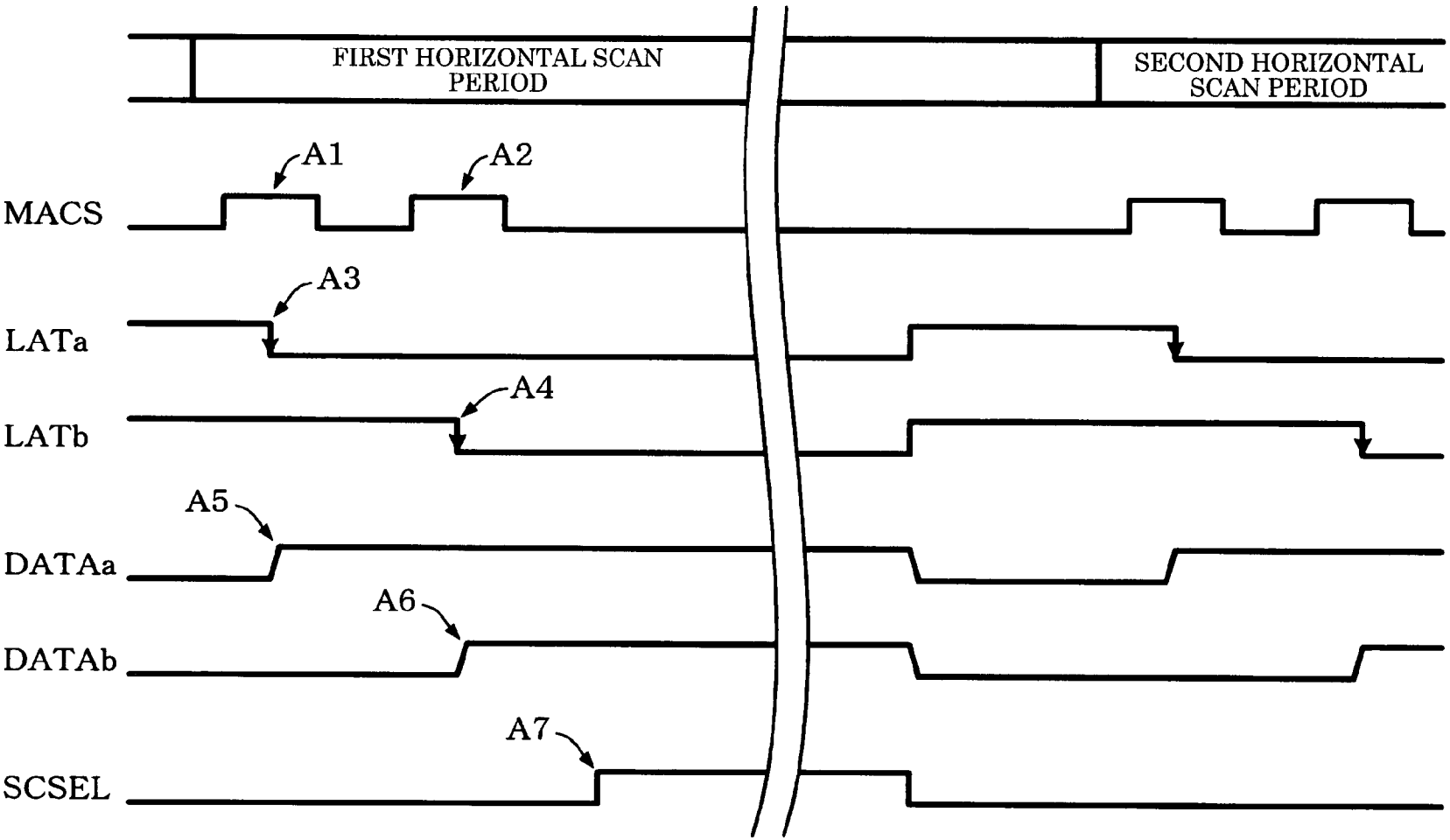
FIG. 32 is a view illustrative of a method of reading image data a plurality of times in one horizontal scan period.
Figure 33:
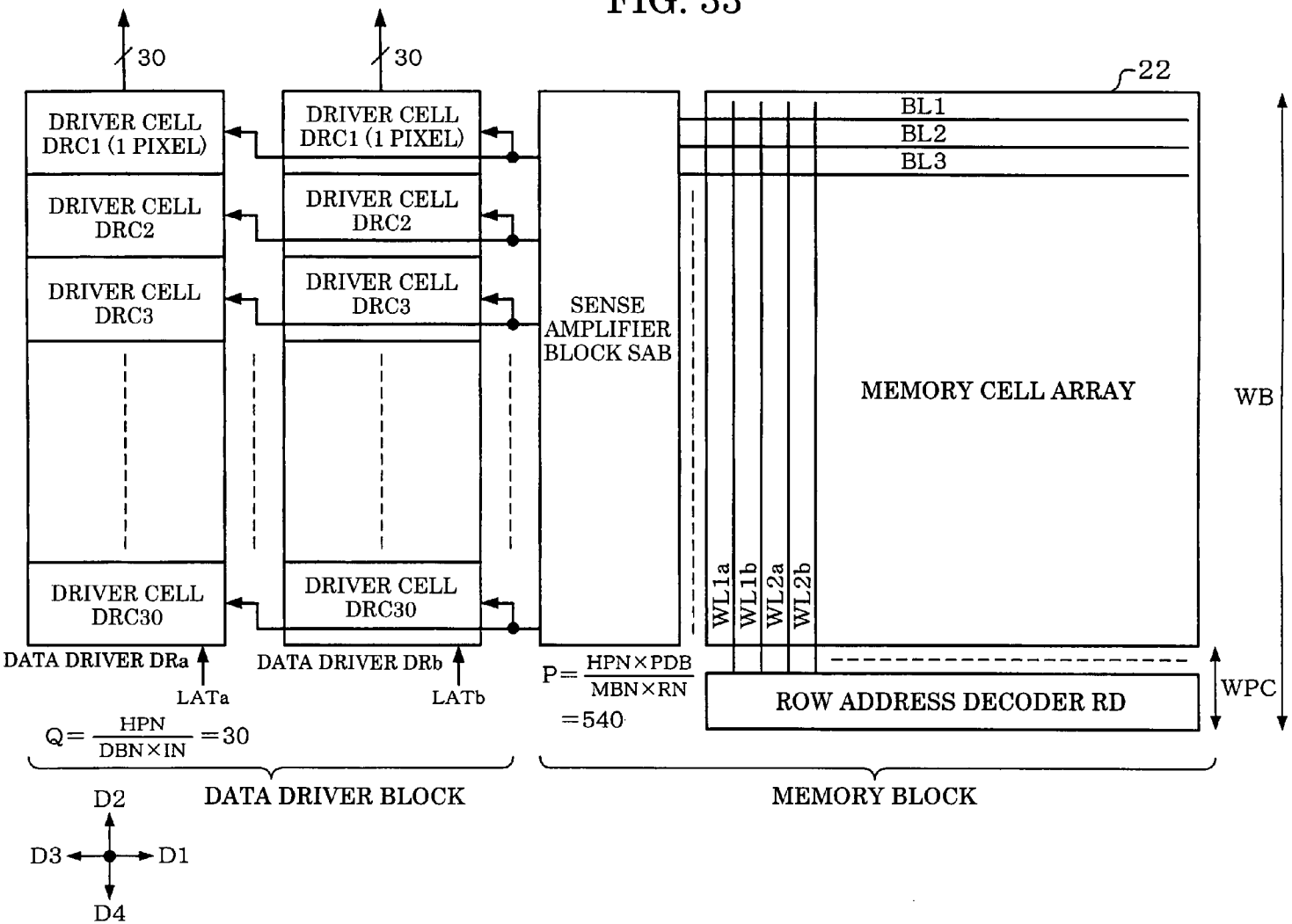
FIG. 33 is an arrangement example of data drivers and driver cells.

In FIG. 32, a memory access signal MACS (word select signal) goes active (high level) twice (RN=2) in one horizontal scan period, as indicated by A1 and A2, for example. This allows image data to be read from each memory block into each data driver block twice (RN=2) in one horizontal scan period. Then, data latch circuits included in data drivers DRa and DRb shown in FIG. 33 provided in the data driver block latch the image data read from the memory block based on latch signals LATa and LATb indicated by A3 and A4. D/A conversion circuits included in the data drivers DRa and DRb perform D/A conversion of the latched image data, and output circuits included in the data drivers DRa and DRb output data signals DATAa and DATAb obtained by D/A conversion to the data signal output lines, as indicated by A5 and A6. A scan signal SCSEL input to the gate of the TFT of each pixel of the display panel then goes active, as indicated by A7, and the data signal is input to and held in each pixel of the display panel.

In FIG. 32, the image data is read twice in the first horizontal scan period, and the data signals DATAa and DATAb are output to the data signal output lines in the first horizontal scan period. Note that the image data may be read twice and latched in the first horizontal scan period, and the data signals DATAa and DATAb corresponding to the latched image data may be output to the data signal output lines in the subsequent second horizontal scan period. FIG. 32 illustrates the case where the number RN of read operations is two. Note that the number RN may be three or more (RN≧3).

According to the method shown in FIG. 32, the image data corresponding to the data signals for 30 data lines is read from each memory block, and each of the data drivers DRa and DRb outputs the data signals for 30 data lines, as shown in FIG. 33. Therefore, the data signals for 60 data lines are output from each data driver block. In FIG. 32, it suffices to read the image data corresponding to the data signals for 30 data lines from each memory block in one read operation, as described above. Therefore, the number of memory cells and sense amplifiers can be reduced in the direction D2 in FIG. 33 in comparison with a method in which the image data is read only once in one horizontal scan period. As a result, the width of the integrated circuit device can be reduced in the direction D2, whereby a narrow chip as shown in FIG. 2B can be realized. In a QVGA display, the length of one horizontal scan period is about 52 microseconds. On the other hand, the memory read time is about 40 nanoseconds, which is sufficiently shorter than 52 microseconds. Therefore, even if the number of read operations in one horizontal scan period is increased from one to two or more, the display characteristics are not affected to a large extent.

In addition to the QVGA (320×240) display panel shown in FIGS. 30A and 31A, it is also possible to deal with a VGA (640×480) display panel by increasing the number of read operations in one horizontal scan period to four (RN=4), for example, whereby the degrees of freedom of the design can be increased.

A plurality of read operations in one horizontal scan period may be implemented using a first method in which the row address decoder (wordline select circuit) selects different wordlines in each memory block in one horizontal scan period, or a second method in which the row address decoder (wordline select circuit) selects a single wordline in each memory block a plurality of times in one horizontal scan period. Or, a plurality of read operations in one horizontal scan period may be implemented by combining the first method and the second method.

5.3 Arrangement of Data Driver and Driver Cell

FIG. 33 illustrates an arrangement example of data drivers and driver cells included in the data drivers. As shown in FIG. 33, the data driver block includes data drivers DRa and DRb (first to mth data drivers) arranged along the direction D1. Each of the data drivers DRa and DRb includes 30 (Q in a broad sense) driver cells DRC1 to DRC30.

When the wordline WL1*a* of the memory block has been selected and the first image data has been read from the memory block, as indicated by A1 in FIG. 32, the data driver DRa latches the read image data based on the latch signal LATa indicated by A3. The data driver DRa performs D/A conversion of the latched image data, and outputs the data signal DATAa corresponding to the first image data to the data signal output line, as indicated by A5.

When the wordline WL1*b* of the memory block has been selected and the second image data has been read from the memory block, as indicated by A2 in FIG. 32, the data driver DRb latches the read image data based on the latch signal LATb indicated by A4. The data driver DRb performs D/A conversion of the latched image data, and outputs the data signal DATAb corresponding to the second image data to the data signal output line, as indicated by A6.

Each of the data drivers DRa and DRb outputs data signals for 30 data lines corresponding to 30 pixels, whereby the data signals for 60 data lines corresponding to 60 pixels are output in total.

A problem in which the width W of the integrated circuit device is increased in the direction D2 due to an increase in the size of the data driver can be prevented by disposing (stacking) the data drivers DRa and DRb along the direction D1, as shown in FIG. 33. The data driver is configured in various ways depending on the type of display panel. In this case, data drivers having various configurations can be efficiently arranged by disposing the data drivers along the direction D1. FIG. 33 illustrates the case where the number of data drivers disposed along the direction D1 is two. Note that the number of data drivers disposed along the direction D1 may be three or more.

In FIG. 33, each of the data drivers DRa and DRb includes 30 (Q) driver cells DRC1 to DRC30 arranged along the direction D2. Each of the driver cells DRC1 to DRC30 receives image data of one pixel. Each of the driver cells DRC1 to DRCQ performs D/A conversion of image data for one pixel, and outputs data signals corresponding to the image data for one pixel. Each of the driver cells DRC1 to DRC30 may include a data latch circuit, the DAC (DAC for one pixel) shown in FIG. 10A, and the output section SQ shown in FIGS. 10B and 10C.

In FIG. 33, suppose that the number of pixels of the display panel in the horizontal scan direction (the number of pixels in the horizontal scan direction driven by each integrated circuit device when two or more integrated circuit devices cooperate to drive the data lines of the display panel) is HPN, the number of data driver blocks (number of block divisions) is DBN, and the number of inputs of image data to the driver cell in one horizontal scan period is IN. The number IN is equal to the number RN of image data read operations in one horizontal scan period described with reference to FIG. 32. In this case, the number Q of driver cells DRC1 to DRC30 arranged along the direction D2 may be expressed as "Q=HPN/(DBN×IN)". In FIG. 33, since "HPN=240", "DBN=4", and "IN=2", "Q=240/(4×2)=30".

When the width (pitch) of the driver cells DRC1 to DRC30 in the direction D2 is WD, the width WB (maximum width) of the first to Nth circuit blocks CB1 to CBN in the direction D2 may be expressed as "Q×WD≦WB≦(Q+1)×WD". When the width of the peripheral circuit section (e.g. row address decoder RD and interconnect region) included in the memory block in the direction D2 is WPC, the width WB may be expressed as "Q×WD≦WB≦(Q+1)×WD+WPC".

Suppose that the number of pixels of the display panel in the horizontal scan direction is HPN, the number of bits of image data of one pixel is PDB, the number of memory blocks is MBN (=DBN), and the number of read operations of image data from the memory block in one horizontal scan period is RN. In this case, the number P of sense amplifiers (sense amplifiers which output one bit of image data) arranged in the sense amplifier block SAB along the direction D2 may be expressed as "P=(HPN×PDB)/(MBN×RN)". In FIG. 33, since "HPN=240", "PDB=18", "MBN=4", and "RN=2", "P=(240×18)/(4×2)=540". The number P is the number of effective sense amplifiers corresponding to the number of effective memory cells, and excludes the number of ineffective sense amplifiers such as sense amplifiers for dummy memory cells.

When the width (pitch) of each sense amplifier included in the sense amplifier block SAB in the direction D2 is WS, the width WSAB of the sense amplifier block SAB (memory block) in the direction D2 may be expressed as "WSAB=P×WS". When the width of the peripheral circuit section included in the memory block in the direction D2 is WPC, the width WB (maximum width) of the circuit blocks CB1 to CBN in the direction D2 may also be expressed as "P×WS≦WB<(P+PDB)×WS+WPC".

5.4 Memory Cell

Figure 34A:
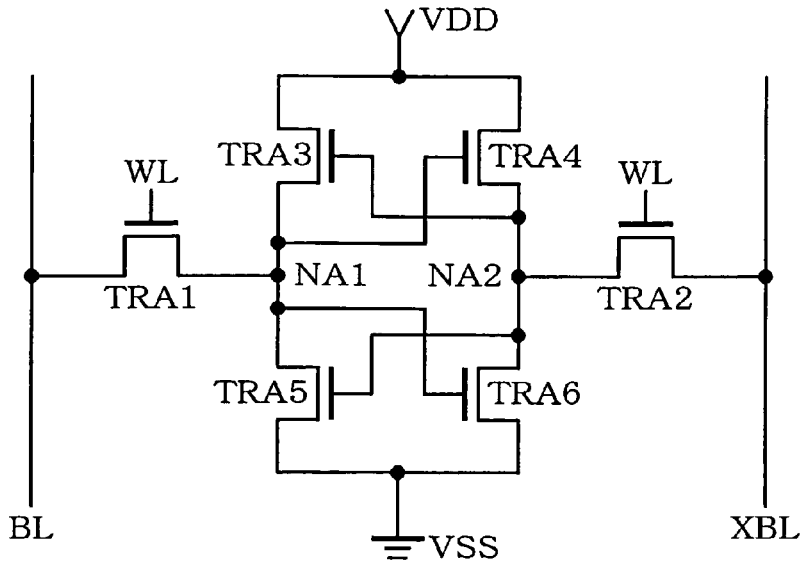
FIGS. 34A, 34B, and 34C are configuration examples of a memory cell.

FIG. 34A illustrates a configuration example of the memory cell (SRAM) included in the memory block. The memory cell includes transfer transistors TRA1 and TRA2, load transistors TRA3 and TRA4, and driver transistors TRA5 and TRA6. The transfer transistors TRA1 and TRA2 are turned ON when the wordline WL goes active, whereby the image data can be written into nodes NA1 and NA2 or the image data can be read from the nodes NA1 and NA2. The image data written into the memory cell is held at the nodes NA1 and NA2 using flip-flop circuits formed by the transistors TRA3 to TRA6. The configuration of the memory cell of the embodiment is not limited to that shown in FIG. 34A. Various modifications and variations may be made, such as using resistor elements as the load transistors TRA3 and TRA4 or adding another transistor.

Figure 34B:
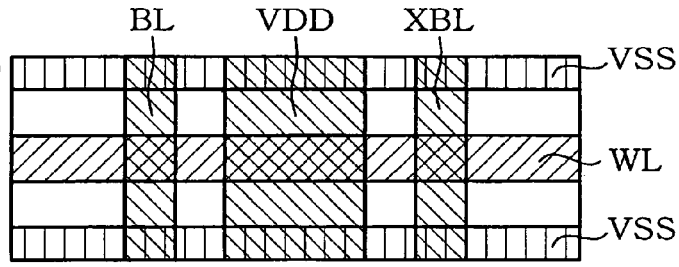
Figure 34C:
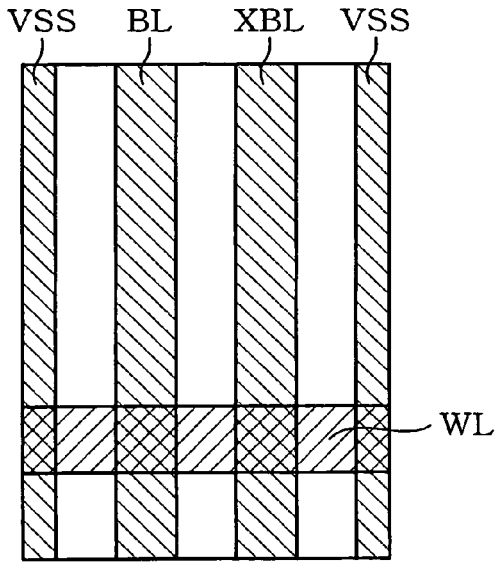

FIGS. 34B and 34C illustrate layout examples of the memory cell. FIG. 34B is a layout example of a horizontal type cell, and FIG. 34C is a layout example of a vertical type cell. As shown in FIG. 34B, the horizontal type cell is a cell in which the wordline WL is longer than the bitlines BL and XBL in each memory cell. As shown in FIG. 34C, the vertical type cell is a cell in which the bitlines BL and XBL are longer than the wordline WL in each memory cell. The wordline WL shown in FIG. 34C is a local wordline which is formed by a polysilicon layer and connected with the transfer transistors TRA1 and TRA2. Note that a wordline formed using a metal layer may be further provided to prevent a signal delay and to stabilize the potential of the wordline WL.

Figure 35:
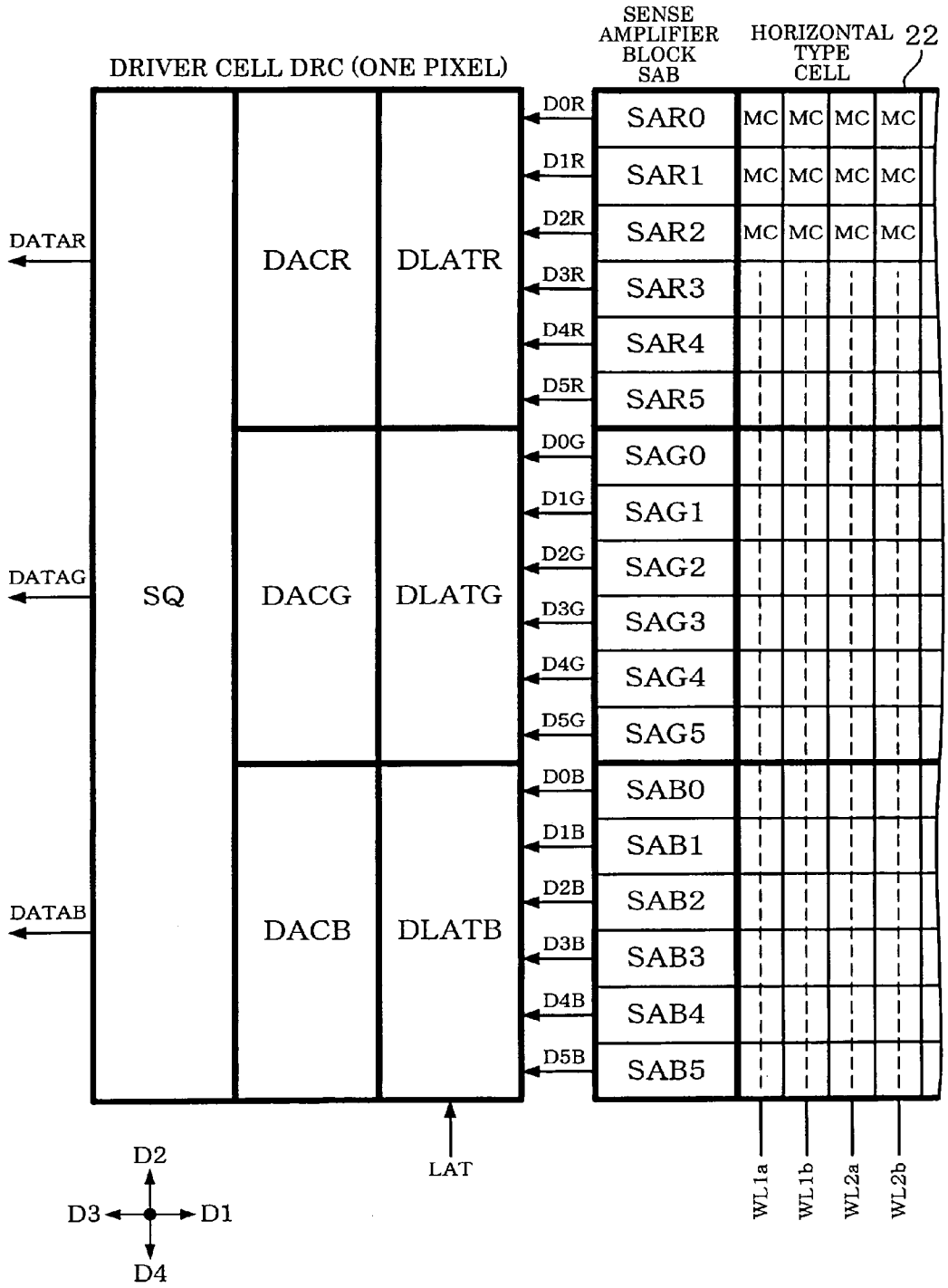
FIG. 35 is an arrangement example of a memory block and a driver cell in a horizontal type cell.

FIG. 35 shows an arrangement example of the memory block and the driver cell when using the horizontal type cell shown in FIG. 34B as the memory cell. FIG. 35 minutely illustrates the section of the driver cell and the memory block corresponding to one pixel.

As shown in FIG. 35, the driver cell DRC which receives image data for one pixel includes R (red), G (green), and B (blue) data latch circuits DLATR, DLATG, and DLATB. Each of the data latch circuits DLATR, DLATG, and DLATB latches the image data when the latch signal LAT (LATa, LATb) goes active. The driver cell DRC includes the R, G, and B digital-analog converters DACR, DACG, and DACB described with reference to FIG. 10A. The driver cell DRC also includes the output section SQ described with reference to FIGS. 10B and 10C.

The section of the sense amplifier block SAB corresponding to one pixel includes R sense amplifiers SAR0 to SAR5, G sense amplifiers SAG0 to SAG5, and B sense amplifiers SAB0 to SAB5. The bitlines BL and XBL of the memory cells MC arranged along the direction D1 on the side of the sense amplifier SAR0 in the direction D1 are connected with the sense amplifier SAR0. The bitlines BL and XBL of the memory cells MC arranged along the direction D1 on the side of the sense amplifier SAR1 in the direction D1 are connected with the sense amplifier SAR1. The above description also applies to the relationship between the remaining sense amplifiers and the memory cells.

When the wordline WL1*a* is selected, the image data is read from the memory cells MC of which the gate of the transfer transistor is connected with the wordline WL1*a* through the bitlines BL and XBL, and the sense amplifiers SAR0 to SAR5, SAG0 to SAG5, and SAB0 to SAB5 amplify the signals. The data latch circuit DLATR latches 6-bit R image data D0R to D5R from the sense amplifiers SAR0 to SAR5, the DACR performs D/A conversion of the latched image data, and the output section SQ outputs the data signal DATAR. The data latch circuit DLATG latches 6-bit G image data D0G to D5G from the sense amplifiers SAG0 to SAG5, the DACG performs D/A conversion of the latched image data, and the output section SQ outputs the data signal DATAG. The data latch circuit DLATB latches 6-bit G image data D0B to D5B from the sense amplifiers SAB0 to SAB5, the DACB performs D/A conversion of the latched image data, and the output section SQ outputs the data signal DATAB.

In the configuration shown in FIG. 35, a plurality of image data read operations in one horizontal scan period shown in FIG. 32 may be realized as follows. Specifically, in the first horizontal scan period (first scan line select period), the first image data read operation is performed by selecting the wordline WL1*a*, and the first data signal DATAa is output as indicated by A5 in FIG. 32. Then, the second image data read operation is performed in the first horizontal scan period by selecting the wordline WL1*b*, and the second data signal DATAb is output, as indicated by A6 in FIG. 32. In the subsequent second horizontal scan period (second scan line select period), the first image data read operation is performed by selecting the wordline WL2*a*, and the first data signal DATAa is output. Then, the second image data read operation is performed in the second horizontal scan period by selecting the wordline WL2*b*, and the second data signal DATAb is output. As described above, when using the horizontal type cell, a plurality of read operations in one horizontal scan period can be realized by selecting different wordlines (WL1*a* and WL1*b*) in the memory block in one horizontal scan period.

Figure 36:
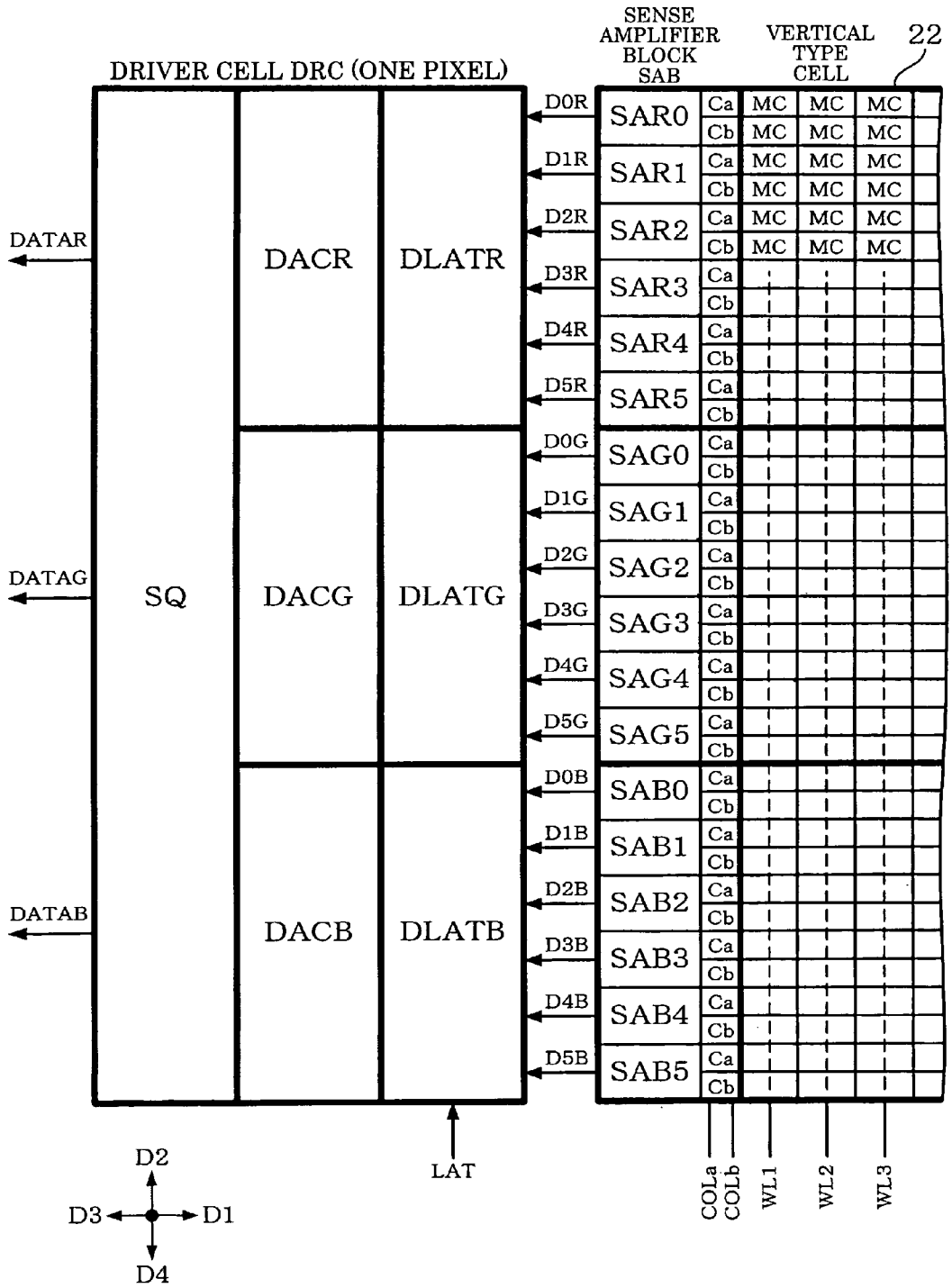
FIG. 36 is an arrangement example of a memory block and a driver cell in a vertical type cell.

FIG. 36 illustrates an arrangement example of the memory block and the driver cell when using the vertical type cell shown in FIG. 34C as the memory cell. The width of the vertical type cell in the direction D2 can be reduced in comparison with the horizontal type cell. Therefore, the number of memory cells in the direction D2 can be doubled in comparison with the horizontal type cell. When using the vertical type cell, the column of the memory cells connected with each sense amplifier is switched by using column select signals COLa and COLb.

In FIG. 36, when the column select signal COLa goes active, the column Ca side memory cells MC provided on the side of the sense amplifiers SAR0 to SAR5 in the direction D1 are selected, and connected with the sense amplifiers SAR0 to SAR5, for example. The signals of the image data stored in the selected memory cells MC are amplified and output as the image data D0R to D5R. When the column select signal COLb goes active, the column Cb side memory cells MC provided on the side of the sense amplifiers SAR0 to SAR5 in the direction D1 are selected, and connected with the sense amplifiers SAR0 to SAR5. The signals of the image data stored in the selected memory cells MC are amplified and output as the image data D0R to D5R. The above description also applies to the read operation of the image data from the memory cells connected to the remaining sense amplifiers.

In the configuration shown in FIG. 36, a plurality of image data read operations in one horizontal scan period shown in FIG. 32 may be realized as follows. Specifically, in the first horizontal scan period, the first image data read operation is performed by selecting the wordline WL1*a* and setting the column select signal COLa to active, and the first data signal DATAa is output, as indicated by A5 shown in FIG. 32. In the first horizontal scan period, the second image data read operation is performed by selecting the wordline WL1 and setting the column select signal COLb to active, and the second data signal DATAb is output, as indicated by A6 shown in FIG. 32. In the second horizontal scan period, the first image data read operation is performed by selecting the wordline WL2 and setting the column select signal COLa to active, and the first data signal DATAa is output. In the second horizontal scan period, the second image data read operation is performed by selecting the wordline WL2 and setting the column select signal COLb to active, and the second data signal DATAb is output. As described above, when using the vertical type cell, a plurality of read operations in one horizontal scan period can be realized by selecting a single wordline in the memory block a plurality of times in one horizontal scan period.

The configuration and the arrangement of the driver cell DRC are not limited to those shown in FIGS. 35 and 36. Various modifications and variations may be made. For example, when a low-temperature polysilicon TFT display driver or the like multiplexes and supplies R, G, and B data signals to the display panel as shown in FIG. 10C, R, G and B image data (image data for one pixel) may be D/A converted by using one common DAC. In this case, it suffices that the driver cell DRC include one common DAC having the configuration shown in FIG. 10A. In FIGS. 35 and 36, the R circuits (DLATR and DACR), the G circuits (DLATG and DACG), and the B circuits (DLATB and DACB) are disposed along the direction D2 (D4). Note that the R, G, and B circuits may be disposed along the direction D1 (D3).

5.5 Wiring of Grayscale Voltage Output Line and Shielding of Bitline

Figure 37A:
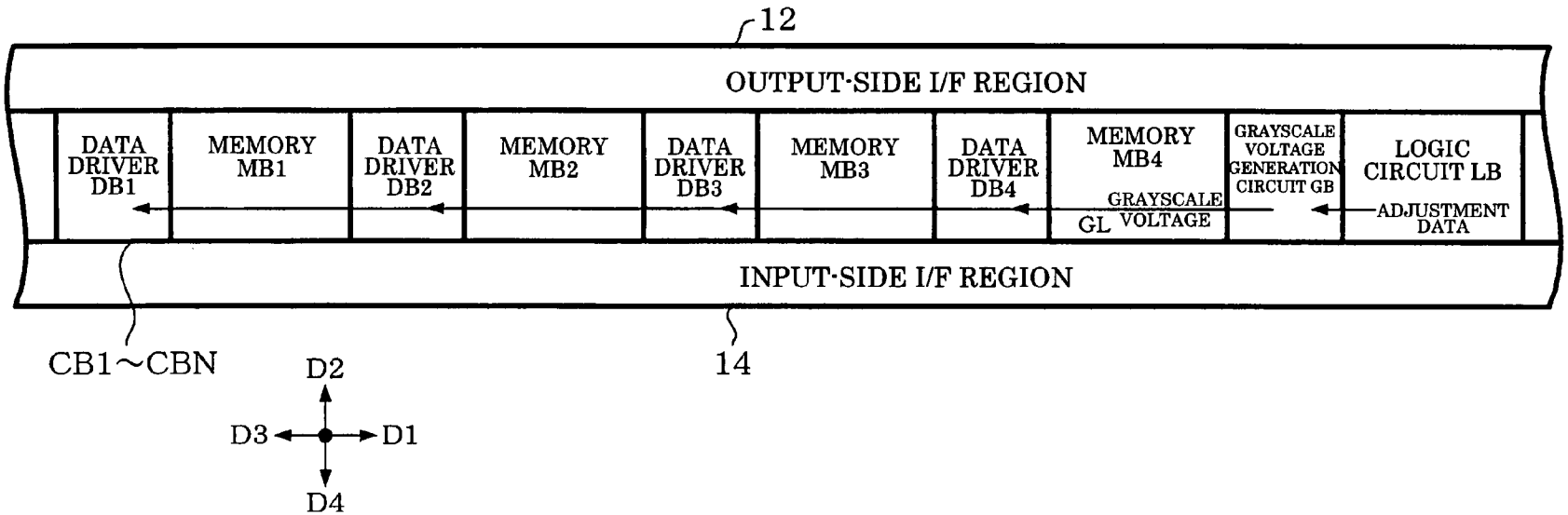
FIGS. 37A, 37B, and 37C are views illustrative of a grayscale voltage output line wiring method in the first or second configuration example.
Figure 38A:
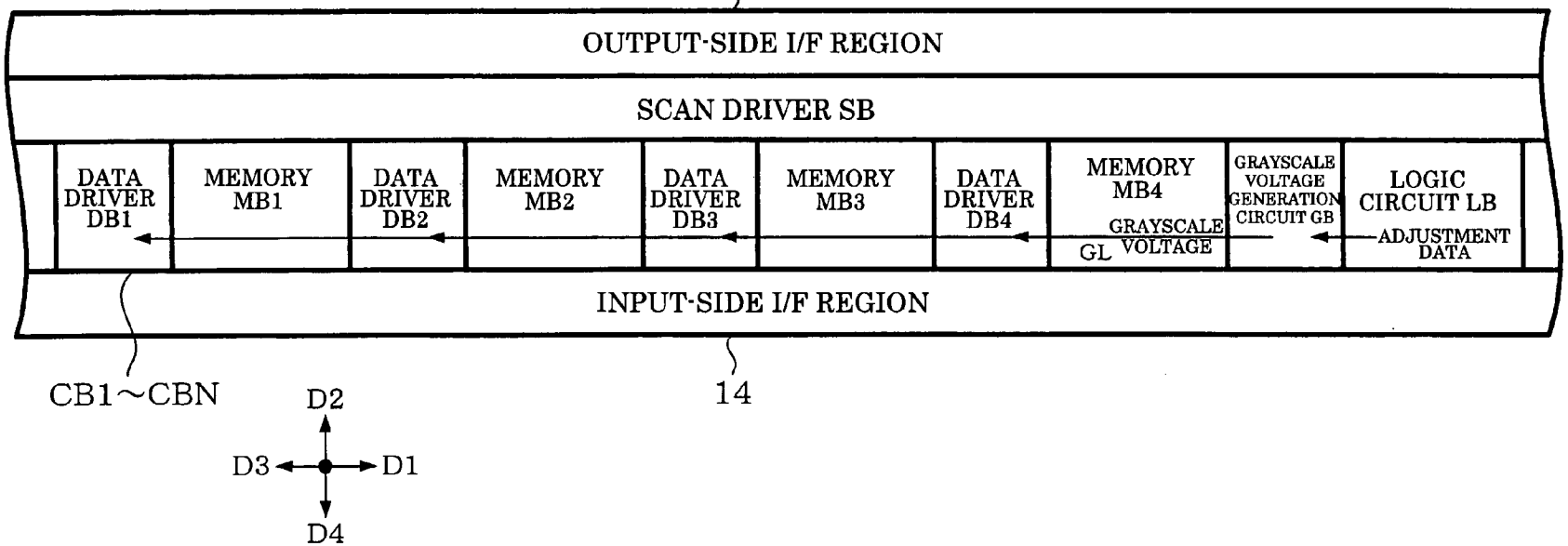
FIGS. 38A, 38B, and 38C are views illustrative of a grayscale voltage output line wiring method in the third configuration example.

In the embodiment, as shown in FIGS. 37A and 38A, the grayscale voltage output line to which the grayscale voltage from the grayscale voltage generation circuit block GB is output is disposed on the circuit blocks CB1 to CBN along the direction D1. In more detail, the grayscale voltage output line is formed using a global line GL provided in the upper layer of the local line in the circuit block.

Specifically, the grayscale voltage from the grayscale voltage generation circuit block GB must be supplied to the data driver blocks DB1 to DB4 arranged along the direction D1, as shown in FIGS. 37A and 38A. If the grayscale voltage output line is provided in the I/F regions 12 and 14, it becomes difficult to provide other signal lines and power supply lines in the I/F regions 12 and 14 using a global line. Therefore, the wiring efficiency in the I/F regions 12 and 14 is decreased, whereby the widths of the I/F regions 12 and 14 in the direction D2 must be increased. In particular, since it is necessary to provide a number of data signal output lines from the data driver block and a number of scan signal output lines from the scan driver blocks in the output-side I/F region 12, it is not desirable to provide the grayscale voltage output line in the output-side I/F region 12.

In FIGS. 37A and 38A, the grayscale voltage output line from the grayscale voltage generation circuit block GB is provided over the circuit blocks CB1 to CBN along the direction D1. Therefore, the global lines in the I/F regions 12 and 14 can be used as signal lines and power supply lines other than the grayscale voltage output line, whereby the wiring efficiency can be increased.

Figure 37B:
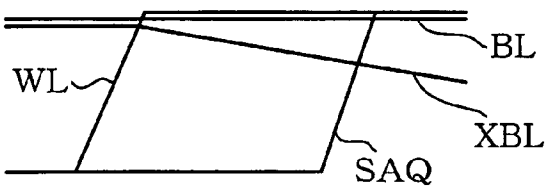
Figure 38B:
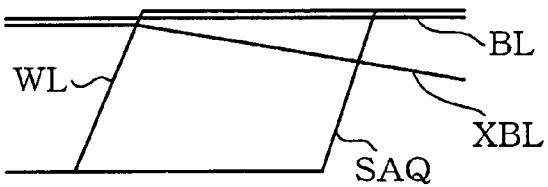

However, the following problem may occur when the global line GL such as the grayscale voltage output line is provided over the memory blocks MB1 to MB4. In FIGS. 37B and 38B, when a wordline WL has become active and the voltage level of a bitline BL has become higher than the voltage level of a bitline XBL, an output SAQ of a sense amplifier outputs a normal logic "1".

Figure 37C:
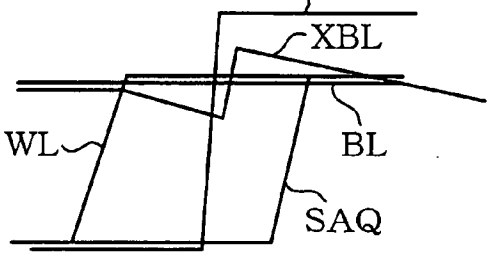
Figure 38C:
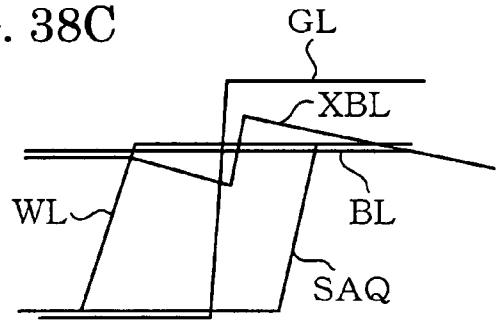

In FIGS. 37C and 38C, when the voltage level of the global line GL is changed, the voltage level of the bitline XBL is changed by capacitive coupling between the global line GL and the bitline XBL in the lower layer. This may cause the output SAQ of the sense amplifier to output abnormal logic "0".

In this embodiment, a shield line is provided in the upper layer of the bitline in the memory blocks MB1 to MB4 shown in FIGS. 37A and 38A, and the grayscale voltage output line from the grayscale voltage generation circuit block GB is provided in the upper layer of the shield line.

FIG. 39A illustrates an arrangement example of a shield line SDL when using the horizontal type cell. In FIG. 39A, a first metal interconnect ME1 in the lowermost layer is used for node connection, and a second metal interconnect ME2 in the upper layer is used as the bitlines BL and XBL and the VDD (second power supply in a broad sense) power supply line. A third metal interconnect ME3 is used as the wordline WL and the VSS (first power supply in a broad sense) power supply line, and a fourth metal interconnect ME4 is used as the shield line SDL connected with the power supply VSS. A fifth metal interconnect ME5 in the uppermost layer is used as the global line GL such as the grayscale voltage output line.

FIG. 39B shows an arrangement example of the shield line SDL when using the vertical type cell. In FIG. 39B, the metal interconnect ME1 is used for node connection, and the metal interconnect ME2 is used as the wordline WL and the VDD power supply line. The third metal interconnect ME3 is used as the bitlines BL and XBL and the VSS power supply line, and the fourth metal interconnect ME4 is used as the shield line SDL. The metal interconnect ME5 is used as the global line GL such as the grayscale voltage output line.

In FIGS. 39A and 39B, the bitlines BL and XBL are provided along the direction D1 (direction of the long side of the integrated circuit device), and the shield line SDL is provided along the direction D1 to overlap the bitlines BL and XBL. Specifically, the shield line SDL is formed in the upper layer of the bitlines BL and XBL to cover the bitlines BL and XBL.

This prevents a change in the voltage level of the global line GL such as the grayscale voltage output line from being applied to the bitlines BL and XBL due to capacitive coupling. Therefore, a problem can be prevented in which the voltage levels of the bitlines BL and XBL are changed as shown in FIGS. 37C and 38C, whereby the sense amplifier outputs an incorrect logic.

A slit is formed between the shield lines SDL (i.e. the shield line SDL is not formed over the entire memory cell) by providing the shield line SDL in each memory cell as shown in FIGS. 39A and 39B. Gas can be removed from the space between the metal layer and the insulating film by forming such a slit, whereby reliability and yield can be increased.

In FIG. 39B, the VSS power supply line is disposed at a position of the slit between adjacent shield lines SDL. Therefore, shielding in the vertical direction can be realized by the shield line SDL and shielding in the horizontal direction can be realized by the VSS power supply line, whereby effective shielding can be achieved.

6. Electronic Instrument

Figure 40A:
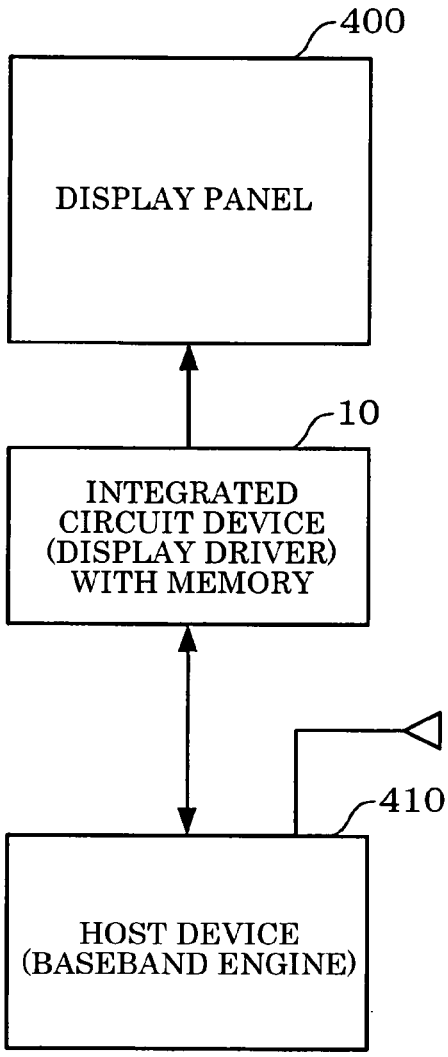
FIGS. 40A and 40B are configuration examples of an electronic instrument.
Figure 40B:
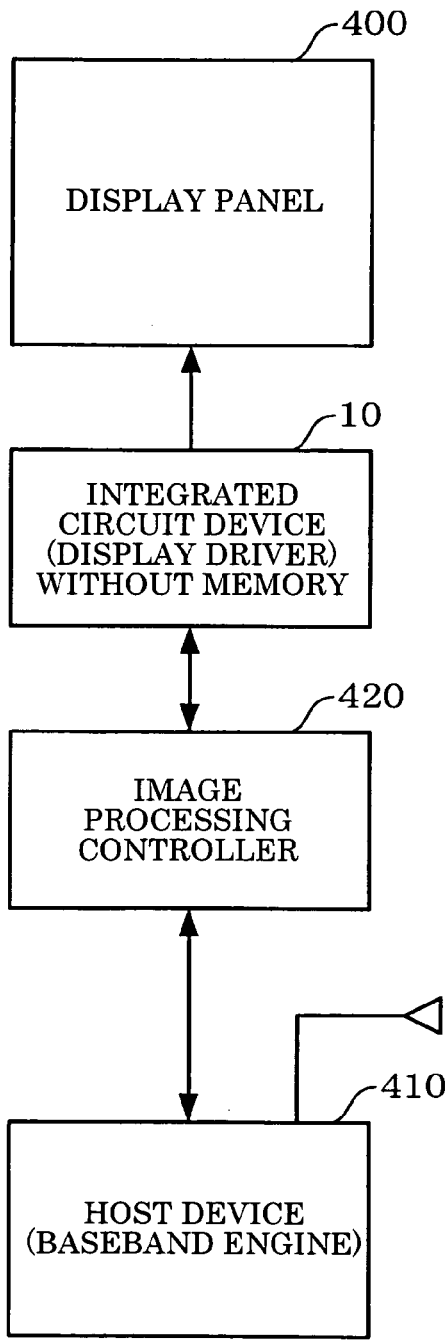

FIGS. 40A and 40B illustrate examples of an electronic instrument (electro-optical device) including the integrated circuit device 10 according to the above embodiment. The electronic instrument may include constituent elements (e.g. camera, operation section, or power supply) other than the constituent elements shown in FIGS. 40A and 40B. The electronic instrument according to this embodiment is not limited to a portable telephone, but may be a digital camera, PDA, electronic notebook, electronic dictionary, projector, rear-projection television, portable information terminal, or the like.

In FIGS. 40A and 40B, a host device 410 is a microprocessor unit (MPU), a baseband engine (baseband processor), or the like. The host device 410 controls the integrated circuit device 10 which is a display driver. The host device 410 may perform processing as an application engine and a baseband engine or processing as a graphic engine such as compression, decompression, and sizing. An image processing controller (display controller) 420 shown in FIG. 40B performs processing as a graphic engine such as compression, decompression, or sizing instead of the host device 410.

A display panel 400 includes a plurality of data lines (source lines), a plurality of scan lines (gate lines), and a plurality of pixels specified by the data lines and the scan lines. A display operation is realized by changing the optical properties of an electro-optical element (liquid crystal element in a narrow sense) in each pixel region. The display panel 400 may be formed by an active matrix type panel using switching elements such as a TFT or TFD. The display panel 400 may be a panel other than an active matrix type panel, or may be a panel other than a liquid crystal panel.

In FIG. 40A, the integrated circuit device 10 may include a memory. In this case, the integrated circuit device 10 writes image data from the host device 410 into the built-in memory, and reads the written image data from the built-in memory to drive the display panel. In FIG. 40B, the integrated circuit device 10 may not include a memory. In this case, image data from the host device 410 is written into a memory provided in the image processing controller 420. The integrated circuit device 10 drives the display panel 400 under control of the image processing controller 420.

Although only some embodiments of the invention have been described in detail above, those skilled in the art would readily appreciate that many modifications are possible in the embodiments without materially departing from the novel teachings and advantages of the invention. Accordingly, such modifications are intended to be included within the scope of the invention. Any term (e.g. output-side I/F region and input-side I/F region) cited with a different term having a broader meaning or the same meaning (e.g. first interface region and second interface region) at least once in the specification and the drawings can be replaced by the different term in any place in the specification and the drawings. The configuration, arrangement, and operation of the integrated circuit device and the electronic instrument are not limited to those described in the embodiment. Various modifications and variations may be made.

What is claimed is:

1. An integrated circuit device comprising:

first to Nth circuit blocks (N is an integer of three or more), the first to Nth circuit blocks being lined along a first direction when a direction from a first side that is a short side of the integrated circuit device toward a third side opposite to the first side is the first direction and a direction from a second side that is a long side of the integrated circuit device toward a fourth side opposite to the second side is a second direction;

a first interface region provided along the fourth side at one side of the first to Nth circuit blocks in the second direction; and a second interface region provided along the second side at another side of the first to Nth circuit blocks in a fourth direction opposite to the second direction, one of the circuit blocks at both ends of the first to Nth circuit blocks being a scan driver block that drives a scan line, the circuit block(s) of the first to Nth circuit blocks excluding the scan driver block including at least one data driver block that drives a data line, the circuit block(s) of the first to Nth circuit blocks excluding the scan driver block and the at least one data driver block including at least one memory block that stores image data, one of the at least one memory block being lined adjacent to one of the at least one data driver block along the first direction, the circuit blocks excluding the scan driver block, the at least one data driver block and the at least one memory block including:

a logic circuit block that sets grayscale characteristic adjustment data, a grayscale voltage generation circuit block that generates a grayscale voltage based on the set adjustment data, and a power supply circuit block that generates a power supply voltage, the one of the at least one data driver block receiving the grayscale voltage from the grayscale voltage generation circuit block and the one of the at least one data driver block driving the data line, and in the at least one memory block, a shield line being provided in an upper layer of a bitline and a grayscale voltage output line to which the grayscale voltage from the grayscale voltage generation circuit block is output being provided in an upper layer of the shield line.

2. The integrated circuit device as defined in claim 1, the power supply circuit block being disposed between the scan driver block and the one of the at least one data driver block.

3. The integrated circuit device as defined in claim 1, the at least one data driver block being disposed between the logic circuit block and the power supply circuit block, the at least one data driver block being disposed between the grayscale voltage generation circuit block and the power supply circuit block.

4. The integrated circuit device as defined in claim 1, the logic circuit block and the grayscale voltage generation circuit block being adjacently lined along the first direction.

5. The integrated circuit device as defined in claim 1, the grayscale voltage generation circuit block being disposed between the data driver block and the logic circuit block.

6. The integrated circuit device as defined in claim 1, the at least one memory block being first to Ith memory blocks (I is an integer of two or more), the at least one data driver being first to Ith data driver blocks, each of the first to Ith memory blocks being lined adjacent to a data driver block of the first to Ith data driver blocks along the first direction, the one of the at least one memory block being the first memory block, and the one of the at least one data driver block being the first data driver block.

7. The integrated circuit device as defined in claim 1, the grayscale voltage generation circuit block including a select voltage generation circuit that outputs a select voltage based on a power supply voltage, and a grayscale voltage select circuit that selects and outputs the grayscale voltage based on the adjustment data set by the logic circuit block and the select voltage.

8. The integrated circuit device as defined in claim 7, the select voltage generation circuit being disposed at a side of the grayscale voltage select circuit in the second direction or the fourth direction.

9. The integrated circuit device as defined in claim 7, the grayscale voltage select circuit being disposed between the data driver block and the logic circuit block.

10. The integrated circuit device as defined in claim 1, a grayscale voltage output line to which the grayscale voltage from the grayscale voltage generation circuit block is output being provided over the first to Nth circuit blocks along the first direction.

11. The integrated circuit device as defined in claim 1, in the at least one memory block, the bitline being provided along the first direction and the shield line being provided along the first direction to overlap the bitline.

12. An electronic instrument comprising:

the integrated circuit device as defined in claim 1; and a display panel driven by the integrated circuit device.

13. The integrated circuit device as defined in claim 1, the scan driver block being a first scan driver block, the circuit block(s) of the first to Nth circuit blocks excluding the first scan driver block, the at least one data driver block and the at least one memory block including a second scan driver block that scans another scan line, another of the circuit blocks at the both ends of the first to Nth circuit blocks being the second scan driver block.

14. The integrated circuit device as defined in claim 13, the circuit blocks excluding the first scan driver block, the at least one data driver block, the at least one memory block and the second scan driver including a logic circuit block that sets grayscale characteristic adjustment data, a grayscale voltage generation circuit block that generates a grayscale voltage based on the set adjustment data, and a power supply circuit block that generates a power supply voltage, the one of the at least one data driver block receiving the grayscale voltage from the grayscale voltage generation circuit block, and the one of the at least one data driver block driving drives the data line, the power supply circuit block being disposed between the first scan driver block and the data driver block, and the logic circuit block and the grayscale voltage generation circuit block being disposed between the second scan driver block and the one of the at least one data driver block.

* * * * *